US005744279A

United States Patent [19]

Ezoe et al.

[11] Patent Number: 5,744,279

[45] Date of Patent: Apr. 28, 1998

[54] SILVER HALIDE PHOTOGRAPHIC MATERIAL

[75] Inventors: Toshihide Ezoe; Toshiaki Kubo; Hiroshi Takeuchi; Kazunobu Katoh; Shigeo Hirano; Kazuki Yamazaki; Takashi Hoshimiya; Minoru Sakai; Tetsuo Yoshida, all of Kanagawa, Japan

[73] Assignee: Fuji Photo Film Co., Ltd., Kanagawa, Japan

[21] Appl. No.: 595,478

[22] Filed: Feb. 1, 1996

[30] Foreign Application Priority Data

| | | | |
|---|---|---|---|
| Feb. 3, 1995 | [JP] | Japan | 7-37817 |
| Feb. 3, 1995 | [JP] | Japan | 7-37823 |
| Feb. 3, 1995 | [JP] | Japan | 7-37824 |
| Feb. 3, 1995 | [JP] | Japan | 7-37827 |
| Feb. 14, 1995 | [JP] | Japan | 7-47901 |
| Feb. 23, 1995 | [JP] | Japan | 7-58236 |

[51] Int. Cl.[6] ..... G03C 1/06

[52] U.S. Cl. ..... 430/264; 430/598; 430/599; 430/600; 430/601

[58] Field of Search ..... 430/264, 598, 430/599, 600, 601

[56] References Cited

U.S. PATENT DOCUMENTS

| | | | |
|---|---|---|---|
| 4,987,052 | 1/1991 | Hirano et al. | 430/264 |
| 5,229,248 | 7/1993 | Sanpei et al. | 430/264 |
| 5,229,249 | 7/1993 | Katoh et al. | 430/264 |

*Primary Examiner*—Geraldine Letscher

*Attorney, Agent, or Firm*—Sughrue, Mion, Zinn, Macpeak & Seas, PLLC

[57] ABSTRACT

A silver halide photographic material is disclosed, comprising a support having provided thereon at least one silver halide emulsion layer, at least one layer of the emulsion layer and other hydrophilic colloid layers containing at least one hydrazine-type nucleating agent having, in the vicinity of the hydrazine group, an anionic group or a nonionic group which forms an intramolecular hydrogen bond with a hydrogen atom of the hydrazine, and also containing at least one of the onium salt compounds represented by formulae (a), (b) and (c), or at least one of the amine compounds represented by formulae (d), (e), (f), (g), (h), (i) and (j). Also disclosed is a method for processing, after exposure, the silver halide photographic material described above with a developer containing a reductone-type developing agent and having a pH of 12 or less.

16 Claims, No Drawings

SILVER HALIDE PHOTOGRAPHIC MATERIAL

FIELD OF THE INVENTION

The present invention relates to a silver halide photographic material, particularly, it relates to a silver halide photographic material capable of achieving a high contrast negative image useful in the photomechanical process.

BACKGROUND OF THE INVENTION

In order to improve the photographic properties (e.g., sensitivity, fog, rapid processability) of a silver halide light-sensitive material, various additives have been proposed.

It is known to add a hydrazine compound to a silver halide photographic emulsion or a developer as described in U.S. Pat. Nos. 3,730,727, 3,227,552, 3,386,831 and 2,419,975, Mees, *The Theory of Photographic Process,* 3rd ed., p. 281 (1966).

Further, as a compound (nucleation accelerator) for accelerating the infectious development action of the hydrazine compound, an amine or an onium salt is known, and when the hydrazine compound is used in combination, the activation is elevated to provide good photographic capability, which is described in JP-A-60-140340 (the term "JP-A" as used herein means an "unexamined published Japanese patent application"), JP-A-61-47945, JP-A-61-47924, JP-A-61-167939, JP-A-62-250439, JP-A-62-280733, JP-A-1-179930, JP-A-2-2542 and JP-A-4-62544.

On the other hand, a photographic light-sensitive material-having coated therein a silver halide emulsion is generally subjected to various pressures. For example, a general photographic negative film or a film for laser exposure may be folded or pulled when it is loaded into a camera or scanner. A sheet film such as a general light-sensitive material for printing or a direct X-ray light-sensitive material for medical field is treated directly with a hand by a man and accordingly, it is frequently bent. Further, all light-sensitive materials are subjected to a great pressure upon cutting or processing.

When various pressures are applied to the photographic light-sensitive material as described above, silver halide is pressured through a medium such as gelatin as a holder (binder) of silver halide grains or a plastic film as a support. It is known that when the silver halide grains are pressured, the photographic properties of the photographic light-sensitive material change, and this is described in detail, for example, in K. B. Mather, *J. Opt. Soc. Am.*

The silver halide light-sensitive material is demanded to have not only good photographic properties but also capability on a higher level with respect to the toughness such as pressure property and storability.

A highly activated hydrazine derivative is known, when it is highly activated by an onium salt, to exhibit good photographic activities but at the same time to deteriorate the storability. When a highly active hydrazine compound is used in combination with an amine compound, good photographic performance can be obtained as well, but the pressure property is very worsened to cause a practical problem. And, it is found that if the hydrazine derivative is further highly activated, the pressure fog increases. In other words, good photographic properties cannot be achieved concurrently with the pressure property and storability and a technique for overcoming this problem is being demanded.

SUMMARY OF THE INVENTION

The object of the present invention is to provide a silver halide photographic light-sensitive material capable of satisfying the photographic performance, the pressure property and the storability even when a hydrazine compound and an onium salt compound are used in combination.

The object of the present invention can be achieved by the following inventions:

(1) a silver halide photographic material comprising a support having provided thereon at least one silver halide emulsion layer, at least one layer of said emulsion layer and other hydrophilic colloid layers containing at least one hydrazine-type nucleating agent having, in the vicinity of the hydrazine group, an anionic group, or a nonionic group which forms an intramolecular hydrogen bond with a hydrogen atom of the hydrazine, and containing at least one of the onium salt compounds-represented by formula (a), (b) and (c):

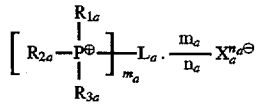

(a)

wherein $R_{1a}$, $R_{2a}$ and $R_{3a}$ each represents an alkyl group, a cycloalkyl group, an aryl group, an alkenyl group, a cycloalkenyl group or a heterocyclic residue, which each may be substituted; $m_a$ represents an integer of from 1 to 4; $L_a$ represents an $m_a$-valent organic group bonded to the P atom through the carbon atom thereof; $n_a$ represents an integer of from 1 to 3; $X_a$ represents an $n_a$-valent anion; and $X_a$ may be linked to $L_a$;

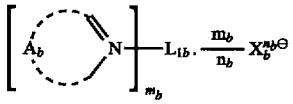

(b)

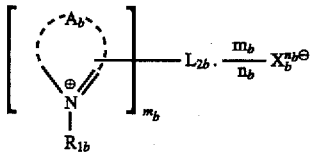

(c)

wherein $A_b$ represents an organic group necessary for completing a heterocyclic ring; $R_{1b}$ represents an alkyl group or an aryl group; $L_{1b}$ and $L_{2b}$ each represents an $m_b$-valent organic group; $X_b$ represents an anion group; $X_b$ may be linked to $R_{1b}$, $L_{1b}$ or $L_{2b}$; $m_b$ represents an integer of from 1 to 6; and $n_b$ represents an integer of from 1 to 3;

(2) a silver halide photographic material as described in item (1), which contains a polymer latex having an active methylene group.

The hydrazine-base nucleating agent for use in the present invention having, in the vicinity of the hydrazine group, an anionic group or a nonionic group which forms an intramolecular hydrogen bond with the hydrogen atom of the hydrazine is described below in detail.

Examples of the anionic group include a carboxylic acid, a sulfonic acid, a sulfinic acid, a phosphoric acid, a phosphonic acid and a salt of these. The term "in the vicinity of the hyrazine group" as used herein means that a bond chain formed of from 2 to 5 atoms of at least one selected from a carbon atom, a nitrogen atom, an oxygen atom and a sulfur atom is present between the nitrogen atom near the anionic group of hydrazine and the anionic group. Preferably, a bond chain formed of from 2 to 5 atoms of at least one selected from a carbon atom and a nitrogen atom is present, and more preferably, a bond chain formed of 2 or 3 carbon atoms is present.

The nonionic group which forms a hydrogen bond together with the hydrogen atom of the hydrazine is a group having a lone electron pair and a group capable of forming a 5-, 6- or 7-membered ring along with the lone electron pair and the hydrogen bond between the lone electron pair and the hydrogen atom of the hydrazine. Therefore, the nonionic group contains at least one of an oxygen atom, a nitrogen atom, a sulfur atom and a phosphorus atom. Examples of the nonionic group include an alkoxy group, an amino group, an alkylthio group, a carbonyl group, a carbamoyl group, an alkoxycarbonyl group, a urethane group, a ureido group, an acyloxy group and an acylamino group.

Among these, an anionic group is preferred and a carboxylic acid or a salt thereof is most preferred. The nucleating agent for use in the present invention is preferably a compound represented by the following formula (i), (ii) or (iii):

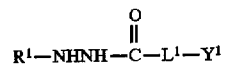

(i)

wherein $R^1$ represents an alkyl group, an aryl group or a heterocyclic group, $L^1$ represents a divalent linking group having an electron withdrawing group and $Y^1$ represents an anionic group or a nonionic group which forms an intramolecular hydrogen bond with the hydrogen atom of hydrazine;

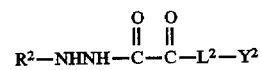

(ii)

wherein $R^2$ represents an alkyl group, an aryl group or a heterocyclic group, $L^2$ represents a divalent linking group and $Y^2$ represents an anionic group or a nonionic group which forms an intramolecular hydrogen bond with the hydrogen atom of hydrazine; or

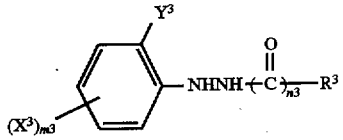

(iii)

wherein $X^3$ represents a group capable of bonding to the benzene ring, $R^3$ represents an alkyl group, an alkenyl group, an alkynyl group, an aryl group, a heterocyclic group, an alkoxy group or an amino group, $Y^3$ represents an anionic group or a nonionic group which forms an intramolecular hydrogen bond with the hydrogen atom of hydrazine, $m^3$ represents an integer of from 0 to 4, $n^3$ represents 1 or 2, and when $n^3$ is 1, $R^3$ has an electron withdrawing group.

Formulae (i) to (iii) are described below in greater detail.

The alkyl group represented by $R^1$ or $R^2$ includes a linear, branched or cyclic alkyl group having from 1 to 16, preferably from 1 to 12 carbon atoms and examples thereof include methyl, ethyl, propyl, isopropyl, t-butyl, allyl, propargyl, 2-butenyl, 2-hydroxyethyl, benzyl, benzhydryl, trityl, 4-methylbenzyl, 2-methoxyethyl, cyclopentyl and 2-acetamidoethyl. The aryl group represented by $R^1$ or $R^2$ includes an aryl group having from 6 to 24, preferably from 6 to 12 carbon atoms and examples thereof include phenyl, naphthyl, p-alkoxyphenyl, p-sulfonamidophenyl, p-ureidophenyl and p-amidophenyl. The heterocyclic group represented by $R^1$ or $R^2$ includes a 5- or 6-membered, saturated or unsaturated heterocyclic ring having from 1 to 5 carbon atoms and containing one or more of an oxygen atom, a nitrogen atom and a sulfur atom. The number of and the kind of element for the hetero atom constituting the ring may be single or in plurality and examples of the heterocyclic ring include 2-furyl, 2-thienyl and 4-pyridyl.

$R^1$ and $R^2$ each is preferably an aryl group, an aromatic heterocyclic group or an aryl-substituted methyl group, more preferably an aryl group (e.g., phenyl, naphthyl). $R^1$ and $R^2$ each may be substituted by a substituent and examples of the substituent include an alkyl group, an aralkyl group, an alkoxy-, alkyl- or aryl-substituted amino group, an amido group, a sulfonamido group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, a carboxyl group and a phosphoric acid amido group. These groups each may further be substituted. Among these, a sulfonamido group, a ureido group, an amido group, an alkoxy group and a urethane group are preferred, and a sulfonamido group and a ureido group are more preferred. These groups may be combined with each other to form a ring, if possible.

The alkyl group, the aryl group and the heterocyclic group represented by $R^3$ include those described above for $R^1$. The alkenyl group includes an alkenyl group having from 2 to 18, preferably from 2 to 10 carbon atoms and examples thereof include vinyl and 2-styryl. The alkynyl group includes an alkynyl group having from 2 to 18, preferably from 2 to 10 carbon atoms and examples thereof include ethynyl and phenylethynyl. The alkoxy group includes a linear, branched or cyclic alkoxy group having from 1 to 16, preferably from 1 to 10 carbon atoms and examples thereof include methoxy, isopropoxy and benzyloxy. The amino group includes an amino group having from 0 to 16, preferably from 1 to 10 carbon atoms and examples thereof include ethylamino, benzylamino and phenyl amino. When $n^3$ is 1, $R^3$ is preferably an alkyl group, an alkenyl group or an alkynyl group. When $n^3$ is 2, $R^3$ is preferably an amino group or an alkoxy group.

The electron withdrawing group which $R^3$ has includes an electron withdrawing group having a Hammett's $\sigma_m$ value of 0.2 or more, preferably 0.3 or more, and examples thereof include a halogen atom (e.g., fluorine, chlorine, bromine), a cyano group, a. sulfonyl group (e.g., methanesulfonyl, benzenesulfonyl), a sulfinyl group (e.g., methanesulfinyl), an acyl group (e.g., acetyl, benzoyl), an oxycarbonyl group (e.g., methoxycarbonyl), a carbamoyl group (e.g., N-methylcarbamoyl), a sulfamoyl group (e.g., methylsulfamoyl), a halogen-substituted alkyl group (e.g., trifluoromethyl), a heterocyclic group (e.g., 2-benzoxazolyl, pyrrolo) and a quaternary onium salt (e.g., triphenylphosphonium, trialkylammonium, pyridinium). Examples of $R^3$ having an electron withdrawing group include trifluoromethyl, difluoromethyl, pentafluoroethyl, cyanomethyl, methanesulfonylmethyl, acetylethyl, trifluoromethylethynyl and ethoxycarbonylmethyl.

$L^1$ and $L^2$ each represents a divalent linking group and includes an alkylene group, an alkenylene group, an alkynylene group, an arylene group, a divalent heterocyclic group and a group formed by linking these groups through an individual group or a combination of —O—, —S—, —NH—, —CO— and —SO2—. $L^1$ and $L^2$ each may be substituted by a group described above as the substituent for $R^1$. Examples of the alkylene group include methylene, ethylene, trimethylene, propylene, 2-buten-1,4-yl and 2-butin-1,4-yl. Examples of the alkenylene group include vinylene. Examples of the alkynylene group include ethynylene. Examples of the arylene group include phenylene. Examples of the divalent heterocyclic group include furan-1,4-diyl. $L^1$ is preferably an alkylene group, an alkenylene group, an alkynylene group or an arylene group, more preferably an alkylene group, most preferably an alkylene group having a chain length of from 2 to 3 carbon atoms. $L^2$ is preferably an alkylene group, an arylene group, —NH-alkylene—, —O-alkylene—or —NH-arylene—, more preferably —NH-alkylene— or —O-alkylene—.

The electron withdrawing group which $L^1$ has includes those described above as the electron withdrawing group which $R^3$ has. Examples of $L^1$ include tetrafluoroethylene, fluoromethylene, hexafluorotrimethylene, perfluorophenylene, difluorovinylene, cyanomethylene and methanesulfonylethylene.

$Y^1$, $Y^2$ and $Y^3$ each represents an anionic group or a nonionic group having a lone electron pair which are a 5-, 6- or 7-membered ring and form an intramolecular hydrogen bond with the hydrogen atom of hydrazine. Examples of the anionic group include a carboxylic acid, a sulfonic acid, a sulfinic acid, a phosphoric acid, a phosphonic acid and a salt of these. Examples of the salt include an alkali metal ion (e.g., sodium, potassium), an alkali earth metal ion (e.g., calcium, magnesium), an ammonium (e.g., ammonium, triethylammonium, tetrabutylammonium, pyridinium) and a phosphonium (e.g., tetraphenylphosphonium). The nonionic group is a group having at least one of an oxygen atom, a nitrogen atom, a sulfur atom and a phosphorus atom and examples thereof include an alkoxy group, an amino group, an alkylthio group, a carbonyl group, a carbamoyl group, an alkoxycarbonyl group, a urethane group, a ureido group, an acyloxy group and an acylamino group. $Y^1$, $Y^2$ and $Y^3$ each is preferably an anionic group, more preferably a carboxylic acid or a salt thereof.

Examples and preferred examples of the group capable of bonding to the benzene ring represented by $X^3$ include those described above as the substituent which $R^1$ in formula (i) has. When $m^3$ is 2 or greater, the $X^3$ groups may be the same or different.

$R^1$, $R^2$, $R^3$ and $X^3$ each may have a non-diffusible group which is used for a photographic coupler or may have an adsorption accelerating group to silver halide. The non-diffusible group includes a non-diffusible group having from 8 to 30, preferably from 12 to 25 carbon atoms. Preferred examples of the adsorption accelerating group to silver halide include thioamidos (e.g., thiourethane, thioureido, thioamido), mercaptos (e.g., heterocyclic mercapto such as 5-mercaptotetrazole, 3-mercapto-1,2,4-triazole, 2-mercapto-1,3,4-thiadiazole and 2-mercapto-1,3,4-oxadiazole, alkylmercapto, arylmercapto) and 5- or 6-membered nitrogen-containing heterocyclic rings capable of forming imino silver (e.g., benzotriazole). The group having an adsorption accelerating group to silver halide includes those having such a structure that an adsorption group is protected and the protective group is removed upon development processing to increase the adsorptivity to silver halide.

In formulae (i) to (iii), the radicals resulting from removal of respective hydrogen atoms of two compounds may be combined with each other to form a bis form.

Among formulae (i) to (iii), formulae (i) and (ii) are preferred, and formula (i) is more preferred. The compound represented by formula (i), (ii) or (iii) is more preferably represented by formula (iv), (v) or (vi), most preferably by formula (iv):

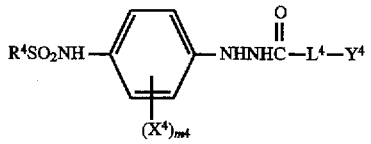

(iv)

wherein $R^4$, $X^4$ and $m^4$ have the same meaning as $R^3$, $X^3$ and $m^3$ in formula (iii), respectively, and $L^4$ and $Y^4$ have the same meaning as $L^1$ and $Y^1$ in formula (i), respectively;

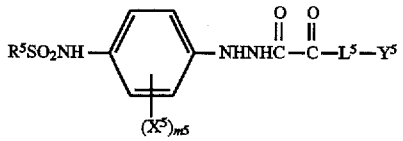

(v)

wherein $R^5$, $X^5$ and $m^5$ have the same meaning as $R^3$, $X^3$ and $m^3$ in formula (iii), respectively, and $L^5$ and $Y^5$ have the same meaning as $L^2$ and $Y^2$ in formula (ii), respectively;

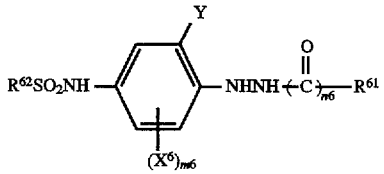

(vi)

wherein $R^{61}$, $R^{62}$, $X^6$, $m^6$, $n^6$ and Y have the same meaning as $R^3$, $R^3$, $X^3$, $m^3$, $n^3$ and $Y^3$ in formula (iii), respectively.

Specific examples of the nucleating agent for use in the present invention are set forth below, but the present invention is by no means limited to these.

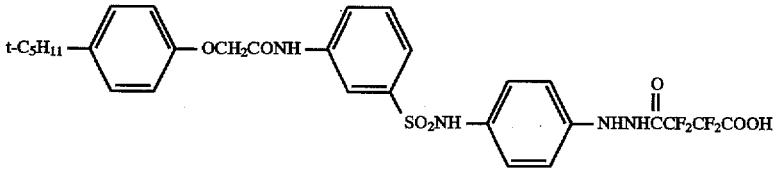

H-1

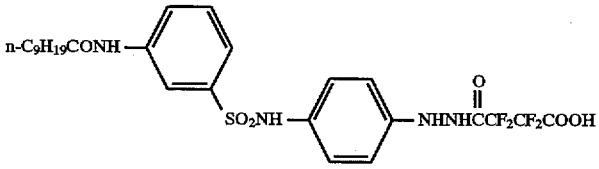

H-2

-continued
H-3
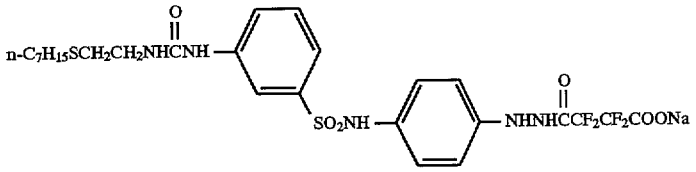
H-4
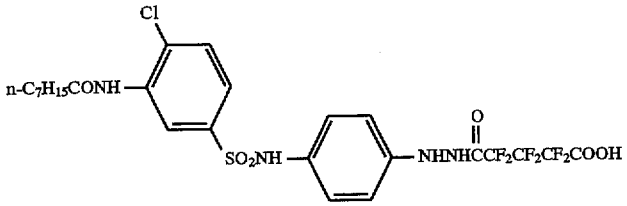
H-5
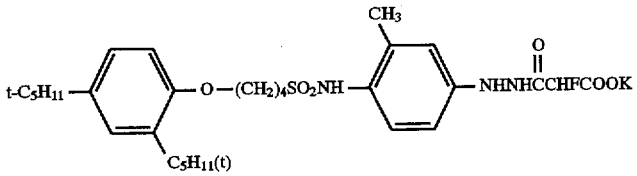
H-6
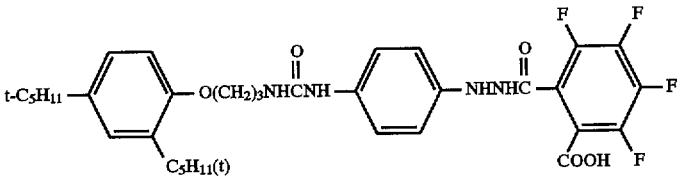
H-7
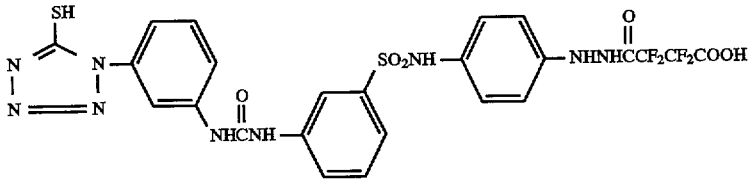
H-8
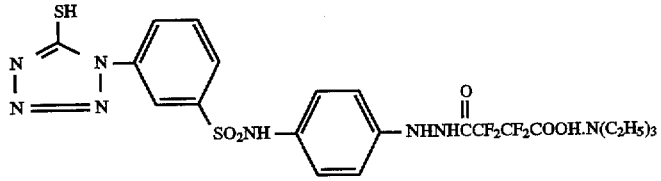
H-9
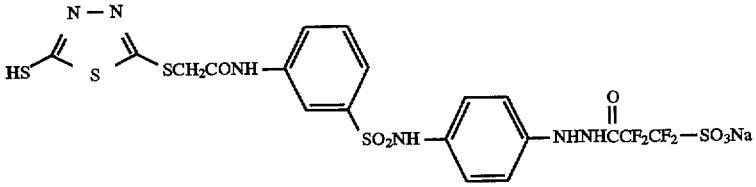
H-10
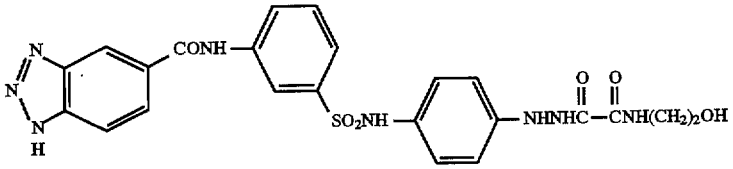

-continued
H-11
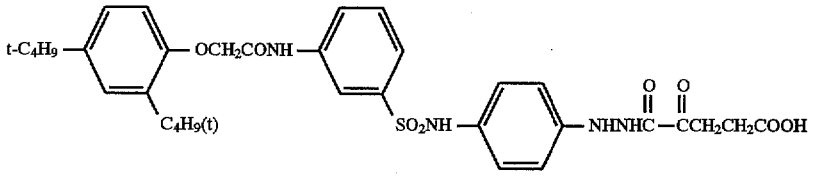
H-12
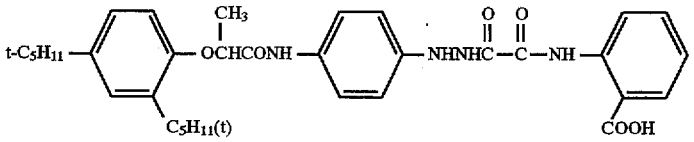
H-13
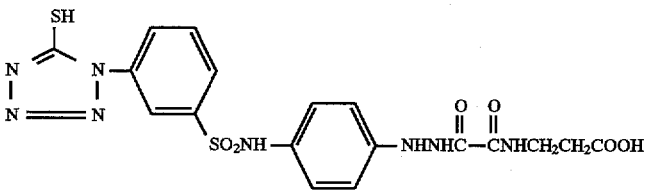
H-14
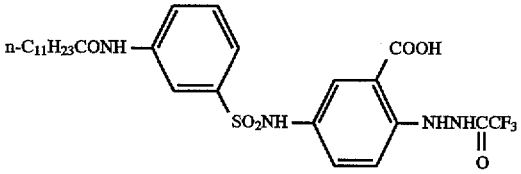
H-15
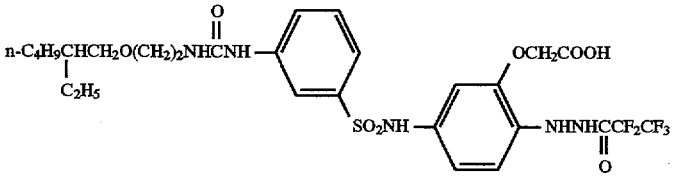
H-16
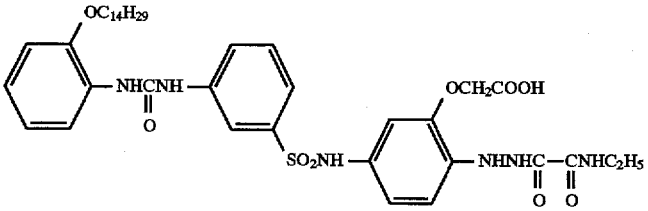
H-17
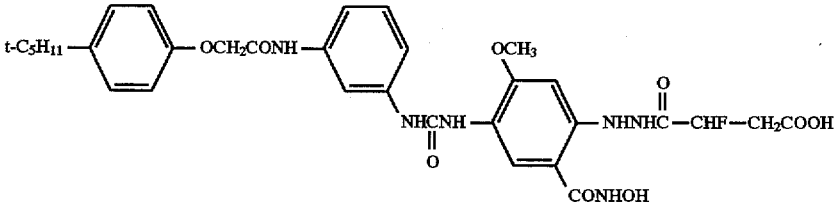
H-18
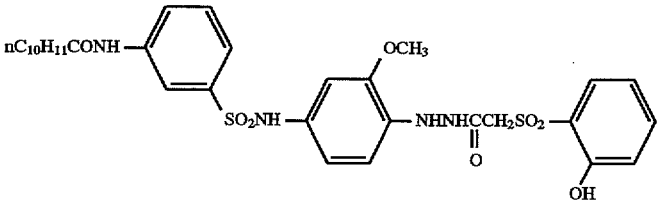

-continued
H-19
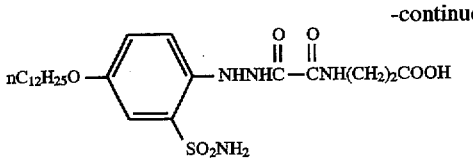
H-20
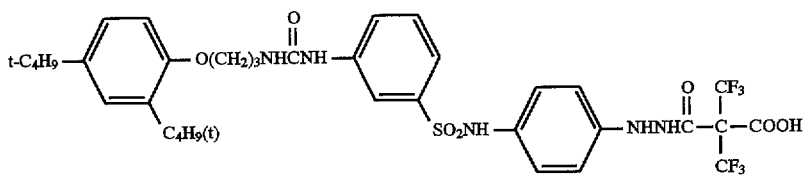
H-21
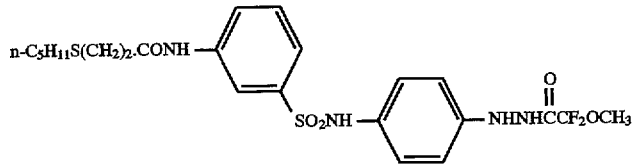
H-22
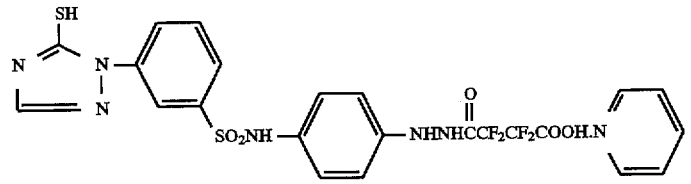
H-23
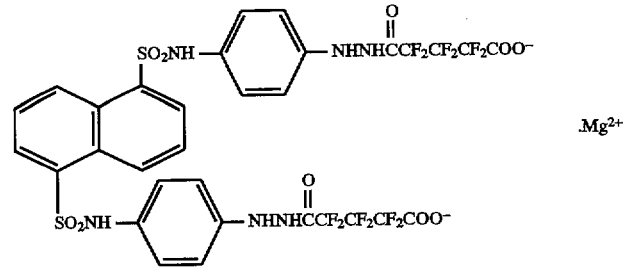
H-24
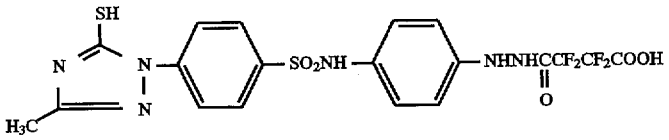
H-25
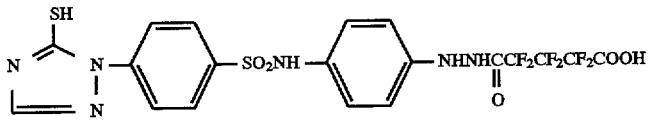
H-26
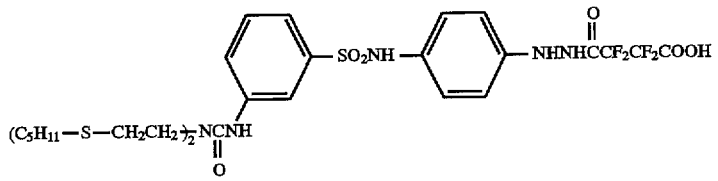
H-27
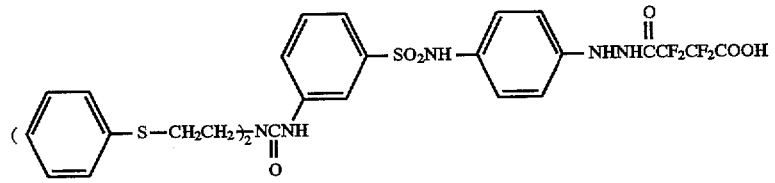

-continued

H-28

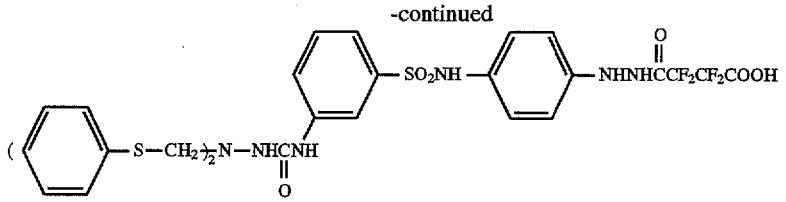

H-29

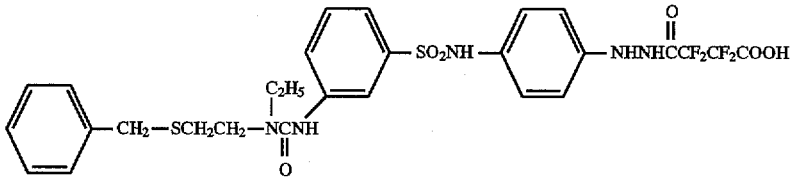

H-30

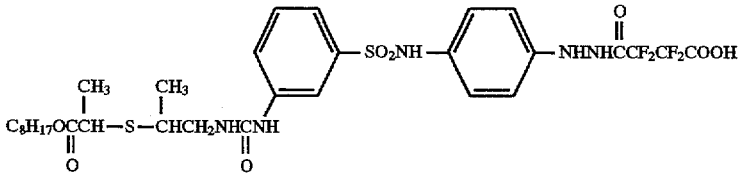

H-31

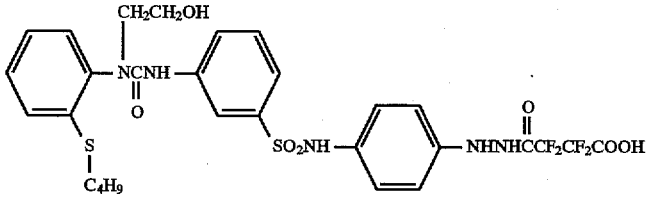

H-32

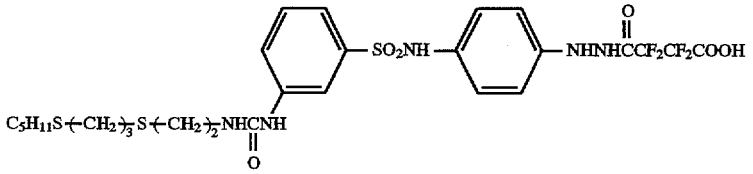

The hydrazine-base nucleating agent of the present invention-may be used by dissolving it in an appropriate water-miscible organic solvent, such as alcohols (e.g., methanol, ethanol, propanol, fluorinated alcohol), ketones (e.g., acetone, methyl ethyl ketone), dimethylformamide, dimethylsulfoxide or methyl cellosolve.

Also, it may be used by a well-known emulsion-dispersion method, for example, by dissolving it in an oil such as dibutyl phthalate, tricresyl phosphate, glyceryl triacetate or diethyl phthalate, or an auxiliary solvent such as ethyl acetate or cyclohexanone, and then mechanically forming the solution into an emulsified dispersion. Further, it may be used by dispersing a hydrazine derivative powder in water using a ball mill, a colloid mill or an ultrasonic wave according to a method known as a solid dispersion method.

The hydrazine nucleating agent of the present invention may be added to any layer of silver halide emulsion layers or other hydrophilic colloid layers on the silver halide emulsion layer side of the support, but it is preferably added to the silver halide emulsion layer or a hydrophilic colloid layer adjacent to the silver halide emulsion layer.

The addition amount of the nucleating agent of the present invention is preferably from $1\times10^{-6}$ to $1\times10^{-2}$ mol, more preferably from $1\times10^{-5}$ to $5\times10^{-3}$ mol, most preferably from $5\times10^{-5}$ to $1\times10^{-3}$ mol, per mol of silver halide.

Formula (a) is described in detail.

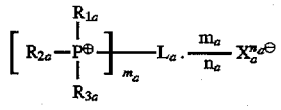

(a)

wherein $R_{1a}$, $R_{2a}$ and $R_{3a}$ each represents an alkyl group, a cycloalkyl group, an aryl group, an alkenyl group, a cycloalkenyl group or a heterocyclic residue, and these groups each may have a substituent.

$m_a$ represents an integer, $L_a$ represents an $m_a$-valent organic group bonded to the P atom through the carbon atom thereof, $n_a$ represents an integer of from 1 to 3, $X_a$ represents an $n_a$-valent anion and $X_a$ may be linked to $L_a$.

Examples of the groups represented by $R_{1a}$, $R_{2a}$ and $R_{3a}$ include a linear or branched alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group and an octadecyl group; an aralkyl group such as a substituted or unsubstituted benzyl group; a cycloalkyl group such as a cyclopropyl group, a cyclopentyl group and a cyclohexyl group; an aryl group such as a phenyl group, a naphthyl group and a phenanthryl group; an alkenyl group such as an allyl group, a vinyl group and a 5-hexenyl group; a cycloalkenyl group such as a cyclopentenyl group and a cyclohexenyl group;

and a heterocyclic residue such as a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group and a pyrrolidyl group. Examples of the substituent which $R_{1a}$, $R_{2a}$ and $R_{3a}$ may have include, besides the groups represented by $R_{1a}$, $R_{2a}$ and $R_{3a}$, a halogen atom such as a fluorine atom, a chlorine atom, a bromine atom and an iodine atom, a nitro group, a primary, secondary or tertiary amino group, an alkyl- or aryl-ether group, an alkyl- or arylthioether group, a carbonamido group, a carbamoyl group, a sulfonamido group, a sulfamoyl group, a hydroxyl group, a sulfoxy group, a sulfonyl group, a carboxyl group, a sulfonic acid group, a cyano group and a carbonyl group. Examples of the group represented by $L_a$ include the groups represented by $R_{1a}$, $R_{2a}$ or $R_{3a}$, a polymethylene group such as a trimethylene group, a tetramethylene group, a hexamethylene group, a pentamethylene group, an octamethylene group and a dodecamethylene group, a divalent aromatic group such as a phenylene group, a biphenylene group and a naphthylene group, a polyvalent aliphatic group such as a trimethylenemethyl group and a tetramethylenemethyl group, and a polyvalent aromatic group such as a phenylene-1,3,5-toluyl group and a phenylene-1,2,4,5-tetrayl group.

Examples of the anion represented by $X_a$ include a halogen ion such as chlorine ion, a bromine ion and an iodine ion, a carboxylate ion such as an acetate ion, an oxalate ion, a fumarate ion and a benzoate ion, a sulfonate ion such as p-toluenesulfonate, methanesulfonate, butanesulfonate and benzenesulfonate, a sulfate ion, a perchlorate ion, a carboxylate ion and a nitrate ion.

In formula (a), $R_{1a}$, $R_{2a}$ and $R_{3a}$ each is preferably a group having 20 or less carbon atoms, more preferably an aryl group having 15 or less carbon atoms. $m_a$ is preferably 1 or 2, and when $m_a$ is 1, $L_a$ is preferably a group having 20 or less carbon atoms, more preferably an alkyl or aryl group having a total carbon number of 15 or less. When $m_a$ is 2, the divalent organic group represented by $L_a$ is preferably an alkylene group, an arylene group, a divalent group formed by connecting these groups, or a divalent group formed by combining these groups with a —CO— group, an —O— group, an —$NR_4$a— group (wherein $R_{4a}$ represents a hydrogen atom or a group having the same meaning as $R_{1a}$, $R_{2a}$ or $R_{3a}$, and when a plurality of $R_{4a}$ groups are present in the molecule, they may be the same or different or may be combined with each other), an —S— group, an —SO— group or an —$SO_2$— group. When $m_a$ is 2, $L_a$ is particularly preferably a divalent group having a total carbon number of 20 or less bonded to the P atom through the carbon atom thereof. When $m_a$ is an integer of 2 or greater, $R_{1a}$, $R_{2a}$ and $R_{3a}$ each is present in plurality in the molecule, and the plurality of $R_{1a}$, $R_{2a}$ or $R_{3a}$ may be the same or different.

$n_a$ is preferably 1 or 2 and $m_a$ is preferably 1 or 2. $X_a$ may be bonded to $R_{1a}$, $R_{2a}$, $R_{3a}$ or $L_a$ to form an inner salt.

Many of the compounds represented by formula (a) of the present invention are known and commercially available as a reagent. The general synthesis method includes a method of reacting a phosphinic acid with an alkylating agent such as an alkyl halide or a sulfonic ester and a method of exchanging the counter anion of a phosphonium salt by a usual method.

Specific examples of the compound represented by formula (a) are set forth below, but the present invention is by no means limited to these compounds.

A-101

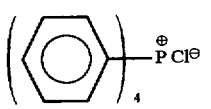

A-102

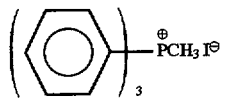

A-103

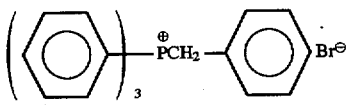

A-104

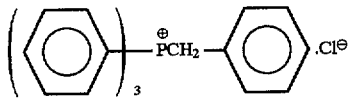

A-105

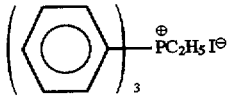

A-106

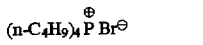

A-107

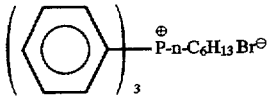

A-108

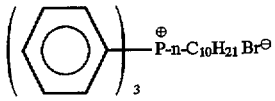

A-109

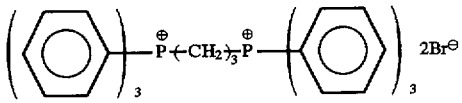

A-110

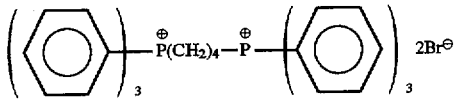

A-111

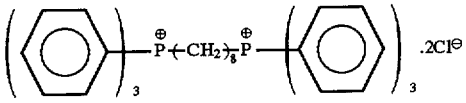

A-112

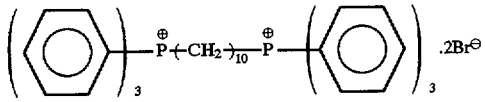

A-113

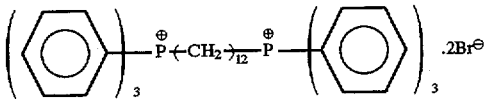

-continued
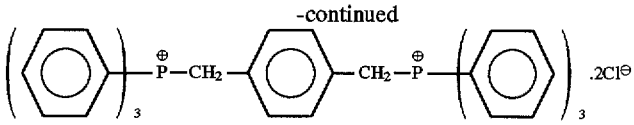
A-114
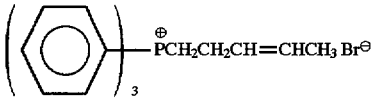
A-115
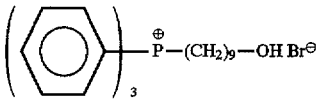
A-116
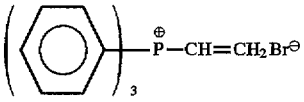
A-117
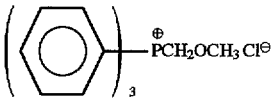
A-118
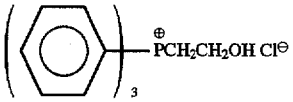
A-119
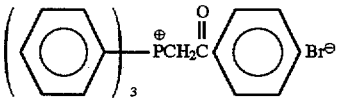
A-120
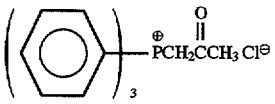
A-121
$(n\text{-}C_4H_9)_3\overset{\oplus}{P}CH_2CH_2OH\ Br^{\ominus}$
A-122
$(n\text{-}C_4H_9)_3\overset{\oplus}{P}C_2H_5.\ \frac{1}{2}\ .SO_4^{2\ominus}$
A-123
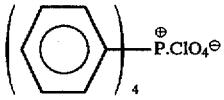
A-124
$Ph_3\overset{\oplus}{P}-(CH_2)_4COOH\ Br^{\ominus}$
A-125
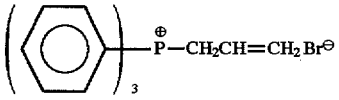
A-126
$(n\text{-}C_4H_9)_3\overset{\oplus}{P}\text{-}n\text{-}C_{16}H_{33}\ Br^{\ominus}$
A-127
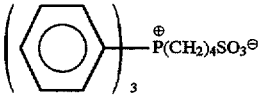
A-128
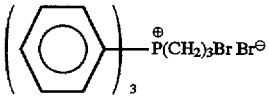
A-129
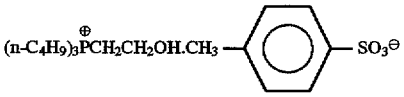
A-130
$(n\text{-}C_4H_9)_3\overset{\oplus}{P}CH_3I^{\ominus}$
A-131
$(HOCH_2)_3\overset{\oplus}{P}CH_3I^{\ominus}$
A-132
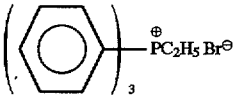
A-133
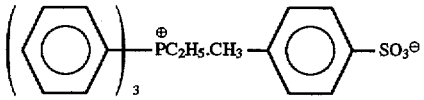
A-134
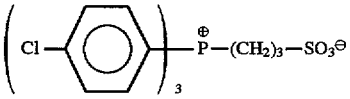
A-135
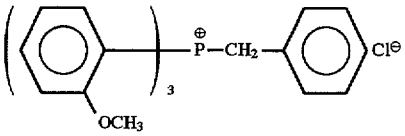
A-136
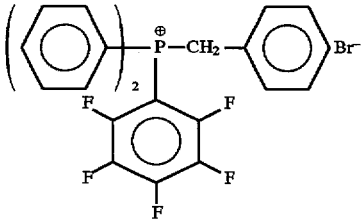
A-137

-continued
A-138
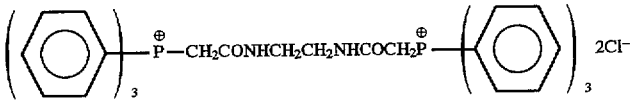
A-139
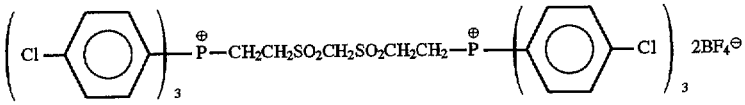
A-140
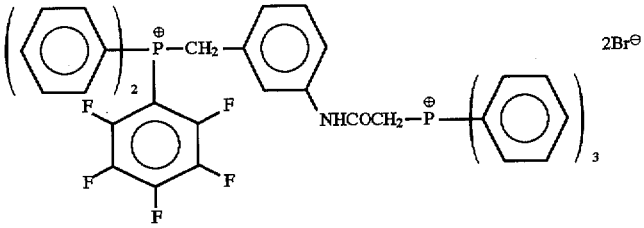
A-141
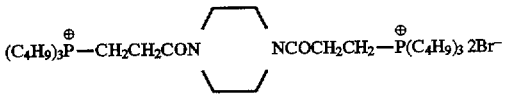
A-142
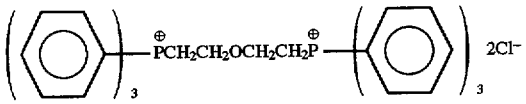
A-143
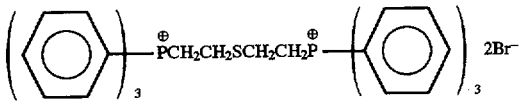
A-144
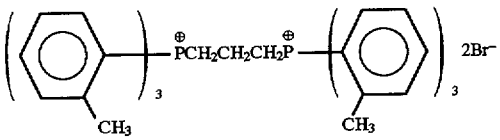
A-145
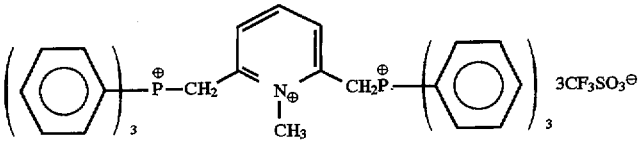
A-146
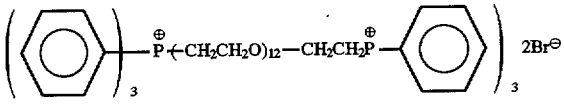
A-147
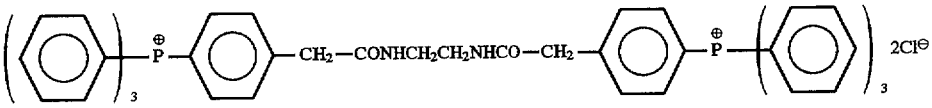
A-148
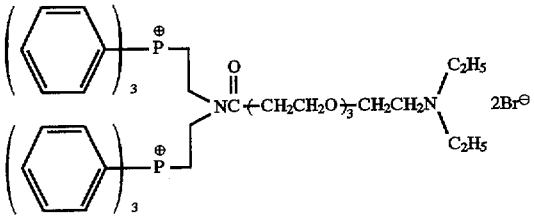
A-149
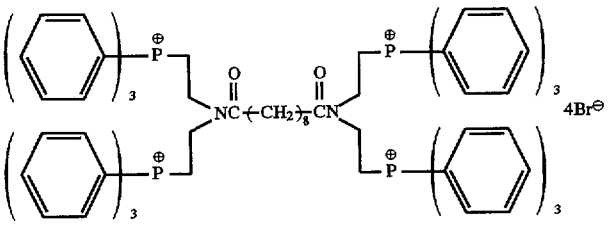

-continued

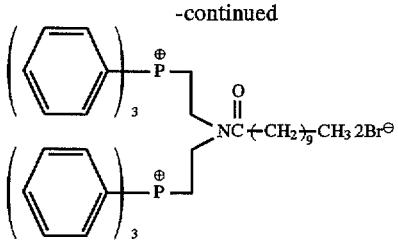

A-150

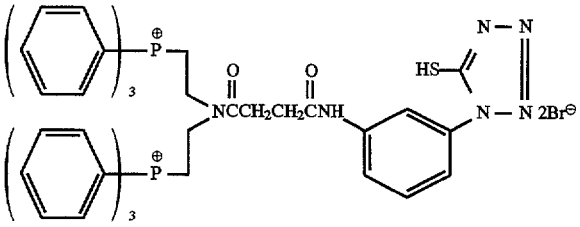

A-151

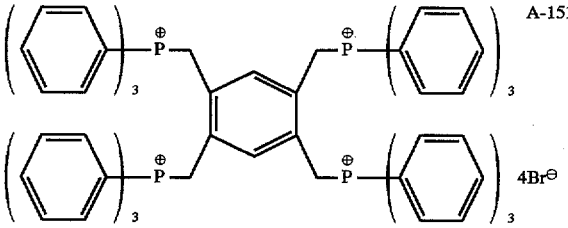

A-151

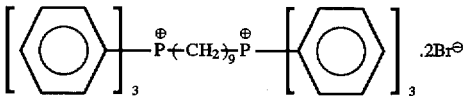

A-152

Formulae (b) and (c) are described below in greater detail.

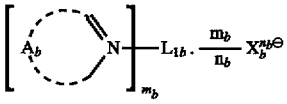

(b)

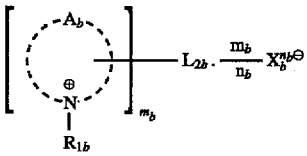

(c)

wherein $A_b$ represents an organic group for accomplishing the heterocyclic ring and may contain a carbon atom, a hydrogen atom, an oxygen atom, a nitrogen atom or a sulfur atom or may be condensed with a benzene ring. Preferred examples of $A_b$ include 5- and 6-membered rings, more preferred examples of $A_b$ include a pyridine ring, a quinoline ring and an isoquinoline ring. Further, $A_b$ may be substituted and preferred examples of the substituent include a halogen atom (e.g., chlorine, bromine) , a substituted or unsubstituted alkyl group (e.g., methyl, hydroxyethyl), a substituted or unsubstituted aralkyl group (e.g. , benzyl, p-methoxyphenethyl), a substituted or unsubstituted aryl group (e.g., phenyl, tolyl, p-chlorophenyl, furyl, thlienyl, naphthyl), a substituted or unsubstituted acyl group (e.g., benzoyl, p-bromobenzoyl, acetyl), a sulfo group, a carboxy group, a hydroxy group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group and an arylthio group. Among these, particularly preferred substituents are an aryl group, a sulfo group, a carboxyl group, a hydroxyl group and an amido group.

$L_{1b}$ and $L_{2b}$ each represents an organic group having preferably 30 or less carbon atoms, and when $m_b$ is 1, $L_{1b}$ and $L_{2b}$ each is preferably an alkyl or aryl group having from 1 to 20 carbon atoms. The alkyl group and the aryl group each may be substituted by a substituent and examples of the substituent include a halogen atom (e.g., chlorine, bromine), a substituted or unsubstituted aryl group (e.g., phenyl, tolyl, p-chlorophenyl, furyl, thienyl, naphthyl), a substituted or unsubstituted acyl group (e.g., benzoyl, p-bromobenzoyl, acetyl), a sulfo group, a carboxy group, a hydroxy group, an alkoxy group, (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group and an arylthio group. Preferred examples of the substituent include an aryl group, a sulfo group, a carboxyl group, a hydroxy group and an amido group. When $m_b$ is 2 or greater, $L_{1b}$ and $L_{2b}$ each preferably comprises alkylene, arylene, alkenylene, $—SO_2—$, —SO—, —O—, —S— or $—N(R_{2b})—$ individually or in combination, wherein $R_{2b}$ represents a substituted or unsubstituted, alkyl or aryl group or-a hydrogen atom.

$R_{1b}$ is preferably an alkyl group having from 1 to 20 carbon atoms. The alkyl group may be substituted by a substituent and examples of the substituent include a halogen atom (e.g., chlorine, bromine), a substituted or unsubstituted aryl group (e.g., phenyl, tolyl, p-chlorophenyl, furyl, thienyl, naphthyl), a substituted or unsubstituted acyl group (e.g., benzoyl, p-bromobenzoyl, acetyl), a sulfo group, a carboxy group, a hydroxy group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group and an arylthio group.

The aryl group represented by $R_{1b}$ include a substituted or unsubstituted aryl group, and examples thereof include a phenyl group, a tolyl group, a p-chlorophenyl group, a furyl group, a thienyl group, and a naphthyl group.

$m_b$ represents an integer of from 1 to 6, $n_b$ represents an integer of from 1 to 3 and $X_b$ represents an $n_b$-valent anion. $X_b$ may be linked to $L_{1b}$, $L_{2b}$ or $R_{1b}$.

Examples of the anion represented by $X_b$ include a halogen ion such as a chlorine ion, a bromine ion and an iodine ion, a carboxylate ion such as an acetate ion, an oxalate ion, a fumarate ion and a benzoate ion, a sulfonate ion such as p-toluenesulfonate, methanesulfonate, butanesulfonate and benzenesulfonate, a sulfate ion, a perchlorate ion, a carboxylate ion and a nitrate ion.

In formula (b), when a plurality of Rib groups are present in the molecule, they may be the same or different or further, they may be combined.

The compounds represented by formulae (b) and (c) may be easily synthesized by a commonly well-known method or by referring to published literatures (see, *Quart. Rev.*, 16, 163 (1962)).

Specific examples of the compounds represented by formulae (b) and (c) are set forth below, however, the present invention is by no means limited to these compounds.

A-201

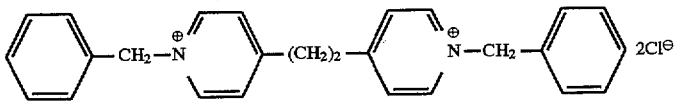

A-202

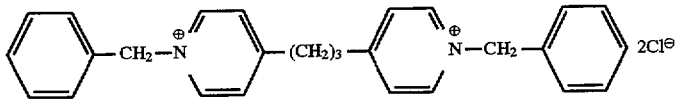

A-203

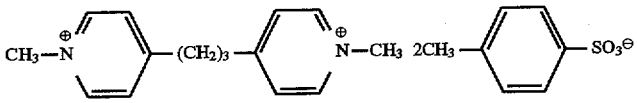

A-204

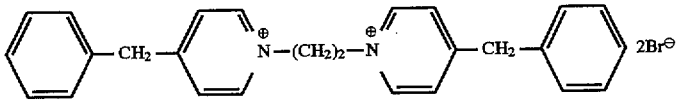

A-205

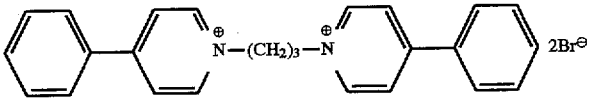

A-206

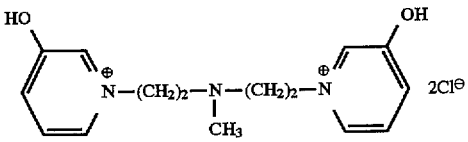

A-207

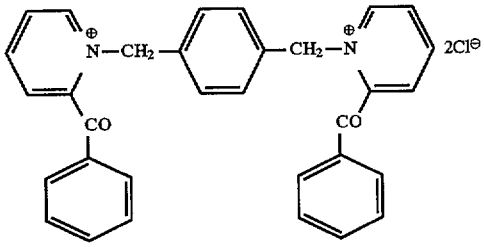

A-208

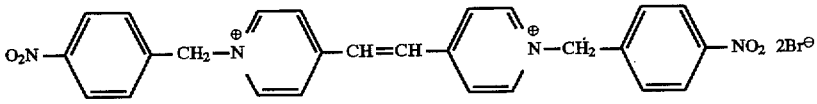

A-209

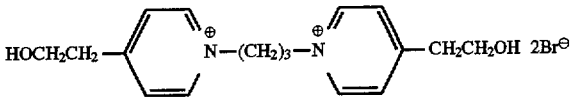

A-210

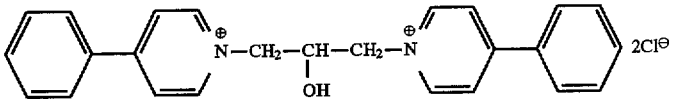

A-211

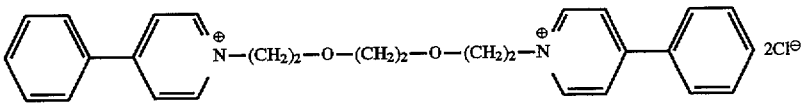

A-212

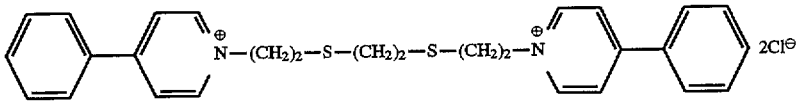

-continued
A-213
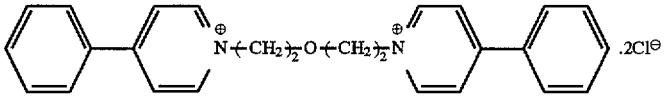
A-214
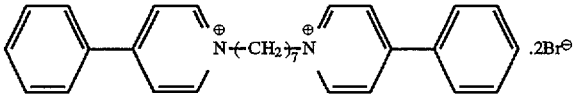
A-215
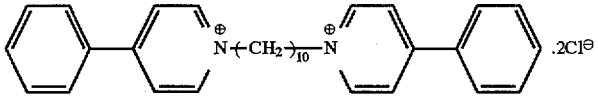
A-216
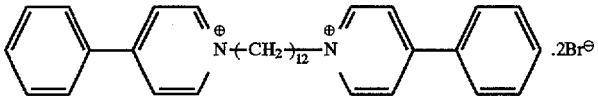
A-217
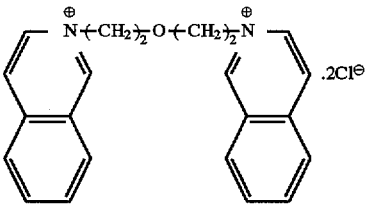
A-218
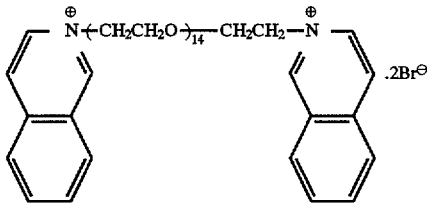
A-219
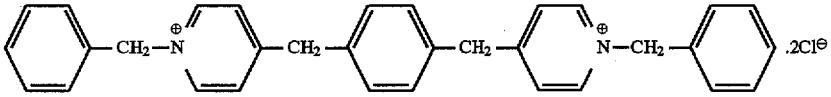
A-220
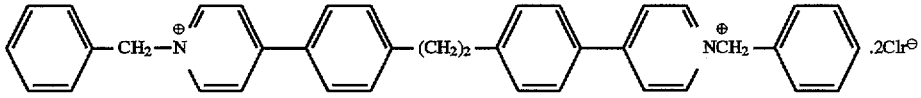
A-221
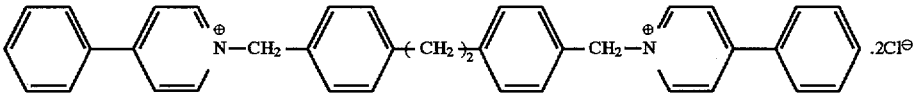
A-222
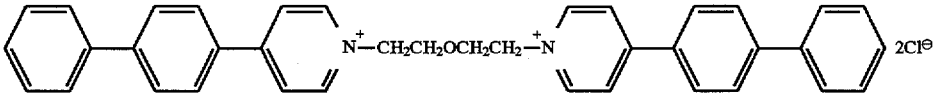
A-223
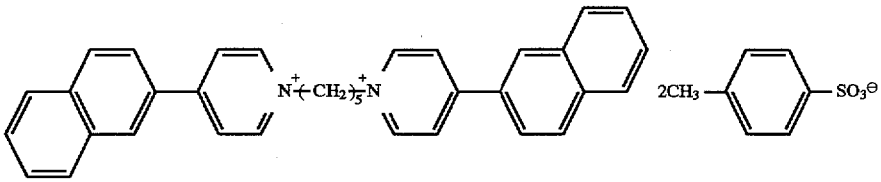
A-224
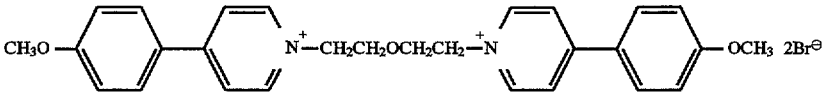
A-225
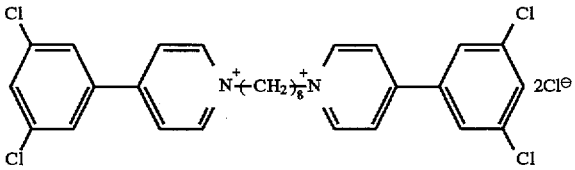

-continued
A-226
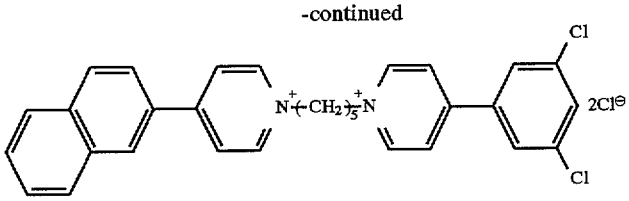
A-227
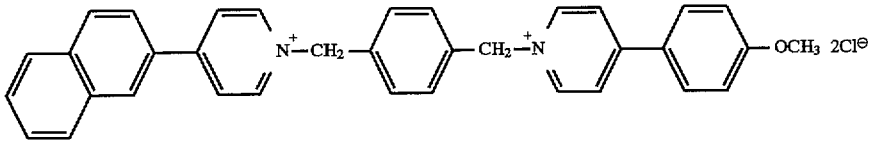
A-228
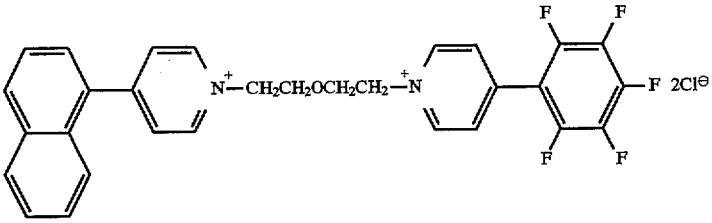
A-229
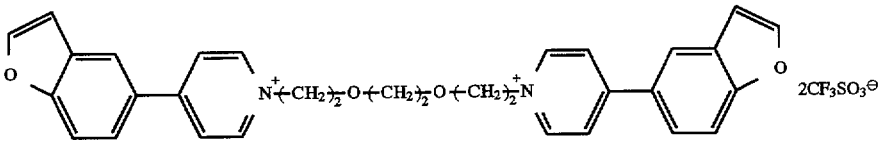
A-230
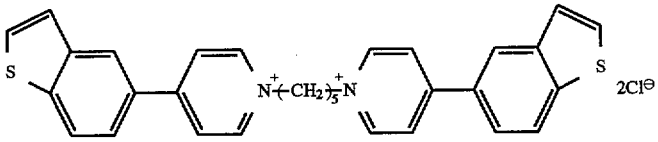
A-231
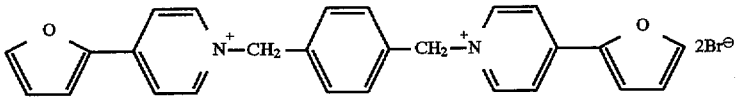
A-232
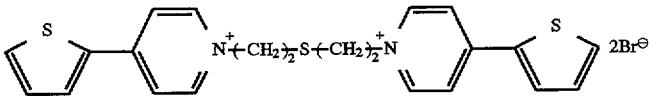
A-233
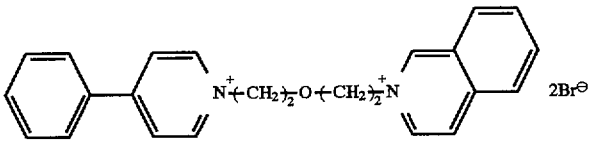
A-234
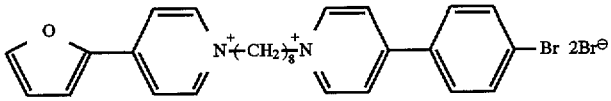
A-235
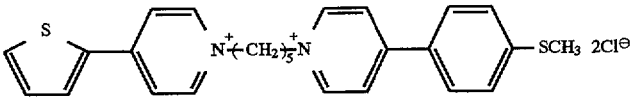
A-236
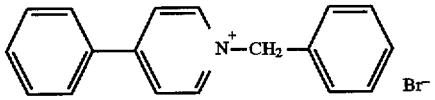
A-237
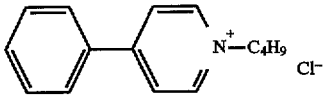
A-238
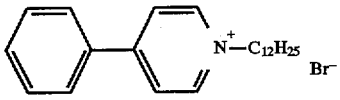
A-239
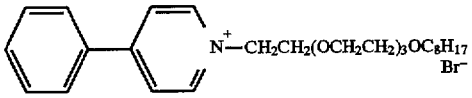

-continued
A-240
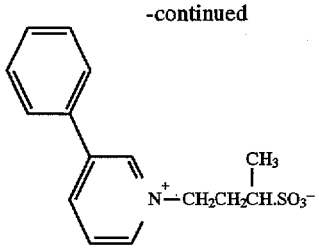
A-241
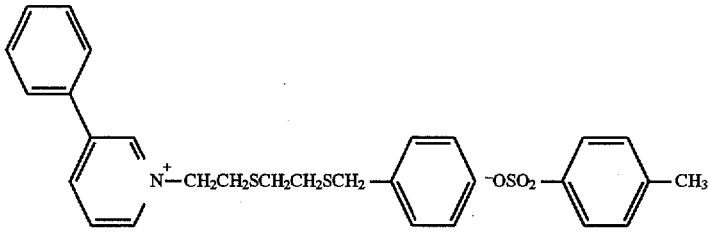
A-242
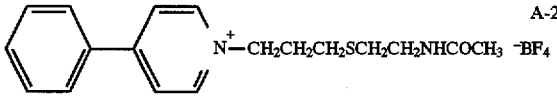
A-243
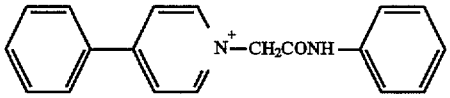
A-244
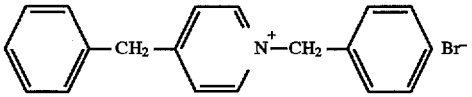
A-245
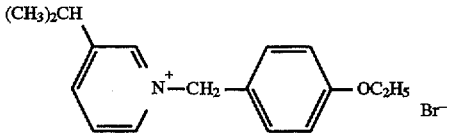
A-246
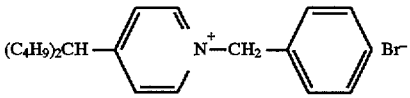
A-247
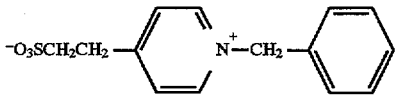
A-248
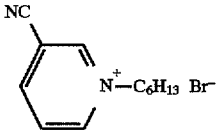
A-249
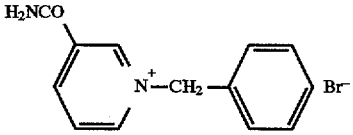
A-250
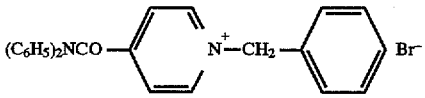
A-251
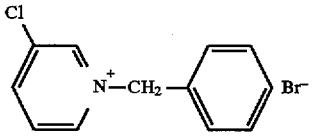
A-252
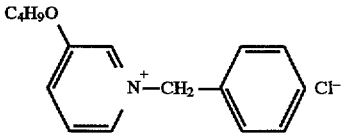
A-253
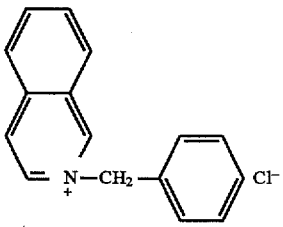
A-254
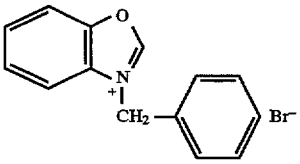
A-255
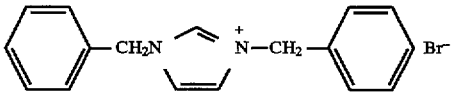
A-256
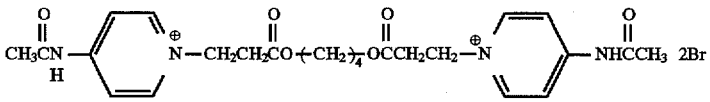

-continued
A-257
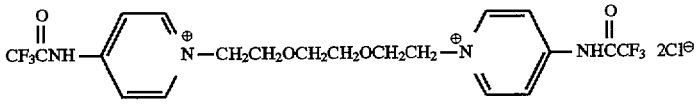
A-258
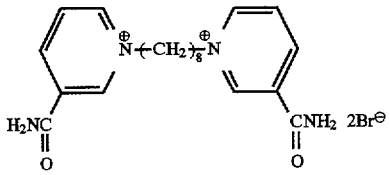
A-259
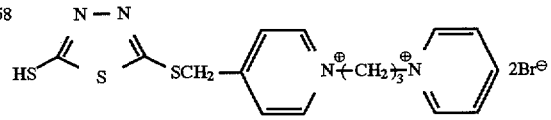
A-260
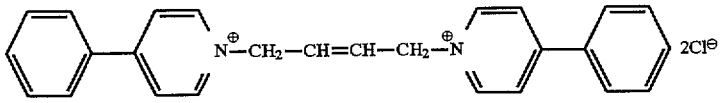
A-261
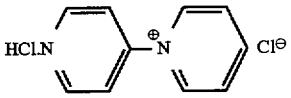
A-262
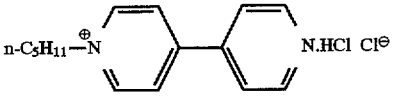
A-263
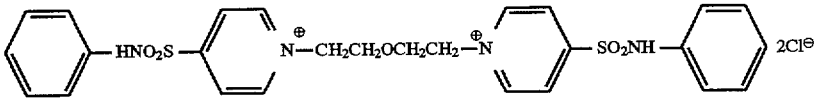
A-264
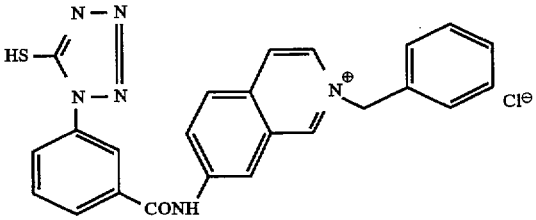
A-265
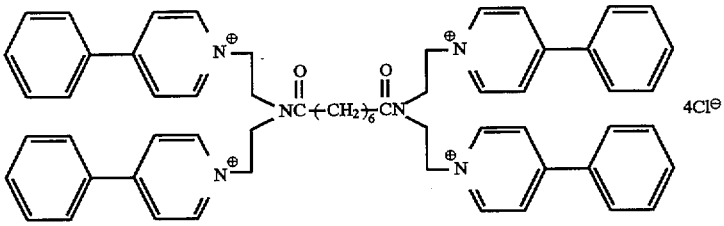
A-266
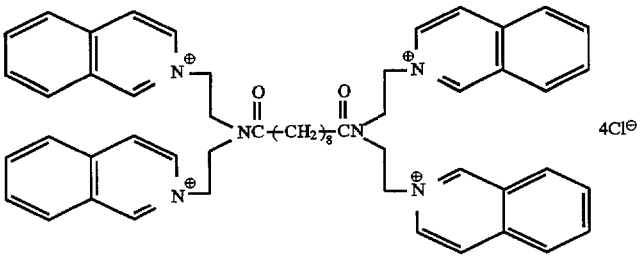
A-267
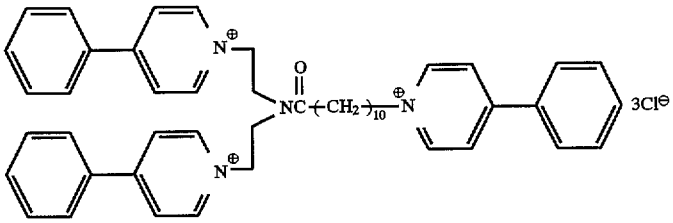

-continued
A-268
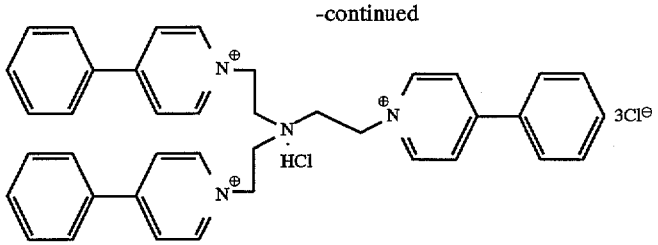
A-269
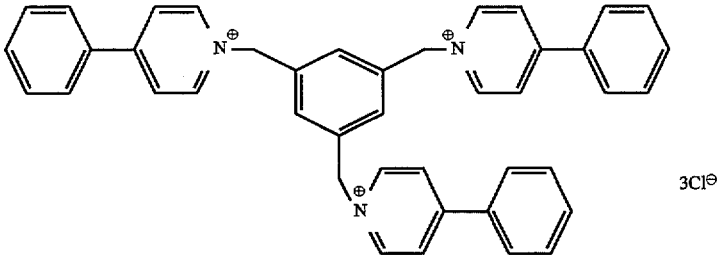
A-270
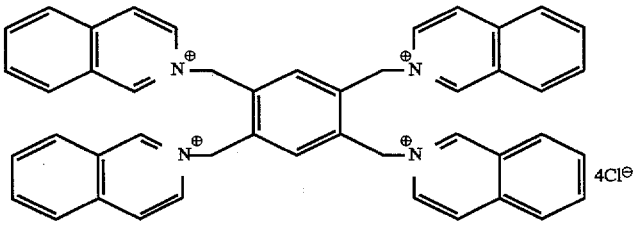
A-271
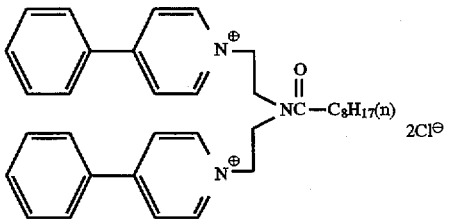
A-272
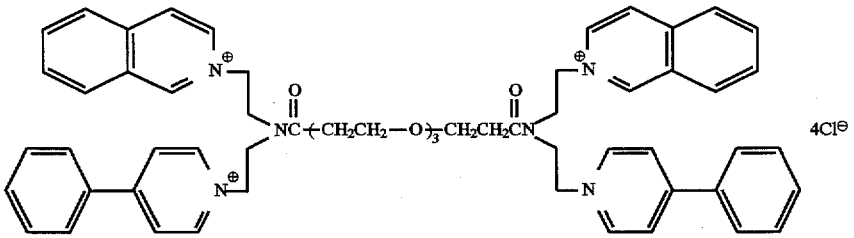
A-273
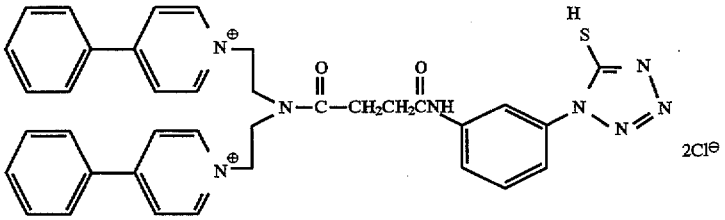
A-274
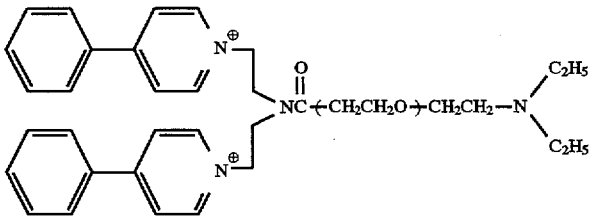

-continued

A-275

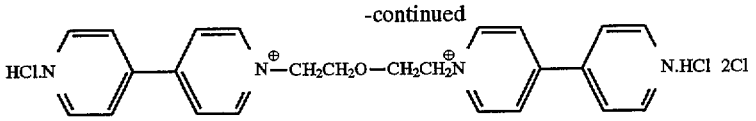

A-276

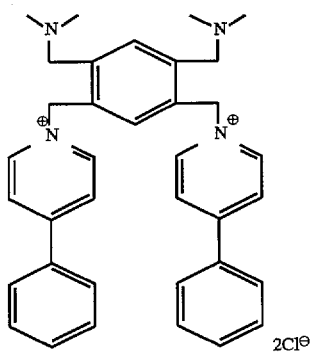

The addition amount of the onium salt compound represented by formula (a), (b) or (c) of the present invention is not particularly limited, however, it is preferably from $1\times10^{5}$ to $2\times10^{-2}$ mol, more preferably from $2\times10^{-3}$ to $1\times10^{-2}$ mol, per mol of silver halide.

The onium salt compound represented by formula (a), (b) or (c) may be incorporated into a photographic light-sensitive material by adding it to a silver halide emulsion solution or a hydrophilic colloid solution, when the compound is water-soluble, after formulating it into an aqueous solution, and when the compound is water-insoluble, after formulating it into an organic solvent miscible with water such as alcohols (e.g., methanol, ethanol), esters (e.g., ethyl acetate) or ketones (e.g., acetone).

Also, the compound may be used after dissolving it according to a well-known emulsion-dispersion method using an oil such as dibutyl phthalate, tricresyl phosphate, glyceryl triacetate or diethyl phthalate, or an auxiliary solvent such as ethyl acetate or cyclohexanone, and mechanically forming the solution into an emulsified dispersion. Further, the compound may be used by forming it into a fine dispersion by a method known as a solid dispersion method.

In the present invention, when the onium salt compound represented by formula (a), (b) or (c) is incorporated into a photographic light-sensitive material, the onium salt compound is preferably incorporated into a silver halide emulsion layer but it may also be incorporated into other light-insensitive hydrophilic colloid layer (e.g., protective layer, interlayer, filter layer, antihalation layer). The onium salt compound may be incorporated into a layer containing a hydrazine nucleating agent or a layer not containing a hydrazine nucleating agent. In the case when the onium salt compound is added to a silver halide emulsion layer, it may be added at any stage between the beginning of chemical ripening and the coating, but it is preferably added between after the completion of chemical ripening and before the coating. The onium salt compound is particularly preferably added to a coating solution prepared for the coating, i.e., immediately before coating.

In the present invention, as another nucleation accelerator, at least one compound selected from the compounds represented by the following formulae (d), (e), (f), (g), (h), (i) and (j) may be incorporated:

$$Y_d\text{-}(X_d)_{nd}A_d\text{-}B_d]_{md} \qquad \text{(d)}$$

wherein $Y_d$ represents a group which adsorbs to silver halide; $X_d$ represents a divalent linking group comprising an atom or an atomic group selected from a hydrogen atom, a carbon atom, a nitrogen atom, an oxygen atom and a sulfur atom; $A_d$ represents a divalent linking group; $B_d$ represents an amino group which may be substituted or a nitrogen-containing heterocyclic ring; $m_d$ represents 1, 2 or 3; and $n_d$ represents 0 or 1;

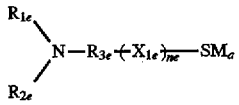

(e)

wherein $R_{1e}$ and $R_{2e}$ each represents a hydrogen atom or an aliphatic residue; $R_{1e}$ and $R_{2e}$ may be combined with each other to form a ring; $R_{3e}$ represents a divalent aliphatic group; $X_{1e}$ represents a divalent heterocyclic ring containing a nitrogen atom, an oxygen atom or a sulfur atom; $n_e$ represents 0 or 1; $M_e$ represents a hydrogen atom, an alkali metal, an alkaline earth metal or an amidino group;

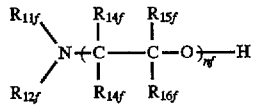

(f)

wherein $R_{11f}$ and $R_{12f}$ each represents a hydrogen atom, an alkyl group having from 1 to 30 carbon atoms, an alkenyl group having from 3 to 30 carbon atoms or an aralkyl group having from 7 to 30 carbon atoms, provided that when $R_{11f}$ and $R_{12f}$ represent an alkyl group at the same time, the total carbon number of $R_{11f}$ and $R_{12f}$ is 10 or more, that $R_{11f}$ and $R_{12f}$ are not a hydrogen atom at the same time and that $R_{11f}$ and $R_{12f}$ may be combined with each other to form a ring; $n_f$ represents an integer of from 2 to 50; and $R_{13f}$, $R_{14f}$, $R_{15f}$ and $R_{16f}$ each represents a hydrogen atom or an alkyl group having from 1 to 4 carbon atoms;

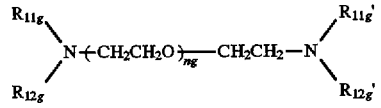

(g)

wherein $R_{11g}$ and $R_{12g}$ each has the same meaning as $R_{11f}$ and $R_{12f}$ in formula (f); $R_{11g}'$ and $R_{12g}'$ have the same meaning as $R_{11g}$ and $R_{12g}$, respectively; and $n_g$ represents an integer of 2 to 50;

$$Y_{h}\text{-}(X_h)_{nh}A_{oh}\text{-}B_h]_{mh} \qquad \text{(h)}$$

wherein $X_h$, $Y_h$ and $B_h$ each h as the same meaning as $X_d$, $Y_d$ and $B_d$ in formula (d); $A_{oh}$ represents a divalent linking group having at least two alkylene oxy units; $m_h$ represents 1, 2 or 3; and $n_h$ represents 0 or 1;

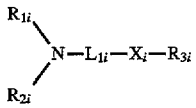

(i)

wherein $R_{1i}$ and $R_{2i}$ each represents an alkyl group, an alkenyl group or an alkynyl group and $R_{i1}$ and $R_{2i}$ may form a ring; $R_{3i}$ represents a hydrogen atom, an alkyl group, an alkenyl group, an alkynyl group, an aryl group or a heterocyclic group; $L_{1i}$ represents a divalent linking group; $X_i$ represents an $-[S-L_{2i}-Y_i-(L_{3i})_{ni}]-$group or an $-[-(L_{3i})_{ni}Y_i-L_{2i}-S]-$group; $L_{2i}$ represents an alkylene group or an alkenylene group; $Y_i$ represents a carbonyl group, a sulfonyl group, a sulfoxy group or a phosphoryl group; $L_{3i}$ represents —O—,

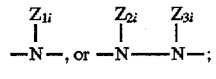

$Z_{1i}$, $Z_{2i}$ and $Z_{3i}$ each represents a hydrogen atom, an alkyl group, an alkenyl group, an alkynyl group, an aryl group or a heterocyclic group; and $n_i$ represents 0 or 1; and

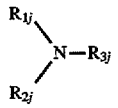

(j)

wherein $R_{1j}$, $R_{2j}$ and $R_{3j}$ each represents an alkyl group, an alkenyl group or an alkynyl group, provided that the compound represented by formula (j) has a thioether group and a partial structure of $-(O-Y_j)_{pj}$; $Y_j$ represents an alkylene group which may be substituted, an alkenylene group which may be substituted or an arylene group which may be substituted; and $p_j$ represents an integer of 2 or greater.

The compound represented by formula (d) is described in detail.

The group which adsorbs to silver halide represented by $Y_d$ include a nitrogen-containing heterocyclic compound.

When $Y_d$ represents a nitrogen-containing heterocyclic compound, the compound of formula (d) is represented by the following formula (d-a):

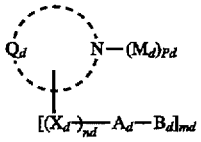

(d-a)

wherein $p_d$ represents 0 or 1, $m_d$ represents 1, 2 or 3, $n_d$ represents 0 or 1, $[(X_d)_n\text{-}Ad\text{-}B_d]m_d$ has the same meaning as defined in formula (d), and $Q_d$ represents an atomic group necessary for forming a 5- or 6-membered heterocyclic ring comprising at least one atom of a carbon atom, a nitrogen atom, an oxygen atom and a sulfur atom. The heterocyclic ring may be condensed with a carboaromatic ring or a heteroaromatic ring.

Examples of the heterocyclic ring formed by $Q_d$ include a substituted or unsubstituted indazole, a substituted or unsubstituted benzimidazole, a substituted or unsubstituted benzotriazole, a substituted or unsubstituted benzoxazole, a substituted or unsubstituted benzothiazole, a substituted or unsubstituted imidazole, a substituted or unsubstituted thiazole, a substituted or unsubstituted oxazole, a substituted or unsubstituted triazole, a substituted or unsubstituted tetrazole, a substituted or unsubstituted azaindene, a substituted or unsubstituted pyrazole, a substituted or unsubstituted indole, a substituted or unsubstituted triazine, a substituted or unsubstituted pyrimidine, a substituted or unsubstituted pyridine and a substituted or unsubstituted quinoline.

$M_d$ represents a hydrogen atom, an alkali metal atom (e.g., sodium, potassium), an ammonium group (e.g., trimethylammonium, dimethylbenzylammonium) or a group capable of being H or an alkali metal atom under an alkali condition (e.g., acetyl, cyanoethyl, methanesulfonylethyl).

The heterocyclic ring may be substituted by a nitro group, a halogen atom (e.g., chlorine, bromine), a mercapto group, a cyano group, a substituted or unsubstituted alkyl group (e.g., methyl, ethyl, propyl, t-butyl, cyanoethyl, methoxyethyl, methylthioethyl), a substituted or unsubstituted aryl group (e.g., phenyl, 4-methanesulfonamidophenyl, 4-methylphenyl, 3,4-dichlorophenyl, naphthyl), a substituted or unsubstituted alkenyl group (e.g., allyl), a substituted or unsubstituted aralkyl group (e.g., benzyl, 4-methylbenzyl, phenethyl), a substituted or unsubstituted alkoxy group (e.g., methoxy, ethoxy), a substituted or unsubstituted aryloxy group (e.g., phenoxy, 4-methoxyphenoxy), a substituted or unsubstituted alkylthio group (e.g., methylthio, ethylthio, methoxyethylthio), a substituted or unsubstituted arylthio group (e.g., phenylthio), a substituted or unsubstituted sulfonyl group (e.g., methanesulfonyl, ethanesulfonyl, p-toluenesulfonyl), a substituted or unsubstituted carbamoyl group (e.g., unsubstituted carbamoyl, methylcarbamoyl, phenylcarbamoyl), a substituted or unsubstituted sulfamoyl group (e.g., unsubstituted sulfamoyl, methylsulfamoyl, phenylsulfamoyl), a substituted or unsubstituted carbonamido group (-e.g., acetamido, benzamido), a substituted or unsubstituted sulfonamido group (e.g., methanesulfonamido, benzenesulfonamido, p-toluenesulfonamido), a substituted or unsubstituted acyloxy group (e.g., acetyloxy, benzoyloxy), a substituted or unsubstituted sulfonyloxy group (e.g., methanesulfonyloxy), a substituted or unsubstituted ureido group (e.g., unsubstituted ureido, methylureido, ethylureido, phenylureido), a substituted or unsubstituted thioureido (e.g., unsubstituted thioureido, methylthioureido), a substituted or unsubstituted acyl group (e.g., acetyl, benzoyl), a substituted or unsubstituted heterocyclic group (e.g., 1-morpholino, 1-piperidino, 2-pyridyl, 4-pyridyl, 2-thienyl, 1-pyrazolyl, 1-imidazolyl, 2-tetrahydrofuryl, tetrahydrothienyl), a substituted or unsubstituted oxycarbonyl group (e.g., methoxycarbonyl, phenoxycarbonyl), a substituted or unsubstituted oxycarbonylamino (e.g., methoxycarbonylamino, phenoxycarbonylamino, 2-ethylhexyloxycarbonylamino), a substituted or unsubstituted amino group (e.g., unsubstituted amino, dimethylamino, methoxyethylamino, amino), a carboxylic acid or a salt thereof, a sulfonic acid or a salt thereof, or a hydroxy group.

Examples of the divalent group represented by $X_d$ include —S—, —O—, —N($R_{1d}$)—, —C(O)O—, —OC(O)—, —C(O)N($R_{2d}$)—, —N($R_{3d}$)C(O)—, —$SO_2$N($R_{4d}$) —, —N($R_{5d}$)$SO_2$—, —N($R_{6d}$)C(O)N($R_{7d}$)—, —N($R_{8d}$)C(S)N($R_{9d}$)—, —N($R_{10d}$)C(O)O—, —$SO_2$—, —C(O)—, —(O)S(O)O— and —O(O)S(O)—, and the linking group may be bonded to $Q_d$ through a linear or branched alkylene group (e.g., methylene, ethylene, propylene, butylene, hexylene, 1-methylethylene). $R_{1d}$, $R_{2d}$, $R_{3d}$, $R_{4d}$, $R_{5d}$, $R_{6d}$, $R_{7d}$, $R_{8d}$, $R_{9d}$ and $R_{10d}$ each represents a hydrogen atom, a substituted or unsubstituted alkyl group (e.g., methyl, ethyl, propyl, n-butyl), a substituted or unsubstituted aryl group (e.g., phenyl, 2-methylphenyl), a substituted or unsubstituted alkenyl group (e.g., propenyl, 1-methylvinyl) or a substituted or unsubstituted aralkyl group (e.g., benzyl, phenethyl).

$A_d$ represents a divalent linking group and examples of the divalent linking group include a linear or branched alkylene group (e.g., methylene, ethylene, propylene, butylene, hexylene, 1-methylethylene), a linear or branched alkenylene (e.g., vinylene, 1-methylvinylene), a linear or branched aralkylene group (e.g., benzylidene) and arylene group (e.g., phenylene, naphthylene). The group represented by A may be further substituted in any combination of X and A.

The substituted or unsubstituted amino group of $B_d$ is represented by the following formula (d-b):

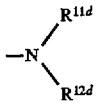

(d-b)

wherein $R^{11d}$ and $R^{12d}$, which may be the same or different, each represents a hydrogen atom, a substituted or unsubstituted alkyl group having from 1 to 30 carbon atoms, an alkenyl group or an aralkyl group, and these groups each may be linear (e.g., methyl, ethyl, n-propyl, n-butyl, n-octyl, allyl, 3-butenyl, benzyl, 1-naphthylmethyl), branched (e.g., isopropyl, t-octyl) or cyclic (e.g., cyclohexyl).

$R^{11d}$ and $R^{12d}$ may be combined to form a ring and the cyclization may be made to form a saturated heterocyclic ring containing one or more hetero atom (e.g., oxygen, sulfur, nitrogen). Examples of the ring include a pyrrolidyl group, a piperidyl group and a morpholino group. Examples of the substituent which $R_{11d}$ and $R^{12d}$ may have include a carboxyl group, a sulfo group, a cyano group, a halogen atom (e.g., fluorine, chlorine, bromine), a hydroxy group, an alkoxycarbonyl group having 20 or less carbon atoms (e.g., methoxycarbonyl, ethoxycarbonyl, phenoxycarbonyl, benzyloxycarbonyl), an alkoxy group having 20 or less carbon atoms (e.g., methoxy, ethoxy, benzyloxy, phenethyloxy), a monocyclic aryloxy group having 20 or less carbon atoms (e.g., phenoxy, p-tolyloxy), an acyloxy group having 20 or less carbon atoms (e.g., acetyloxy, propionyloxy), an acyl group having 20 or less carbon atoms (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), an acylamino group having 20 or less carbon atoms (e.g., acetylamino, propionylamino, benzoylamino, mesylamino), a sulfonamido group (e.g., ethylsulfonamido, p-toluenesulfonamido), a carbonamido group having 20 or less carbon atoms (e.g., methylcarbonamido, phenylcarbonamido), a ureido group having 20 or less carbon atoms (e.g., methylureido, phenylureido) and an amino group.

The nitrogen-containing heterocyclic ring represented by $B_d$ is a 5- or 6-membered ring containing at least one or more nitrogen atom and the ring may have a substituent or may be condensed with other ring. Examples of the nitrogen-containing heterocyclic ring include an imidazolyl group, a pyridyl group and a thiazolyl group.

Among the compounds represented by formula (d), preferred are compounds represented by the following formulae (d-m), (d-n), (d-o) and (d-p):

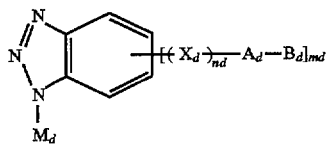

(d-m)

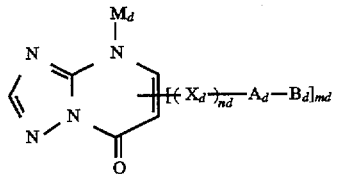

(d-n)

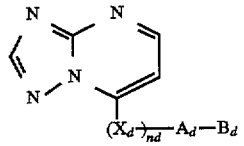

(d-o)

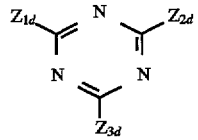

(d-p)

wherein $-(X_d)_{nd}-A_d-B_d$, $M_d$ and $m_d$ each has the same meaning as defined in formula (d-a) above, and $Z_{1d}$, $Z_{2d}$ and $Z_{3d}$ each has the same meaning as $-(X_d)_{nd}-A_d-B_d$ in formula (d-a) or represents a halogen atom, an alkoxy group having 20 or less carbon atoms (e.g., methoxy), a hydroxy group, a hydroxyamino group, or a substituted or unsubstituted amino group (the substituent may be selected from the substituents for $R^{11d}$ and $R^{12d}$ in formula (d-b)), provided that at least one of $Z_{1d}$, $Z_{2d}$ and $Z_{3d}$ has the same meaning as $-(X_d)_{nd}-A_d-B_d$.

The heterocyclic ring may also be substituted by a substituent applicable to the heterocyclic ring of formula (d).

Examples of the compound represented by formula (d) are set forth below, but the present invention is by no means limited thereto.

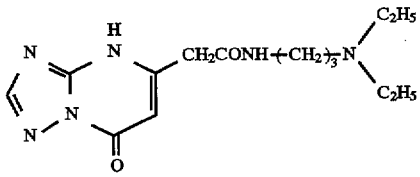

1-1

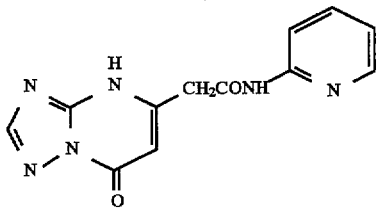

1-2

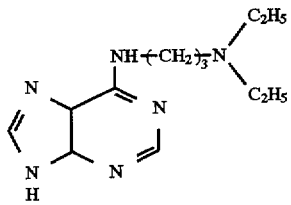

1-3

-continued 1-4

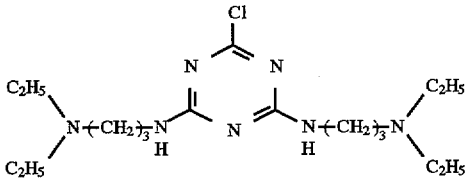

1-5

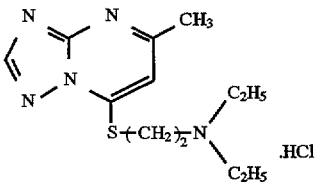

1-6

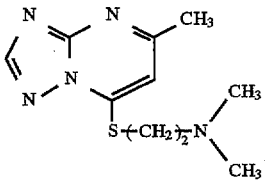

1-7

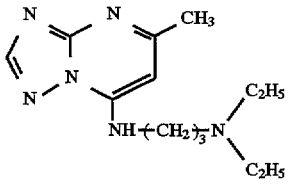

1-8

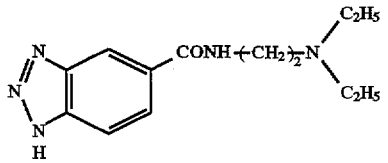

The compound represented by formula (e) is described below in-detail.

$R_{1e}$ and $R_{2e}$ each represents a hydrogen atom or an aliphatic residue.

$R_{1e}$ and $R_{2e}$ may be combined with each other to form a ring.

$R_{3e}$ represents a divalent aliphatic group.

$X_e$ represents a divalent heterocyclic ring containing a nitrogen atom, an oxygen atom or a sulfur atom.

$n_e$ represents 0 or 1. Me represents a hydrogen atom, an alkali metal, an alkaline earth metal, a quaternary ammonium salt, a quaternary phosphonium salt or an amidino group.

The aliphatic residue represented by $R_{1e}$ or $R_{2e}$ is preferably an alkyl, alkenyl or alkynyl group, each having from 1 to 12 carbon atoms, which may be substituted by an appropriate group. Examples of the alkyl group include a methyl group, an ethyl group, a propyl group, a butyl group, a hexyl group, a decyl group, a dodecyl group, an isopropyl group, a sec-butyl group and a cyclohexyl group. Examples of the alkenyl group include an allyl group, a 2-butenyl group, a 2-hexenyl group and a 2-octenyl group. Examples of the alkyl group include a propargyl group and a 2-pentinyl group. Examples of the substituent include a phenyl group, a substituted phenyl group, an alkoxy group, an alkylthio group, a hydroxy group, a carboxyl group, a sulfo group, an alkylamino group and an amido group.

In the case when $R_{1e}$ and $R_{2e}$ form a ring, a 5- or 6-membered carbocyclic or heterocyclic ring comprising carbon or a combination of carbon and nitrogen or oxygen is preferred, particularly a saturated ring is preferred, and examples of the ring include pyrrolidyl, piperidyl, morpholyl, piperazyl and 4-methylpiperazyl.

$R_{1e}$ and $R_{2e}$ each is particularly preferably an alkyl group having from 1 to 3 carbon atoms, still more preferably an ethyl group.

The divalent aliphatic group represented by $R_{3e}$ is preferably $—R_{4e}$, or $—R_{4e}—S—$, wherein $R_{4e}$ represents a divalent aliphatic residue, preferably a saturated or unsaturated aliphatic residue having from 1 to 6 carbon atoms, and examples thereof include $—CH_2—$, $—CH_2CH_2—$, $—(CH_2)_3—$, $—(CH_2)_4—$, $—(CH_2)_6—$, $—CH_2CH{=}CHCH_2—$, $—CH_2C{=}CCH_2—$ and $—CH_2CH(CH_3)CH_2—$.

$R_{4e}$ preferably has a carbon number of from 2 to 4 and $R_{4e}$ more preferably represents $—CH_2CH_2—$ or $—CH_2CH_2CH_2—$. When $n_e$ in $(X_e)_{ne}$ is 0, $R_{3e}$ represents only $—R_{4e}—$.

The heterocyclic ring represented by $X_e$ includes 5- and 6-membered heterocyclic rings containing nitrogen, oxygen or sulfur and the heterocyclic ring may be condensed with a benzene ring. The heterocyclic ring is preferably an aromatic heterocyclic ring and examples thereof include tetrazole, triazole, thiadiazole, oxadiazole, imidazole, thiazole, oxazole, benzimidazole, benzothiazole and benzoxazole. Among these, tetrazole and thiadiazole are particularly preferred.

Examples of the alkali metal represented by $M_e$ include $N^{a+}$, $K^+$ and $Li^+$. Examples of the alkaline earth metal include $Ca^{++}$ and $Mg^{++}$.

The quaternary ammonium salt represented by $M_e$ includes a quaternary ammonium salt having from 4 to 30 carbon atoms and examples thereof include $(CH_3)_4N^+$, $(C_2H_5)_4N^+$, $(C_4H_9)_4N^+$, $C_6H_5CH_2N^+(CH_3)_3$ and $C_{16}H_{33}N^+(CH_3)_3$. Examples of the quaternary phosphonium salt include $(C_4H_9)_4P^+$, $C_{16}H_3P^+(CH_3)_3$ and $C_6H_3CH_2P^+(CH_3)$.

Examples of the inorganic acid salt of the compound represented by formula (e) include a hydrochloride, a sulfate and a phosphate, and examples of the organic acid salt thereof include an acetate, a propionate, a methanesulfonate, a benzenesulfonate and a p-toluenesulfonate.

Specific examples of the compound represented by formula (e) are set forth below.

2-1

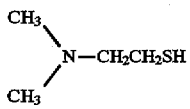

2-2

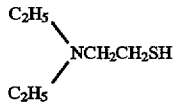

2-3

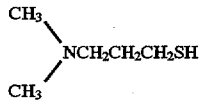

2-4

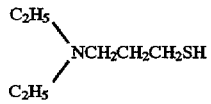

2-5

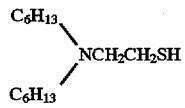

-continued 2-6

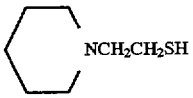

2-7

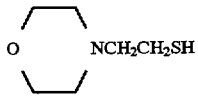

2-8

$(HOCH_2CH_2)_2NCH_2CH_2SH$ 2-9

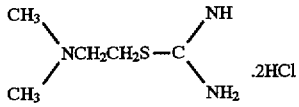

2-10

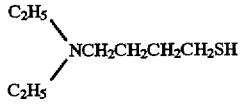

2-11

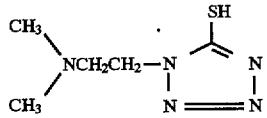

2-12

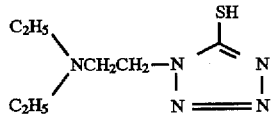

2-13

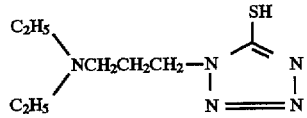

The compounds represented by formulae (f) and (g) are described below in detail.

$R_{11f}$, $R_{12f}$, $R_{11g}$, $R_{12g}$, $R_{11g}'$ and $R_{12g}'$ each independently represents a hydrogen atom, an alkyl group having from 1 to 30 carbon atoms (including those having a substituent, e.g., methyl, ethyl, n-butyl, n-hexyl, n-octyl, 2-ethylhexyl, methoxyethyl, ethylthioethyl, dimethylaminoethyl, n-decyl, n-dodecyl, phenoxyethyl, 2,4-di-t-amylphenoxyethyl, n-octadecyl), an alkenyl group having from 3 to 30 carbon atoms (including those having a substituent, e.g., allyl, butenyl, pentenyl) or an aralkyl group having from 7 to 30 carbon atoms (including those having a substituent, e.g., phenethyl, benzyl, 4-methoxybenzyl, 4-t-butylbenzyl, 2,4-di-t-amylphenethyl). $R_{11f}$ and $R_{12f}$, $R_{11g}$ and $R_{12g}$, or $R_{11g}'$ and $R_{12g}'$, each combination may be integrated into alkylene which may be substituted and may form a ring together with the nitrogen atom (e.g., pyrrolidine ring, piperidine ring, 2-methylpiperidine ring, hexamethyleneimine ring).

$R_{13f}$, $R_{14f}$, $R_{15f}$ and $R_{16f}$, which may be the same or different, each represents a hydrogen atom or a lower alkyl group having from 1 to 4 carbon atoms (preferably a lower alkyl group having no-substituent, e.g., methyl, ethyl, n-butyl).

When $R_{11f}$, $R_{12f}$, $R_{11g}$, $R_{12g}$, $R_{11g}'$ and $R_{12g}'$ each has a substituent, examples of the substituent include a halogen atom (e.g., chlorine, bromine), a cyano group, a nitro group, a hydroxy group, an alkoxy group (e.g., methoxy), an aryloxy group (e.g., phenoxy, 2,4-di-t-amylphenoxy), an alkylthio group (e.g., methylthio), an arylthio group (e.g., phenylthio), an acyloxy group (e.g., acetyloxy, benzoyloxy), an amino group (e.g., unsubstituted amino, dimethylamino), a carbonamido group (e.g., acetamido), a sulfonamido group (e.g., methanesulfonamido, benzenesulfonamido), an oxycarbonylamino group (e.g., methoxycarbonylamino), a ureido group (e.g., unsubstituted uredio, 3,3-dimethylureido), a thioureido group (e.g., unsubstituted thioureido, 3-phenylthioureido), an acyl group (e.g., acetyl, benzoyl), an oxycarbonyl group (e.g., methoxycarbonyl), a carbamoyl group (e.g., methylcarbamoyl, 4-methylphenylcarbamoyl), a sulfonyl group (e.g., methanesulfonyl), a sulfamoyl group (e.g., methylsulfamoyl, 4-methoxyphenylsulfamoyl), a carboxylic acid or a salt thereof, and a sulfonic acid or a salt thereof.

In formulae (f) and (g), $R_{11f}$, $R_{12f}$, $R_{11g}$, $R_{12g}$, $R_{11g}'$ and $R_{12g}'$ each preferably represents an alkyl group having from 1 to 30 carbon atoms or an aralkyl group having from 7 to 30 carbon atoms, $R_{13f}$, $R_{14f}$, $R_{15f}$ and $R_{16f}$ each preferably represents a hydrogen atom, and $n_f$ and $n_g$ each preferably represents an integer of from 3 to 20. $R_{11f}$, $R_{12f}$, $R_{11g}$, $R_{12g}$, $R_{11g}'$ and $R_{12g}'$ each more preferably represents an alkyl group having from 5 to 20 carbon atoms.

Specific examples of the compounds represented by formulae (f) and (g) are set forth below, but the present invention is by no means limited to these compounds.

3-1

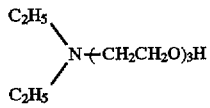

3-2

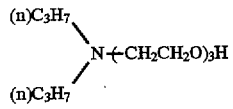

3-3

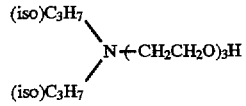

3-4

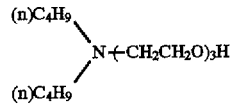

3-5

$(n)C_4H_9NH(CH_2CH_2O)_3H$ 3-6

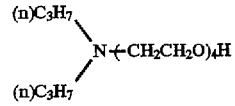

3-7

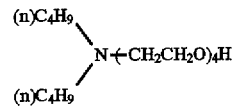

3-8

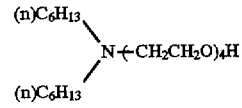

3-9

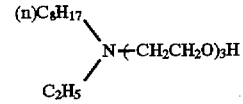

3-10

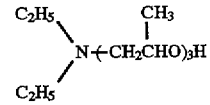

-continued 4-1

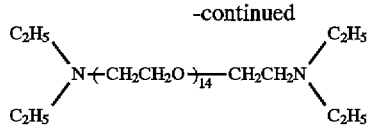

4-2

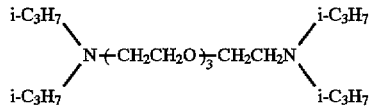

4-3

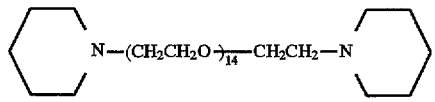

4-4

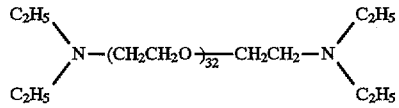

4-5

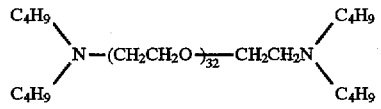

The compound represented by formula (h) is described below.

$X_h$, $Y_h$ and $B_h$ each has the same meaning as $X_d$, $Y_d$ and $B_d$ in formula (d), respectively, $m_h$ represents 1, 2 or 3, and $n_h$ represents 0 or 1

$A_{Oh}$ represents a divalent linking group having at least two alkylene oxy units and preferably represents

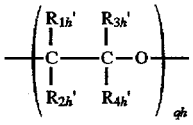

$R_{1h}'$, $R_{2h}'$, $R_{3h}'$ and $R_{4h}'$ each represents a hydrogen atom, an alkyl group having from 1 to 4 carbon atoms (e.g., methyl, ethyl, n-propyl, n-butyl) and $q_h$ represents an integer of from 2 to 50.

Specific examples of the compound represented by formula (h) are set forth below, but the present invention is by no means limited thereto.

5-1

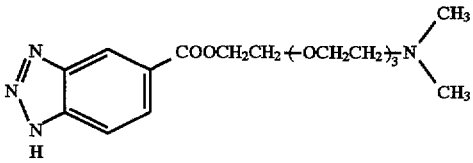

5-2

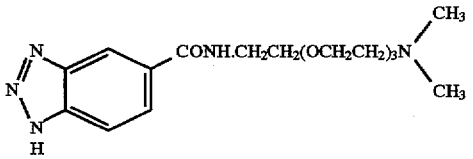

5-3

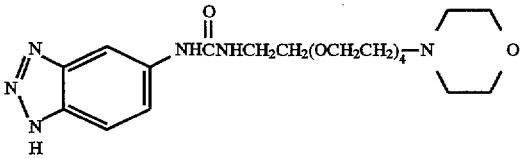

-continued 5-4

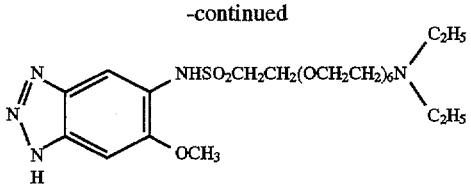

5-5

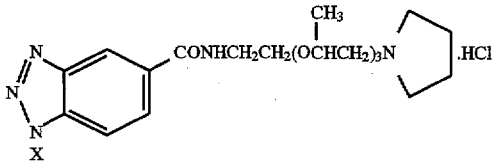

5-6

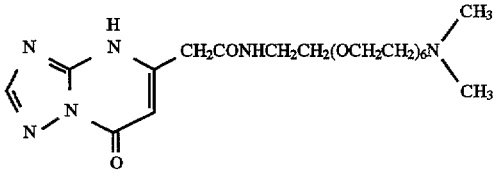

The compound represented by formula (i) is described below in detail.

In formula (i), $R_{1i}$ and $R_{2i}$ each represents an alkyl group (e.g., methyl, ethyl propyl, isopropyl, butyl, octyl, dodecyl), an alkenyl group (e.g., allyl, butenyl) or an alkynyl group (e.g., propargyl, butynyl). These groups each may be further substituted by a substituent (e.g., allyl, alkoxy, aryloxy, hydroxyl, alkylthio, arylthio, sulfonamido, carbonamido, ureido, sulfamoyl, carbamoyl, amino, alkoxycarbonyl, carboxyl). $R_{1i}$ and $R_{2i}$ may be combined to form a ring (e.g., piperidine, piperazine, morpholine, pyrrolidine). $R_{1i}$ and $R_{2i}$ each is preferably an alkyl group and most preferably an alkyl group having from 2 to 20 carbon atoms.

$R_{3i}$ represents an alkyl group (e.g., methyl, ethyl, propyl, t-butyl, octyl, dodecyl), an alkenyl group (e.g., allyl, butenyl), an alkynyl group (e.g., propargyl, butynyl), an aryl group (e.g., phenyl, naphthyl) or a heterocyclic group (e.g., thienyl, furyl, pyridyl).

The above-described groups each may be further substituted by a substituent the same as the substituent described for $R_{1i}$ or $R_{2i}$.

$L_{1i}$ represents a divalent linking group, preferably a group having an alkylene group which may be substituted (the alkylene group bonds to

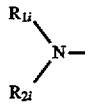

group).

The divalent linking group represented by $L_1$ is more preferably an alkylene group having from 1 to 10 carbon atoms or a group comprising a combination of an alkylene group having from 1 to 10 carbon atoms with the group described below.

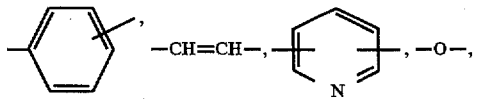

-continued

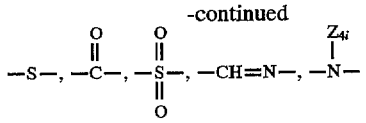

(wherein $Z_{4i}$ represents a hydrogen atom, an alkyl group or an aryl group).

$X_i$ represents an $-[S-L_{2i}Y_i-(L_{3i})_{ni}]-$ group or an $-[-(L_{3i})_{ni}-Y_i-L_{2i}-S]-$ group $L_{2i}$ represents an alkylene group (e.g., methylene, ethylene, propylene, butylene) or an alkenylene group (e.g., propenylene, butenylene), preferably an alkylene group having from 1 to 4 carbon atoms, more preferably a methylene group or an ethylene group. $Y_i$ represents a carbonyl group, a sulfonyl group, a sulfoxy group or a phosphoryl group, preferably a carbonyl group or a sulfonyl group. $L_{3i}$ represents —O—,

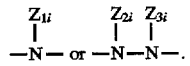

$Z_{1i}$, $Z_{2i}$ and $Z_{3i}$ each represents a hydrogen atom, an alkyl group, an alkenyl group, an alkynyl group, an aryl group or a heterocyclic group. $Z_{1i}$, $Z_{2i}$ and $Z_{3i}$ each preferably represents a hydrogen atom, an alkyl group or an aryl group.

$n_i$ represents 0 or 1.

Specific examples of the compound represented by formula (i) are set forth below, but the present invention is by no means limited to these.

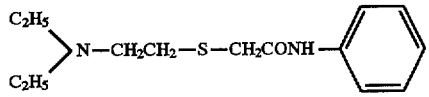

6-1

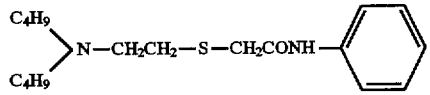

6-2

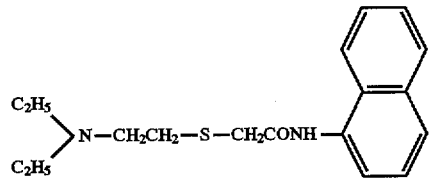

6-3

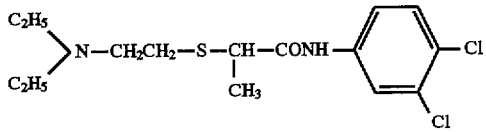

6-4

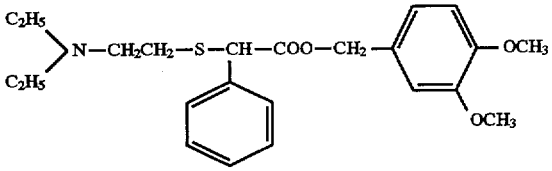

6-5

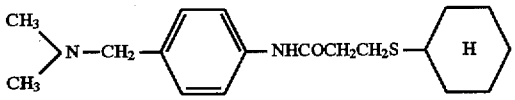

6-6

Formula (j) is described below in detail.

In formula (j), $R_{1j}$ and $R_{2j}$ each represents an alkyl group (e.g., methyl, ethyl, propyl, isopropyl, butyl, octyl, dodecyl), an alkenyl group (e.g., allyl, 2-methylallyl, butenyl) or an alkynyl group (e.g., propargyl, butynyl). These groups each may further be substituted by a substituent (e.g., alkyl, aryl, alkoxy, aryloxy, hydroxyl, alkylthio, arylthio, sulfonamido, carbonamido, ureido, sulfamoyl, carbamoyl, amino, alkoxycarbonyl, carboxyl) or $R_{1j}$ and $R_{2j}$ may be combined to form a ring (e.g., piperidine, piperazine, morpholine, pyrrolidine). $R_{1j}$ and $R_{2j}$ each is preferably an alkyl group or an alkenyl group, more preferably an alkyl group having from 2 to 20 carbon atoms or an alkenyl group having from 3 to 20 carbon atoms.

$R_{3j}$ represents an alkyl group (e.g., methyl, ethyl, propyl, butyl, octyl, dodecyl), an alkenyl group (e.g., allyl butenyl), an alkynyl group (e.g., propargyl, butynyl), an aryl group (e.g., phenyl, naphthyl) or a heterocyclic group (e.g., thienyl, furyl, pyridyl).

These groups each may be further substituted by a substituent the same as the substituent described for $R_{1j}$ or $R_{2j}$.

Among the compounds represented by formula (j), compounds represented by the following formulae (j-A) and (j-B) are more preferred.

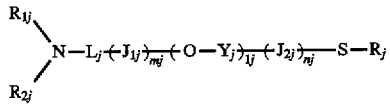

(j-A)

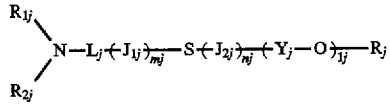

(j-B)

wherein $R_{1j}$, $R_{2j}$, $Y_j$ and $p_j$ have the same meaning as those in formula (j), respectively, $L_j$ represents a divalent aliphatic group, $J_{1j}$ and $J_{2j}$ each represents a divalent linking group, $m_j$ and $n_j$ each represents 0 or 1, and $R_j$ represents a hydrogen atom, an aliphatic group, an aromatic group or a heterocyclic group.

The divalent aliphatic group represented by $L_j$ includes an alkylene group (preferably having from 1 to 20 carbon atoms) or an alkenylene group (preferably having from 3 to 20 carbon atoms), and $L_j$ is preferably an alkylene group, more preferably an alkylene group having from 2 to 10 carbon atoms.

$L_j$ is most preferably an ethylene group, a trimethylene group or a tetramethylene group.

$L_j$ may be further substituted by an appropriate substituent (e.g., alkyl, aryl).

Examples of the divalent linking group represented by $J_{1j}$ or $J_{2j}$ include $—CH_2—$, —CH=CH—, $—C_6H_4—$, pyridinediyl, $—N(Z_{1j})—$ (wherein $Z_{1j}$ represents a hydrogen atom, an alkyl group or an aryl group), —O—, —S—, —CO—, $—SO_2—$, —CH=N—, a group comprising a combination of the groups selected from the exemplified groups, and a group composed of these groups which further have appropriate substitut(s) (e.g., alkyl, alkenyl, alkynyl, aryl, heterocyclic ring, heterocyclic onium, amino, ammonium, acylamino, carbamoyl, sulfonamido, sulfamoyl, ureido, alkoxy, aryloxy, heterocyclic oxy, hydroxyl, alkoxycarbonylamino, alkylthio, arylthio, heterocyclic thio, sulfonyl, sulfinyl, halogen atom, cyano, sulfo, carboxyl, acyloxy, acyl, alkyloxycarbonyl, aryloxycarbonyl, nitro, thioacyl, thioacylamino, thioureido).

$m_j$ and $n_j$ each represents 0 or 1 and most preferably, both of them are 0.

$Y_j$ represents an algkylene group (e.g., ethylene, propylene, trimethylene, tetramethylene), an alkenylene group (e.g., vinylene, propenylene, 1-butenylene, 2-butenylene), an arylene group (e.g., phenylene) or a group resulting from substituting these groups by an appropriate substituent (for example, those described above as an appropriate substituent which $J_{1j}$ or $J_{2j}$ may have).

$Y_i$ is preferably an alkylene group, more preferably an ethylene group, a propylene group or a trimethylene group.

The aliphatic group represented by $R_j$ includes a linear, branched or cyclic alkyl group, an alkenyl group and an alkynyl group (preferably, an alkyl group with the alkyl moiety having from 1 to 20 carbon atoms, an alkenyl group with the alkynyl moiety having from 2 to 20 carbon atoms, an alkynyl group).

The aromatic group represented by $R_j$ is preferably a monocyclic (e.g., benzene) or condensed ring (e.g., naphthalene) aryl group.

The heterocyclic group represented by $R_j$ is preferably a monocyclic or condensed ring heterocyclic ring containing at least one hetero atom selected from nitrogen, sulfur and oxygen, more preferably a 5-membered ring (e.g., pyrrole, thiophene, furan, imidazole, pyrazole, thiazole, oxazole, thiadiazole, oxadiazole, pyrroline, pyrrolidine, imidazoline, imidazolidine, pyrazolidine, tetrahydrofuran), a 6-membered ring (e.g., pyridine, pyrazine, pyrimidine, pyridazine, triazine, dithiine, dioxine, piperidine, morpholine, quinacridine) or a condensed ring of these rings with a cycloalkyl ring (e.g., cyclopentane, cyclohexane, cycloheptane), a cycloalkenyl group (e.g., cyclopentene, cyclohexene, cycloheptene), an aromatic ring (e.g., benzene, naphthalene) or a heterocyclic ring (e.g., pyrrole, imidazole, pyridine, pyrazine, pyrimidine).

Specific examples of the compound represented by formula (j) are set forth below, but the present invention is by no means limited to these.

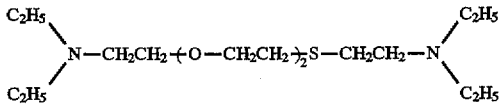

7-1

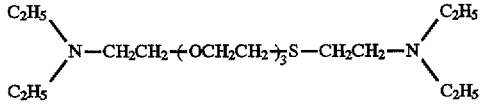

7-2

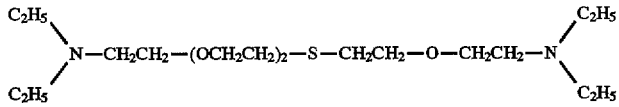

7-3

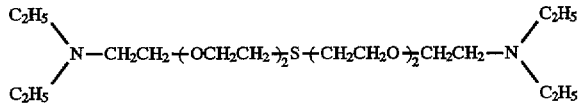

7-4

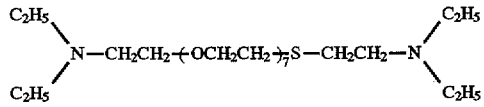

7-5

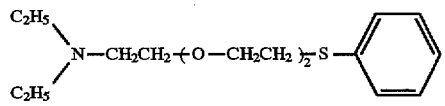

7-6

The compound represented by formula (d), (e), (f), (g), (h), (i) or (j) can be added into any hydrophilic colloidal layer on the surface having a silver halide emulsion layer or can be added in a silver halide emulsion layer.

The optimal addition amount of the compound represented by formula (d), (e), (f), (g), (h), (i) or (j) varies depending upon the kind of the compound but it is preferably from $1.0\times10^{-3}$ to 0.5 g/m$^2$, more preferably from $5.0\times10^{-3}$ to 0.3 g/m$^2$.

Also, plural kinds of these compounds may be used in combination.

Further, these compounds each may be used after dissolving it in an appropriate water-miscible organic solvent such as alcohols (e.g., methanol, ethanol, propanol, fluorinated alcohol), ketones (e.g., acetone, methyl ethyl ketone), dimethylformamide, dimethylsulfoxide or methyl cellosolve.

Also, these compounds each may be used after dissolving it according to a well-known emulsion-dispersion method using an oil such as dibutyl phthalate, tricresyl phosphate, glyceryl triacetate or diethyl phthalate, or an auxiliary solvent such as ethyl acetate or cyclohexanone, and then mechanically forming the solution into an emulsified dispersion. Further, these compounds each may be used by forming it into a fine dispersion by a method known as a solid dispersion method.

Polymer Latex

The polymer latex having an active methylene group for use in the present invention is described below. The polymer latex can be added into any hydrophilic colloidal layer on the surface having a silver halide emulsion layer or can be added in a silver halide emulsion layer. The term "having an active methylene group" as used herein means to have a repeating unit derived from an ethylenically unsaturated monomer having an active methylene group. The ethylenically unsaturated monomer having an active methylene group is described below in detail.

The ethylenically unsaturated monomer containing an active methylene group for use in the present invention is represented by the following formula (k):

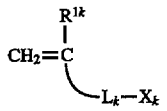

(k)

wherein $R^{1k}$ represents a hydrogen atom, an alkyl group having from 1 to 4 carbon atoms (e.g., methyl, ethyl, n-propyl, n-butyl) or a halogen atom (e.g., chlorine, bromine) and $R^{1k}$ is preferably a hydrogen atom, a methyl group or a chlorine atom.

$L_k$ represents a single bond or a divalent linking group and more specifically, $L_k$ is represented by the following formula:

$$-(L^{1k})_{mk}-(L^{2k})_{nk}$$

wherein $L^{1k}$ represents —CON($R^{2k}$) (wherein $R^{2k}$ represents a hydrogen atom, an alkyl group having from 1 to 4 carbon atoms or a substituted alkyl group having from 1 to 6 carbon atoms), —COO—, —NHCO—, —OCO—,

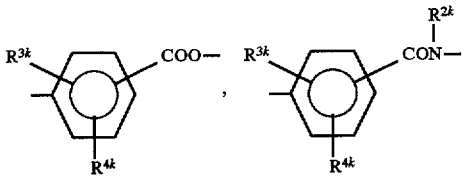

(wherein $R^{3k}$ and $R^{4k}$ each independently represents hydrogen, hydroxyl, a halogen atom or a substituted or unsubstituted alkyl, alkoxy, acyloxy or aryloxy group), $L^{2k}$ represents a linking group connecting $L^{1k}$ and $X_k$, $m_k$ represents 0 or 1 and $n_k$ represents 0 or 1. The linking group represented by $L^{2k}$ is specifically represented by the following formula:

$$-X^{1k}-(J^{1k}-X^{2k})_{pk}-(J^{2k}-X^{3k})_{qk}-(J^{3k}-X^{4k})_{rk}-$$

wherein $j^{1k}$, $j^{2k}$ and $j^{3k}$, which may be the same or different, each represents —CO—, —$SO_2$—, —CON($R^{5k}$) (wherein $R^{5k}$ represents a hydrogen atom, an alkyl group (having from 1 to 6 carbon atoms) or a substituted alkyl group (having from 1 to 6 carbon atoms), —$SO_2$N($R^{5k}$)— (wherein $R^{5k}$ is as defined above), —N($R^{5k}$)—$R^{6k}$— (wherein $R^{5k}$ is as defined above and $R^{6k}$ represents an alkylene group having from 1 to about 4 carbon atoms), —N($R^{5k}$)—$R^{6k}$—N($R^{7k}$)— (wherein $R^{5k}$ and $R^{6k}$ each is as defined above and $R^{7k}$ represents a hydrogen atom, an alkyl group (having from 1 to 6 carbon atoms) or a substituted alkyl group (having from 1 to 6 carbon atoms), —O—, —S—, —N($R^{5k}$)—CO—N($R^{7k}$)— (wherein $R^{5k}$ and $R^{7k}$ each is as defined above), —N($R^{5k}$)—$SO_2$—N($R^{7k}$)— (wherein $R^{5k}$ and $R^{7k}$ each is as defined above), —COO—, —OCO—, —N($R^{5k}$)$CO_2$— (wherein $R^{5k}$ is as defined above), or —N($R^{5k}$)CO— (wherein $R^{5k}$ is as defined above).

$p_k$, $q_k$, $r_k$ and $s_k$ each represents 0 or 1.

$X^{1k}$, $X^{2k}$ and $X^{3k}$, which may be the same or different, each represents an unsubstituted or substituted alkylene group having from 1 to 10 carbon atoms, an aralkylene group or a phenylene group. The alkylene group may be linear or branched. Examples of the alkylene group include methylene, methylmethylene, dimethylmethylene, dimethylene, trimethylene, tetramethylene, pentamethylene, hexamethylene and decylmethylene, examples of the aralkylene group include benzylidene, and examples of the phenylene group include p-phenylene, m-phenylene and methylphenylene.

$X_k$ represents a monovalent group containing an active methylene group and preferred specific examples thereof include $R^{8k}$—CO—$CH_2$—COO—, —NC—$CH_2$—COO—, $R^{8k}$—CO—$CH_2$—CO— and $R^{8k}$—CO—$CH_2$—CON($R^{5k}$)—, wherein $R^{5k}$ is as defined above and $R^{8k}$ represents a substituted or unsubstituted alkyl group having from 1 to 12 carbon atoms (e.g., methyl, ethyl, n-propyl, n-butyl, t-butyl, n-nonyl, 2-methoxyethyl, 4-phenoxybutyl, benzyl, 2-methanesulfonamidoethyl), a substituted or unsubstituted aryl group (e.g., phenyl, p-methylphenyl, p-methoxyphenyl, o-chlorophenyl), an alkoxy group (e.g., methoxy, ethoxy, methoxyethoxy, n-butoxy), a cycloalkyloxy group (e.g., cyclohexyloxy), an aryloxy group (e.g., phenoxy, p-methylphenoxy, o-chlorophenoxy, p-cyanophenoxy), an amino group or a substituted amino group (e.g., methylamino, ethylamino, dimethylamino, butylamino).

Examples of the ethylenically unsaturated monomer containing an active methylene group represented by C in the polymer represented by formula (k) of the present invention are set forth below, but the present invention is by no means limited to these.

M-1: 2-Acetoacetoxyethyl Methacrylate
M-2: 2-Acetoacetoxyethyl Acrylate
M-3: 2-Acetoacetoxypropyl Methacrylate
M-4: 2-Acetoacetoxypropyl Acrylate
M-5: 2-Acetoacetamidoethyl Methacrylate
M-6: 2-Acetoacetamidoethyl Acrylate
M-7: 2-Cyanoacetoxyethyl Methacrylate
M-8: 2-Cyanoacetoxyethyl Acrylate
M-9: N-(2-Cyanoacetoxyethyl)acrylamide
M-10: 2-Propionylacetoxyethyl Acrylate
M-11: N-(2-Propionylacetoxyethyl)methacrylamide
M-12: N-4-(Acetoacetoxybenzyl)phenylacrylamide
M-13: Ethylacryloyl Acetate
M-14: Acryloylmethyl Acetate
M-15: N-Methacryloyloxymethylacetoacetamide
M-16: Ethylmethacryloyl Acetoacetate
M-17: N-Allylcyanoacetamide
M-18: 2-Cyanoacetylethyl Acrylate
M-19: N-(2-Methacryloyloxymethyl)cyanoacetamide
M-20: p-(2-Acetoacetyl)ethylstyrene
M-21: 4-Acetoacetyl-l-methacryloylpiperazine
M-22: Ethyl-a-acetoacetoxymethacrylate
M-23: N-Butyl-N-acryloyloxyethylacetoacetamide
M-24: p-(2-Acetoacetoxy)ethylstyrene In the polymer latex of the present invention, an ethylenically unsaturated monomer other than the above-described ethylenically unsaturated monomers having an active methylene group may be copolymerized.

Examples of the monomer include acrylic esters, methacrylic esters, vinyl esters, acrylamides, methacrylamides, olefins, styrenic acid, vinyl ethers and monomers constituting the above-described core grain, and among these, acrylic esters, methacrylic esters, vinyl esters and styrenes are particularly preferred.

Preferred compounds as the polymer latex of the present invention are set forth below, but the present invention is by no means limited thereto.

In each parenthesis, the weight percentage of respective components in the copolymer is shown.

| | |
|---|---|
| Po-1 | Ethyl acrylate/M-1/acrylic acid copolymer (85/10/5) |
| Po-2 | n-Butyl acrylate/M-1/sodium 2-acrylamido-2-methylpropanesulfonate copolymer (85/10/5) |
| Po-3 | n-Butyl acrylate/M-1/methacrylic acid copolymer (85/5/10) |
| Po-4 | 2-Ethylhexyl acrylate/M-2/sodium 2-acrylamido-2-methylpropanesulfonate copolymer (75/20/5) |
| Po-5 to Po-9 | n-Butyl acrylate/M-1/acrylic acid copolymer (x/y/z)<br>Po-5 x/y/z = 95/2/3<br>Po-6 x/y/z = 92/5/3<br>Po-7 x/y/z = 89/8/3<br>Po-8 x/y/z = 81/16/3<br>Po-9 x/y/z = 72/25/3 |
| Po-10 | n-Butyl acrylate/styrene/M-1/methacrylic acid copolymer (65/20/5/10) |
| Po-11 | Methyl acrylate/M-4/methacrylic acid copolymer (80/15/5) |
| Po-12 | n-Butyl acrylate/M-5/acrylic acid copolymer (85/10/5) |
| Po-13 | n-Butyl acrylate/M-7/methacrylic acid copolymer (85/10/5) |
| Po-14 | 2-Ethylhexyl acrylate/M-9 copolymer (75/25) |
| Po-15 | n-Butyl acrylate/M-13/sodium styrenesulfonate copolymer (85/10/5) |
| Po-16 | n-Butyl acrylate/M-14/potassium styrenesulfinate copolymer (75/20/5) |
| Po-17 | n-Hexyl acrylate/methoxyethyl acrylate/M-2 copolymer (70/20/10) |
| Po-18 | 2-Ethylhexyl acrylate/M-15/methacrylic acid copolymer (90/5/5) |
| Po-19 | n-Butyl acrylate/M-1/M-17/acrylic acid copolymer (75/5/15/5) |
| Po-20 | Octyl methacrylate/M-20/sodium styrenesulfonate copolymer (80/15/5) |

Further, polymer latexes having a composition consisting of a core part and a shell part and containing in the shell part an ethylenically unsaturated monomer having an active methylene group are also preferably used.

Preferred examples of the compound as the core/shell latex of the present invention are set forth below, but the present invention is by no means limited thereto. In the following structure of each latex compound, the core polymer structure, the shell polymer structure and the core/shell ratio are shown in this order and the copolymer compositional ratio in each polymer and the core/shell ratio are each shown by weight percentage.

P1 to P-12

Core: Styrene/Butadiene Copolymer (37/63)

P-1: Shell=Styrene/M-1 (98/2), Core/Shell=50/50

P-2: Shell=Styrene/M-1 (96/4), Core/Shell=50/50

P-3: Shell=Styrene/M-1 (92/8), Core/Shell=50/50

P-4: Shell=Styrene/M-1 (84/16), Core/Shell=50/50

P-5: Shell=Styrene/M-1 (68/32), Core/Shell=50/50

P-6: Shell=Styrene/M-1 (84/16), Core/Shell=85/15

P-8: Shell=n-Butyl Acrylate/M-1 (96/4), Core/Shell=50/50

P-9: Shell=n-Butyl Acrylate/M-1 (92/8), Core/Shell=50/50

P-10: Shell=n-Butyl Acrylate/M-1 (84/16), Core/Shell=50/50

P-11: Shell=Methyl Acrylate/M-7 (84/16), Core/Shell=50/50

P-12: Shell=Styrene/Methyl Acrylate/M-3 (21.63/16), Core/Shell=50/50

P-13 and P-14

Core: Styrene/Butadiene Copolymer (22/78)

P-13: Shell=Styrene/M-2 (84/16), Core/Shell=50/50

P-14: Shell=n-Butyl Acrylate/M-8 (84/16), Core/Shell=50/50

P-15 to P-20

Core: Butadiene Homopolymer (100)

P-15: Shell=Styrene/M-1 (84/16), Core/Shell=50/50

P-16: Shell=Ethyl Acrylate/M-7/Methacrylic Acid (65/15/20), Core/Shell=75/25

P-17: Shell=n-Butyl Acrylate/M-1 (84/16), Core/Shell=50/50

P-18: Shell=n-Butyl Acrylate/M-2 (84/16), Core/Shell=50/50

P-19: Shell=2-Ethylhexyl Acrylate/M-24 (84/16), Core/Shell=50/50

P-20: Shell=n-Butyl Acrylate/M-18 (84/16), Core/Shell=50/50

P-21 to P-23

Core: Isoprene Homopolymer (100)

P-21: Shell=Styrene/Acrylonitrile/M-1 (63/21/16), Core/Shell=90/10

P-22: Shell=Methyl Methacrylate/Ethyl Acrylate/M-2/Sodium 2-Acrylamido-2-methylpropane-sulfonate (15/65/15/5), Core/Shell=75/25

P-23: Shell=Styrene/M-1 (84/16), Core/Shell=20/80

P-24 to P-26

Core: Styrene/Butadiene Copolymer (49/51)

P-24: Shell=Styrene/Butyl Acrylate/M-1 (25/60/15), Core/Shell=50/50

P-25: Shell=M-1 (100), Core/Shell=90/10

P-26: Shell=Lauryl Methacrylate/Butyl Acrylate/M-7 (30/55/15), Core/Shell=40/60

P-27

Core: Acrylonitrile/Styrene/Butadiene Copolymer (25/25/50)

Shell: Butyl Acrylate/M-1 (92/8), Core/Shell=50/50

P-28

Core: Ethyl Acrylate/Butadiene Copolymer (50/50)

Shell: Styrene/Divinylbenzene/M-1 (79/5/16), Core/Shell=50/50

P-29 to P-33

Core: n-Dodecyl Methacrylate Homopolymer

P-29: Shell=Styrene/M-1 (92/8), Core/Shell=50/50

P-30: Shell=Styrene/M-1 (84/16), Core/Shell=50/50

P-31: Shell=Ethyl Acrylate/M-1 (96/4), Core/Shell=50/50

P-32: Shell=Ethyl Acrylate/M-1 (92/8), Core/Shell=50/50

P-33: Shell=Styrene/Methyl Acrylate/M-3 (21/63/16), Core/Shell=50/50

P-34

Core: n-Butyl Acrylate Homopolymer

Shell: Styrene/M-2 (84/16), Core/Shell=50/50

P-35 and P-36

Core: Ethylene Glycol Dimethacrylate/n-Butyl Acrylate Copolymer (10/90)

P-35: Shell=Styrene/M-1 (84/16), Core/Shell=50/50

P-36: Shell=Methyl Acrylate/M-7/Methacrylic Acid (65/15/20), Core/Shell=75/25

P-37 to P-40

Core: Ethylene Glycol Dimethacrylate/n-Butyl Acrylate Copolymer (20/80)

P-37: Shell=Styrene/M-1 (84/16), Core/Shell=50/50

P-38: Shell=Styrene/M-1 (84/16), Core/Shell=75/25

P-39: Shell=Methyl Acrylate/M-8/Sodium 2-Acrylamido-2-methylpropanesulfonate (80/15/5), Core/Shell=75/25

P-40: Shell=n-Butyl Acrylate/M-1 (84/16), Core/Shell=50/50

P-41 to P-43

Core: Vinyl Acetate Homopolymer (100)

P-41: Shell=Styrene/M-1 (84/16), Core/Shell=50/50

P-42: Shell=Styrene/Divinylbenzene/M-24 (79/5/16), Core/Shell=50/50

P-43: Shell=n-Dodecyl Methacrylate/Butyl Acrylate/M-7 (30/55/15), Core/Shell=40/60

P-44 to P-46

Core: Divinylbenzene/2-Ethylhexyl Acrylate Copolymer (10/90)

P-44: Shell=Methyl Acrylate/M-1 (84/16), Core/Shell=50/50

P-45: Shell=Methyl Acrylate/Styrene/M-1 (74/10/16), Core/Shell=50/50

P-46: Shell=M-1 (100), Core/Shell=90/10

P-47 to P-49

Core: Divinylbenzene/Styrene/2-Ethylhexyl Acrylate Copolymer (10/23/67)

P-47: Shell=Methyl Acrylate/M-1 (84/16), Core/Shell=50/50

P-48: Shell=Methyl Acrylate/Styrene/M-1 (74/10/16), Core/Shell=50/50

P-49: Shell=Ethyl Acrylate/2-Hydroxyethyl Methacrylate/M-5 (65/15/20), Core/Shell=85/15

P-50

Core: Ethylene Glycol Dimethacrylate/Vinyl Palmitate/n-Butyl Acrylate Copolymer (20/20/60)

Shell: Ethylene Glycol Dimethacrylate/Styrene/n-Butyl Methacrylate/M-1 Copolymer (5/40/40/15), Core/Shell=50/50

P-51

Core: Trivinylcyclohexane/n-Butyl Acrylate/Styrene Copolymer (10/55/35)

Shell: Methyl Acrylate/M-1/Sodium 2-Acrylamido-2-methylpropanesulfonate (88/7/5), Core/Shell=70/30

P-52 and P-53

Core: Divinylbenzene/Styrene/Methyl Methacrylate Copolymer (10/45/45)

P-52: Shell=n-Butyl Acrylate/M-1 (84/16), Core/Shell=50/50

P-53: Shell=n-Dodecyl Acrylate/Ethyl Acrylate/M-21 (60/30/10), Core/Shell=50/50

P-54 and P-55

Core: p-Vinyltoluene/n-Dodecyl Methacrylate Copolymer (70/30)

P-54: Shell=Methyl Acrylate/n-Butyl Methacrylate/M-2/Acrylic Acid (30/55/10/5), Core/Shell=50/50

P-55: Shell=n-Butyl Acrylate/M-19 (84/16), Core/Shell=70/30

The polymer latex for use in the present invention can be prepared by a general synthesis method. JP-A-7-152112 describes it specifically.

In the present invention, the compound represented by the following formula (SA-1), (SA-2), (SA-3) or (SA-4) is preferably used in combination with the above-described hydrazine derivative and nucleation accelerator.

Formula (SA-1) is described below.

$$R_1\text{-}L\text{-}G\text{-}A^{\ominus}\cdot M^{\oplus} \qquad \text{(SA-1)}$$

wherein $R_1$ represents an alkyl group or an alkenyl group, L represents a phenylene group, a naphthylene group or single bond, G represents $—O(CH_2)_n—$ (wherein n is from 2 to 10) or a single bond, $A^-$ represents $—OSO_3—$ or $—SO_3—$, and $M^+$ represents a cation.

Formula (SA-1) is described in greater detail.

In formula (SA-1), the alkyl group represented by $R_1$ is preferably an alkyl group having a total carbon number of from 6 to 30, more preferably a linear, branched or cyclic alkyl group having a total carbon number of from 8 to 25. The alkyl group represented by $R_1$ may have further a substituent such as an alkoxy group or an aryloxy group and examples of the alkyl group include an n-butyl group, an isobutyl group, an n-hexyl group, an n-octyl group, a 2-ethylhexyl group, an n-nonyl group, an n-dodecyl group, an n-hexadecyl group, an n-octadecyl group and a 2-hexylnonyl group. The alkenyl group includes an alkenyl group having from 4 to 30 carbon atoms, preferably from 6 to 25 carbon atoms, and specific examples thereof include $—C_8H_{16}$, $—C_{10}H_{20}$ and $—C_{17}H_{33}$. The phenylene group and the naphthylene group represented by L may be substituted by a plurality of $R_1$ groups. The $R_1$ groups in plurality may be the same or different. $M^+$ represents a hydrogen atom, an alkali metal ion (e.g., lithium ion, sodium ion, potassium ion) or an ammonium ion, and $M^+$ is particularly preferably a hydrogen ion, a sodium ion or a potassium ion.

Specific examples of the compound represented by (SA-1) are set forth below, but the present invention is by no means limited to these.

$C_{10}H_{21}SO_3Na$ W1-1

$C_{12}H_{25}SO_3Na$ W1-2

$C_{16}H_{33}SO_3Na$ W1-3

$C_{16}H_{33}-CH=CHSO_3Na$ W1-4

$C_{12}H_{25}OCH_2CH_2SO_3Na$ W1-5

$C_{12}H_{25}O(CH_2)_4SO_3Na$ W1-6

$C_{16}H_{33}O(CH_2)_3SO_3Na$ W1-7

$C_8H_{17}-CH(C_6H_{13})-SO_3Na$ W1-8

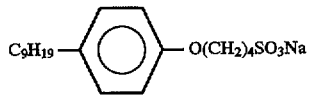

W1-9

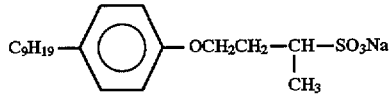

W1-10

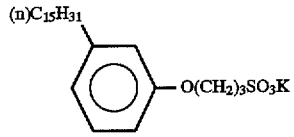

W1-11

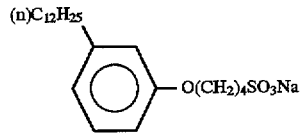

W1-12

-continued

W1-13

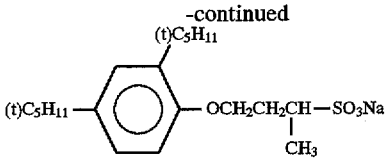

W1-14

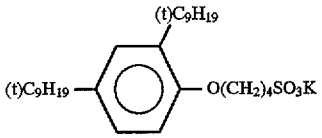

W1-15

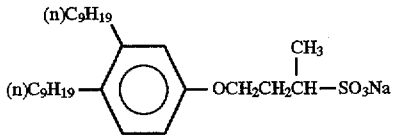

W1-16

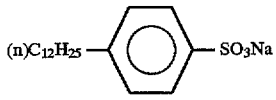

W1-17

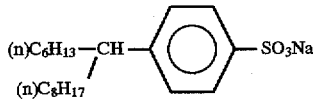

W1-18

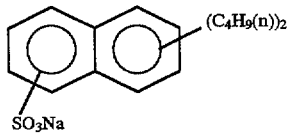

W1-19

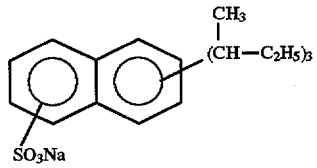

W1-20

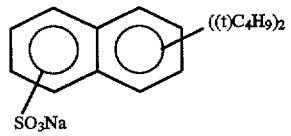

Formula (SA-2) is described below.

(SA-2)

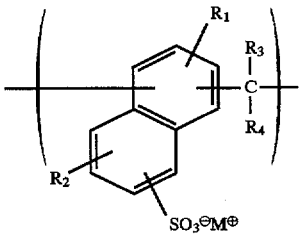

wherein $R_1$ and $R_2$, which may be the same or different, each represents a hydrogen atom, an alkyl group, an aryl group, an alkoxyl group, an alkenyl group, a carbamoyl group, a carbonamido group, a sulfonamido group or a halogen atom, $R_3$ and $R_4$, which may be the same or different, each represents a hydrogen atom, an alkyl group or an aryl group, and M represents a cation.

The polymer represented by formula (SA-2) of the present invention is described below in greater detail.

In formula (SA-2), $R_1$ and $R_2$ each is preferably a hydrogen atom, an alkyl group having from 1 to 20 carbon atoms (e.g., methyl, ethyl, n-propyl, isopropyl, n-butyl, t-butyl, n-amyl, tert-amyl, n-hexyl, n-octyl, tert-octyl, n-nonyl, dodecyl, octadecyl), an aryl group having from 6 to 20 carbon atoms (e.g., phenyl, p-toluyl, m-chlorophenyl), an alkenyl group having from 2 to 20 carbon atoms (oleyl, vinyl, allyl), an alkoxyl group having from 1 to 20 carbon atoms (e.g., methoxy, ethoxy, butoxy, octyloxy), a carbamoyl group represented by $—NR_5CO—R_6$ (wherein $R_5$ and $R_6$, which may be the same or different, each represents a hydrogen atom, an alkyl group having from 1 to 20 carbon atoms, an aryl group having from 6 to 20 carbon atoms, an alkenyl group having from 2 to 20 carbon atoms), a carbonamido group represented by $—CONR_5R_6$ (wherein $R_5$ and $R_6$ are as defined above), a sulfonamido group represented by $—SO_2NR_5R_6$ (wherein $R_5$ and $R_6$ are as defined above), or a halogen atom (e.g., fluorine, chlorine, bromine), and particularly preferably a hydrogen atom, an alkyl group having from 1 to 8 carbon atoms, an alkoxyl group having from 1 to 8 carbon atoms, a fluorine atom or a chlorine atom.

$R_3$ and $R_4$ each is preferably a hydrogen atom, an alkyl group having from 1 to 12 carbon atoms (e.g., methyl, ethyl, n-propyl, isopropyl, n-butyl, n-acyl, n-hexyl, cyclohexyl, octyl, nonyl, dodecyl) or an aryl group having from 6 to 12 carbon atoms (e.g., phenyl, p-toluyl, α-naphthyl, p-chlorophenyl), and particularly preferably a hydrogen atom, an alkyl group having from 1 to 4 carbon atoms or a phenyl group. $R_3$ and $R_4$ may be combined with each other to form a ring structure.

M is preferably a hydrogen atom, an alkali metal ion (e.g., lithium ion, sodium ion, potassium ion) or an ammonium ion, and particularly preferably a hydrogen atom, a sodium ion or a potassium ion.

The polymer for use in the present invention may be preferably a copolymer having two or more kinds of repeating unit structures represented by formula (SA-2) in the same molecule. Further, the polymer may be preferably a copolymer of a repeating unit represented by formula (SA-2) with a repeating unit (e.g., the repeating units represented by the following formulae CU-1 to CU-4) other than the repeating unit represented by formula (SA-2).

CU-1

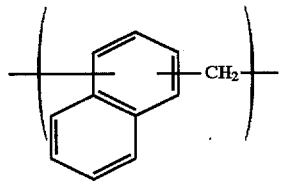

CU-2

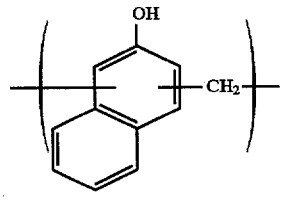

CU-3

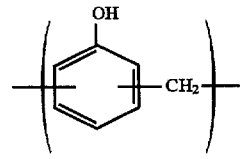

-continued

CU-4

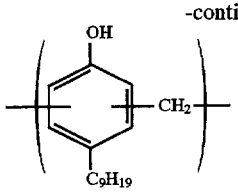

The repeating unit represented by formula (SA-2) of the present invention preferably occupies from 10 to 100%, more preferably from 50 to 100% of the repeating unit number of the polymer which is preferably used in the present invention.

Specific examples of the polymer having a repeating unit represented by formula (SA-2) of the present invention are set forth below, but the present invention is by no means limited to these compounds.

W2-1

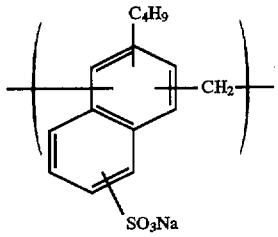

number average molecular weight: 1,600

W2-2

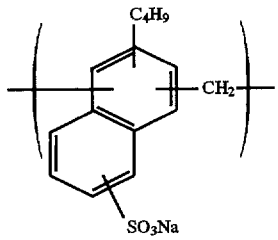

number average molecular weight: 2,900

W2-3

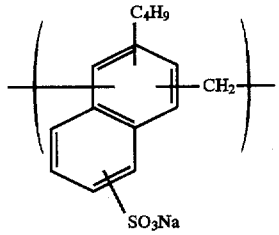

number average molecular weight: 4,500

W2-4

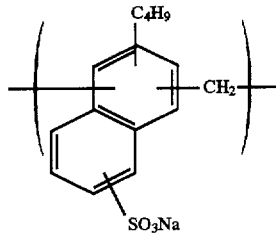

number average molecular weight: 6,700

W2-5

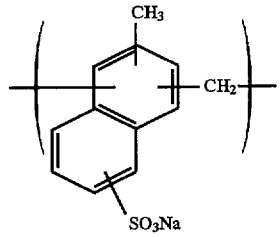

number average molecular weight: 2,300

-continued

W2-6

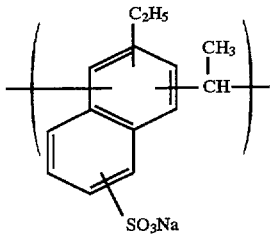

number average molecular weight: 3,400

W2-7

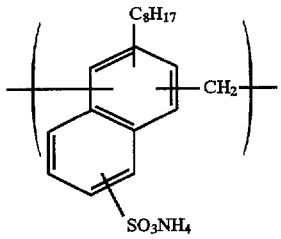

number average molecular weight: 6,900

W2-8

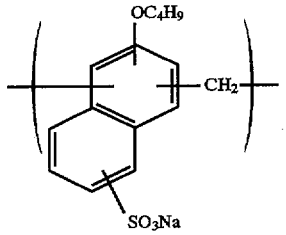

number average molecular weight: 4,200

W2-9

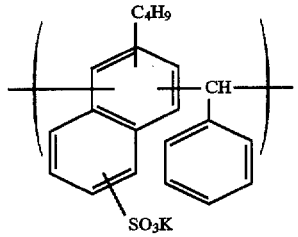

number average molecular weight: 5,500

W2-10

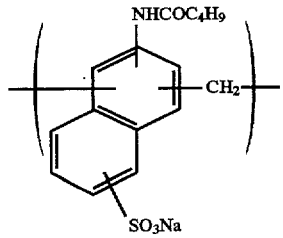

number average molecular weight: 2,400

W2-11

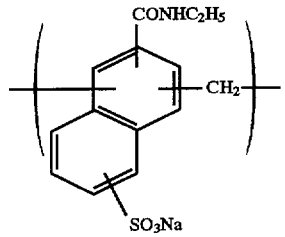

number average molecular weight: 2,100

-continued

W2-12

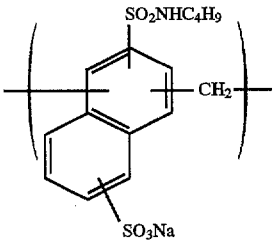

number average molecular weight: 1,700

W2-13

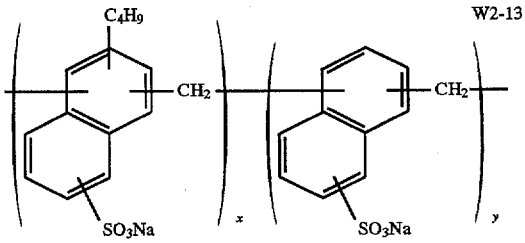

x/y = 75/25 (mol fraction)
number average molecular weight: 3,900

W2-14

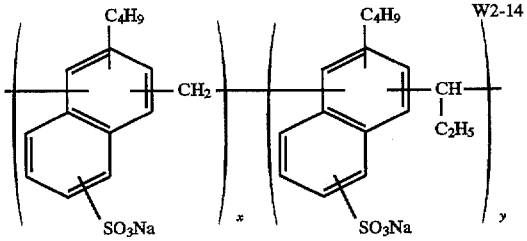

x/y = 50/50 (mol fraction)
number average molecular weight: 4,500

W2-15

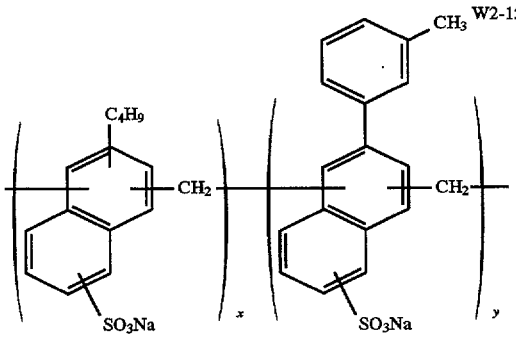

x/y = 95/5 (mol fraction)
number average molecular weight: 4,000

W2-16

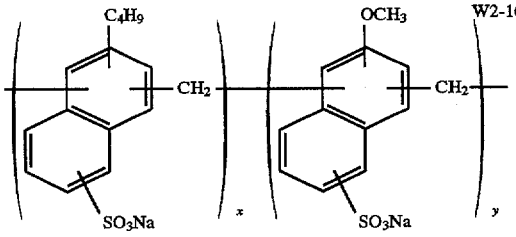

x/y = 60/40 (mol fraction)
number average molecular weight: 6,200

Formula (SA-3) is described below.

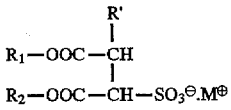

(SA-3)

wherein $R_1$ and $R_2$, which may be the same or different, each represents an alkyl group having from 6 to 30 carbon atoms, R' represents a hydrogen atom or —$COOR_3$, $R_3$ has the same meaning as $R_1$ and $R_2$, and $M^+$ represents a cation.

Formula (SA-3) is described below in greater detail.

$R_1$ and $R_2$ each is a linear or branched alkyl group having from 6 to 30 carbon atoms and both of $R_1$ and $R_2$ have a carbon number of 6 or more, more preferably from 8 to 20. When R' is —$COOR_3$, all of $R_1$, $R_2$ and $R_3$ have a carbon number of 6 or more.

Specific examples of the compound represented by formula (SA-3) are set forth below, but the present invention is by no means limited thereto.

W3-1

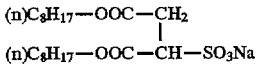

W3-2

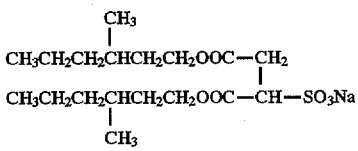

W3-3

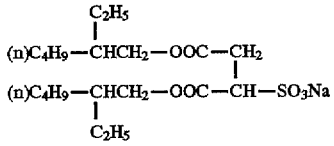

W3-4

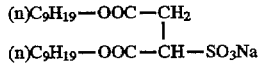

W3-5

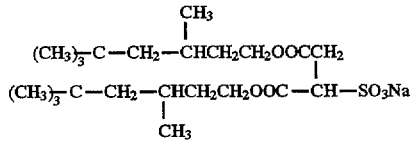

W3-6

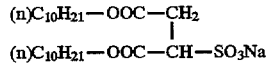

W3-7

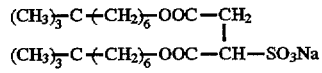

W3-8

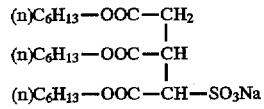

W3-9

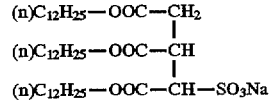

Formula (SA-4) is described below.

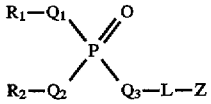

(SA-4)

wherein $R_1$ represents an aliphatic group, an alicyclic compound group, an aromatic group or a heterocyclic ring, $R_2$ represents an aliphatic group, an alicyclic compound group, an aromatic group, a heterocyclic ring or a group represented by —L—Z, $Q_1$, $Q_2$ and $Q_3$ each represents a single bond, an oxygen atom, a sulfur atom, or a group represented by —N($R_3$)— or —N($R_3$)—CO— (wherein $R_3$ represents a hydrogen atom or a group represented by $R_2$), L represents a divalent linking group, and Z represents an ionic group.

Describing in greater detail, in formula (SA-4), the aliphatic group represented by $R_1$ is preferably a linear or branched unsubstituted alkyl group having from 1 to 40 carbon atoms (e.g., methyl, ethyl, n-propyl, iso-propyl, n-butyl, sec-butyl, tert-butyl, n-amyl, tert-amyl, n-hexyl, n-heptyl, n-octyl, tert-octyl, 2-ethylhexyl, n-nonyl, 1,1,3-trimethylhexyl, n-decyl, n-dodecyl, cetyl, hexadecyl, 2-hexyldecyl, octadecyl, eicosyl, 2-octyldodecyl, docosyl, tetracosyl, 2-decyltetradecyl, tricosyl), a linear or branched substituted alkyl group having from 1 to 40 carbon atoms (examples of the substituent includes an alkoxyl group, an aryl group, a halogen atom, a carbonester group, a carbonamido group, a carbamoyl group, an oxycarbonyl group and a phosphate) (e.g., benzyl, β-phenethyl, 2-methoxyethyl, 4-phenylbutyl, 4-acetoxyethyl, 6-phenoxyhexyl, 12-phenyldodecyl, 18-phenyloctadecyl, heptadecylfluorooctyl, 12-(p-chlorophenyl)dodecyl, 2-(diphenyl phosphato)ethyl), a linear or branched unsubstituted alkenyl group having from 2 to 40 carbon atoms (e.g., vinyl, allyl, 3-butenyl, 2-methyl-2-butenyl, 4-pentenyl, 3-pentenyl, 3-methyl-3-pentenyl, 5-hexenyl, 4-hexenyl, 3-hexenyl, 2-hexenyl, 7-octenyl, 9-decenyl, oleyl, linoleyl, linolenyl), a linear or branched substituted alkenyl group having from 2 to 40 carbon atoms (e.g., 2-phenylvinyl, 4-acetyl-2-butenyl, 13-methoxy-9-octadecenyl, 9,10-dibromo-12-octadecenyl), a linear or branched unsubstituted alkynyl group having from 2 to 40 carbon atoms (e.g., acetylene, propargyl, 3-butynyl, 4-pentynyl, 5-hexynyl, 4-hexynyl, 3-hexynyl, 2-hexynyl), or a linear or branched substituted alkynyl group having from 2 to 40 carbon atoms (the substituents is preferably an alkoxyl group or an aryl group) (e.g., 2-phenylacetylene, 3-phenylpropargyl).

The alicyclic compound group is preferably a substituted or unsubstituted cycloalkyl group having from 3 to 40 carbon atoms (e.g., cyclopropyl, cyclohexyl, 2,6-dimethylcyclohexyl, 4-tert-butylcyclohexyl, 4-phenylcyclohexyl, 3-methoxycyclohexyl, cycloheptyl), or a substituted or unsubstituted cycloalkenyl group having from 4 to 40 carbon atoms (e.g., 1-cyclohexenyl, 2-cyclohexenyl, 3-cyclohexenyl, 2,6-dimethyl-3-cyclohexenyl, 4-tert-butyl-2-cyclohexenyl, 2-cycloheptenyl, 3-methyl-3-cycloheptenyl), and the aromatic group is preferably a substituted or unsubstituted aryl group having from 6 to 50 carbon atoms (examples of the substituent include an alkyl group, an alkoxyl group, an aryl group, a halogen atom) (e.g., phenyl, 1-naphthyl, 2-naphthyl, anthranyl, o-cresyl, m-cresyl, p-cresyl, p-ethylphenyl, p-tert-butylphenyl, 3,5-di-tert-butylphenyl, p-n-amylphenyl, p-tert-amylphenyl, 2,6-dimethyl-4-tert-butylphenyl, p-cyclohexylphenyl, octylphenyl, p-tert-octylphenyl, nonylphenyl, p-n-dodecylphenyl, m-methoxyphenyl, p-butoxyphenyl, m-octyl-oxyphenyl, biphenyl, m-chlorophenyl, pentachlorophenyl, 2-(5-methylnaphthyl)).

Preferred examples of the heterocyclic ring include a substituted or unsubstituted cyclic ether having from 4 to 40 carbon atoms (e.g., furyl, 4-butyl-3-furyl, pyranyl, 5-octyl-2H-pyran-3-yl, isobenzofuranyl, chromenyl) and a substituted or unsubstituted nitrogen-containing ring having from 4 to 40 carbon atoms (e.g., 2H-pyrrolyl, pyrrolyl, imidazolyl, pyrazolyl, indolizinyl, morpholyl).

Among these, particularly preferred are a linear, cyclic or branched unsubstituted alkyl group having from 1 to 24 carbon atoms (e.g., methyl, ethyl, n-propyl, n-butyl, n-amyl, n-hexyl, cyclohexyl, n-heptyl, n-octyl, 2-ethylhexyl, n-nonyl, 1,1,3-trimethylhexyl, n-decyl, n-dodecyl, cetyl, hexadecyl, 2-hexyldecyl, octadecyl, eicosyl, 2-octyldodecyl, docosyl, tetracosyl, 2-decyltetradecyl), a linear, cyclic or branched alkyl group having from 1 to 24 carbon atoms exclusive of the carbon number of the substituent (e.g., 6-phenoxyhexyl, 12-phenyldodecyl, 18-phenyloctadecyl, heptadecylfluorooctyl, 12-(p-chlorophenyl)dodecyl, 4-tert-butylcyclohexyl), a linear, cyclic or branched unsubstituted alkenyl group having from 2 to 24 carbon atoms (e.g., vinyl, allyl, 2-methyl-2-butenyl, 4-pentenyl, 5-hexenyl, 3-hexenyl, 3-cyclohexenyl, 7-octenyl, 9-decenyl, oleyl, linoleyl, linolenyl), a linear, cyclic or branched substituted alkenyl group having from 2 to 24 carbon atoms (e.g., 2-phenylvinyl, 9,10-dibromo-12-octadecenyl), and a substituted or unsubstituted aryl group having from 6 to 30 carbon atoms (e.g., phenyl, 1-naphthyl, 2-naphthyl, p-cresyl, p-ethylphenyl, p-tert-butylphenyl, p-tert-amylphenyl, octylphenyl, p-tert-octylphenyl, nonylphenyl, p-n-dodecylphenyl, m-octyloxyphenyl, biphenyl).

$Q_1$, $Q_2$ and $Q_3$ each independently represents a single bond, an oxygen atom, a sulfur atom or a group represented by —N($R_3$)— or —N($R_3$)—CO— (wherein $R_3$ represents a hydrogen atom or $R_2$ defined above). Among these, preferred are a single bond, an oxygen atom and —N($R_3$)—, and particularly preferably, at least two or more of $Q_1$, $Q_2$ and $Q_3$ are an oxygen atom. The term "single bond" as used herein means that no element is present.

L represents a divalent linking group and preferably a group represented by the following formula:

$$[Y_1(J_1)_p[Y_2(J_2)_q]_a[Y_3(J_3)_r]_b]_s$$

wherein $Y_1$, $Y_2$ and $Y_3$, which may be the same or different, each represents a substituted or unsubstituted alkylene group having from 1 to 40 carbon atoms, or a substituted or unsubstituted arylene group having from 6 to 40 carbon atoms (the substituent is the same as described above for $R_1$). Preferred examples of the alkylene include a methylene group, an ethylene group, a propylene group, a trimethylene group, a tetramethylene group, a pentamethylene group, a hexamethylene group, a 1,4-cyclohexylene group, an octamethylene group, a decamethylene group and a 2-methoxy-1,3-propylene group, and preferred examples of the arylene group include an o-phenylene group, an m-phenylene group, a p-phenylene group, a 3-chloro-1,4-phenylene group, a 1,4-naphthylene group and a 1,5-naphthylene group. Among these, preferred are an ethylene group, a propylene group, a trimethylene group, a tetramethylene group, a pentamethylene group, a hexamethylene group, a 1,4-cyclohexylene group, an octamethylene group, a decamethylene group, an m-phenylene group and a p-phenylene group.

$J_1$, $J_2$ and $J_3$, which may be the same or different, each represents a divalent bond unit and preferred examples thereof include a single bond, —O—, —S—, —CO—, —COO—, —OCO—, —CON($R_4$)— (wherein $R_4$ represents a hydrogen atom an unsubstituted alkyl group having from 1 to 6 carbon atoms or a substituted alkyl group having from 1 to 6 carbon atoms exclusive of the carbon number of the substituent (examples of the substituent include an aryl group, an alkoxyl group and a halogen atom), —N($R_4$)CO— (wherein $R_4$ is as defined above), —CON($R_4$)CO— (wherein $R_4$ is as defined above), —N($R_4$)CON($R_5$)— (wherein $R_4$ and $R_5$, which may be the same or different, each has the same meaning as $R_4$ defined above), —OCON $(R_4)$— (wherein $R_4$ is as defined above), —$N(R_4)COO$— (wherein $R_4$ is as defined above), —$SO_2$—, —$SO_2N(R_4)$— (wherein $R_4$ is as defined above), —$N(R_4)SO_2$— (wherein $R_4$ is as defined above), —$N(COR_4)$— (wherein $R_4$ is as defined above) and —$OP(=O)(OR_1)O$— (wherein $R_1$ is as defined above). Among these, particularly preferred are a single bond, —O—, —S—, —CO—, —COO—, —OCO—, —$CON(R_4)$— (wherein $R_4$ represents a hydrogen atom, a methyl group, an ethyl group, a propyl group), —$N(R_4)CO$— (wherein $R_4$ is as defined above), —$SO_2N(R_4)$— (wherein $R_4$ is as defined above) and —$N(R_4)SO_2$— (wherein $R_4$ is as defined above).

p, q and r each independently represents an integer of from 0 to 5, preferably from 0 to 3, more preferably 0 or 1. s represents an integer of from 1 to 10, preferably from 1 to 5, more preferably from 1 to 3.

a and b each independently represents an integer of from 0 to 50, preferably from 0 to 20, more preferably from 0 to 10.

Z is preferably a hydrophilic anionic, cationic or ampho-ionic group, more preferably in view of photographic performance an anionic group. Examples of the anionic group include —COOM, —$SO_3M$, —$OSO_3M$, —$PO(OM)_2$ and —$OPO(OM)_2$ (wherein M represents a counter cation and preferred examples thereof include an alkali metal ion (e.g., lithium ion, sodium ion, potassium ion), an alkaline earth metal ion (e.g., magnesium ion, calcium ion) and an ammonium ion, with sodium ion and potassium ion being particularly preferred). Examples of the cationic group include —$NH_3^+.X^-$, —$NH(R_6)^+.X^-$, —$NH(R_6)_2^+X^-$, —$N(R_6)_3^+.X^-$ (wherein $R_6$ represents an alkyl group having from 1 to 3 carbon atoms (e.g., methyl, ethyl, 2-hydroxyethyl, n-propyl, iso-propyl, with methyl and 2-hydroxyethyl being preferred) and X represents a counter anion, preferably a halogen ion (e.g., fluorine ion, chlorine ion, bromine ion), a composite inorganic anion (e.g., hydroxide ion, sulfate ion, nitrate ion, phosphate ion) or an organic compound anion (e.g., oxalate ion, formate ion, acetate ion, propionate ion, methanesulfonate ion, p-toluenesulfonate ion), more preferably a chlorine ion, a sulfate ion, a nitrate ion or an acetate ion.

The ampho-ionic group preferably has a structure represented by the following formula (VII):

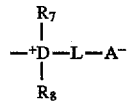

(VII)

wherein D represents a nitrogen atom or a phosphorus atom, $R_7$ and $R_8$ each represents a hydrogen atom or an alkyl group having from 1 to 3 carbon atoms (e.g., methyl, ethyl, 2-hydroxyethyl, iso-propyl), particularly preferably a methyl group or a 2-hydroxyethyl group, L is the same as the divalent linking group defined in the forgoing formula, and $A^-$ represents an anionic group, preferably a group represented by —COO—, —$SO_3$—, —$OSO_3$—, —$PO(OR_9)O$— or —$OPO(OR_9)O$— (wherein $R_9$ represents a hydrogen atom or an alkyl group having from 1 to 3 carbon atoms (e.g., methyl, ethyl, 2-hydroxyethyl, iso-propyl)).

$R_2$ represents a monovalent group selected from the groups defined above for $R_1$ or the groups defined above for —L—Z. When $R_2$ is selected from the groups defined for $R_1$, it may be the same with or different from, in term of the structure, $R_1$ present in the same molecule, and when $R_2$ is selected from the groups defined for —L—Z, it may also be the same with or different from, in terms of the structure, —L—Z present in the same molecule. $R_2$ is particularly preferably selected from the groups defined for $R_1$.

The total carbon number of $R_1$ and $R_2$ is preferably from 6 to 80, more preferably from 8 to 50.

Any two or more groups of $R_1$, $R_2$ and L may be combined with each other to form a ring structure. In this case, the ring structure formed is not particularly restricted, but in view of stability of the ring structure, 4- to 7-membered rings are preferred, and 5- and 6-membered rings are more preferred.

Specific examples of preferred surface active compounds for use in the present invention are set forth below, but the present invention is by no means limited to these compounds.

PW-1

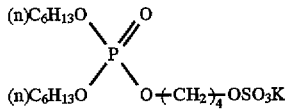

PW-2

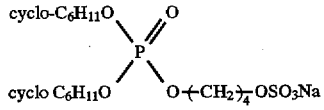

PW-3

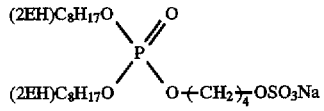

PW-4

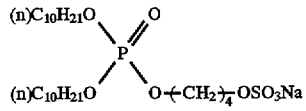

PW-5

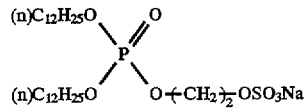

PW-6

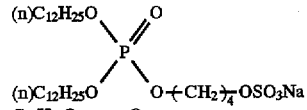

PW-7

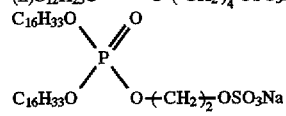

PW-8

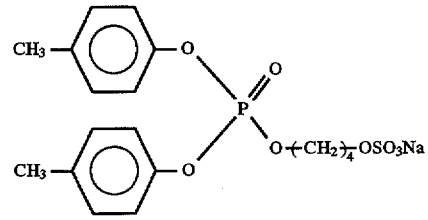

The compound represented by formula (SA-1), (SA-2), (SA-3) or- (SA-4) is incorporated into a silver halide emulsion layer.

The addition amount of the compound represented by formula (SA-1), (SA-2), (SA-3) or (SA-4) is not particularly restricted and the necessary addition amount may be afforded by the formulation of silver halide emulsion layers of a light-sensitive material (e.g., the kind and addition amount of nucleating agent or nucleation accelerator, the pH of the finished solution), but it is preferably from $1\times10^{-6}$ to $2\times10^{-2}$ mol, more preferably from $1\times10^{-5}$ to $1\times10^{-2}$ mol, per mol of silver halide.

The compound represented by formula (SA-1), (SA-2), (SA-3) or (SA-4) may be incorporated into a silver halide emulsion layer, when it is water-soluble, as an aqueous solution or when it is water-insoluble, as a solution in a water-miscible organic solvent such as alcohols (e.g., methanol, ethanol), esters (e.g., ethyl acetate) or ketones (e.g., acetone, ethyl methyl ketone).

The silver halide emulsion for use in the silver halide photographic light-sensitive material of the present invention is not particularly restricted in its halogen composition and any of silver chloride, silver chlorobromide, silver iodochlorobromide, silver bromide and silver iodobromide may be used. In preparing a light-sensitive material for a scanner or a camera, the silver chloride content is preferably 50 mol % or more. In preparing a bright room light type light-sensitive material for contact work, the silver chloride content is preferably 95 mol % or more. The shape of a silver halide grain may be any of a cubic form, a tetradecahedral form, an octahedral form, an irregular form and a plate form, but the cubic form is preferred. The average grain size of silver halide is preferably from 0.1 to 0.7 μm, more preferably from 0.2 to 0.5 μm, and the grain size distribution is preferably narrow and having a coefficient of variation represented by {(standard deviation of grain size)/(average grain size)}×100, of preferably 15% or less, more preferably 10% or less.

The surface and inside of the silver halide grain may be composed of an uniform layer or different layers.

The photographic emulsion for use in the present invention can be prepared by the methods described, for example, in P. Glafkides, *Chimie et Physique Photographigue,* Paul Montel (1967), G. F. Duffin, *Photographic Emulsion Chemistry,* The Focal Press (1966), and V. L. Zelikman et al, *Making and Coating Photographic Emulsion,* The Focal Press (1964).

The method for reacting a soluble silver salt and a soluble halogen salt may be any of a single jet method, a double jet method or a combination thereof.

A method where grains are formed in the presence of excessive- silver ions (so-called reverse mixing method) may also be used. As one type of the double jet method, a method of keeping the pAg in the liquid phase where silver halide is formed constant, a so-called controlled double jet method, may also be used. Further, a method of forming grains using a so-called silver halide solvent such as ammonia, thioether or tetra-substituted thiourea, is preferred. The tetra-substituted thiourea compound is more preferred and it is described in JP-A-53-82408 and JP-A-55-77737. Preferred examples of the thiourea compound include a tetramethylthiourea and 1,3-dimethyl-2-imidazolinethione.

The controlled double jet method and the method of forming grains using a silver halide solvent are useful means for preparing the silver halide emulsion for use in the present invention because a silver halide emulsion having a regular crystal form and narrow in the grain size distribution is easily prepared.

Further, for achieving uniformity of the grain size, it is preferred to grow grains rapidly within the range where the critical saturation degree is not exceeded, using a method of varying the addition rate of silver nitrate or halogenated alkali according to the grain growth speed described in British Patent 1,535,016, JP-B-48-36890 (the term "JP-B" as used herein means an "examined Japanese patent publication") and JP-B-52-16364, or using a method of changing the concentration of the aqueous solution described in British Patent 4,242,445 and JP-A-55-158124.

The silver halide grain for use in the silver halide photographic light-sensitive material of the present invention may contain at least one metal selected from rhodium, rhenium, ruthenium, osmium and iridium, so as to achieve high contrast and low fog. The metal content is preferably from $1\times10^{-9}$ to $1\times10^{-5}$, more preferably from $1\times10^{-8}$ to $5\times10^{-6}$ mol, per mol of silver. These metals may be used in combination of two or more thereof and the metal may be incorporated uniformly into the silver halide grain or may be incorporated to give a molecule within the grain as described in JP-A-63-29603, JP-A-2-306236, JP-A-3-167545, JP-A-4-76534 and JP-A-6-110146, and Japanese Patent Application No. 4-68305.

As the rhodium compound for use in the present invention, a water-soluble rhodium compound may be used. Examples thereof include a rhodium(III) halogenide compound or a rhodium complex salt having a halogen, an amine or an oxalate as a ligand such as a hexachlororhodium(III) complex salt, a hexabromorhodium(III) complex salt, a hexamminerhodium(III) complex salt and a trioxalatorhodium(III) complex salt. The rhodium compound is used after dissolving it in water or an appropriate solvent and in this case, a method commonly used for stabilizing the rhodium compound solution, more specifically, a method of adding an aqueous hydrogen halogenide solution-(e.g., hydrochloric acid, bromic acid, fluoric acid) or a halogenated alkali (e.g., KCl, NaCl, KBr, NaBr), may be used. In place of using a water-soluble rhodium, the rhodium compound may be dissolved by adding separate silver halide grains previously doped with rhodium at the time of preparation of silver halide.

The addition of the compound may be made appropriately at the time of preparation of silver halide emulsion grains or at any stage before coating of the emulsion, but the compound is preferably added at the time of formation of the emulsion to integrate it into a silver halide grain.

The rhenium, ruthenium or osmium for use in the present invention is added in the form of a water-soluble complex salt described in JP-A-63-2042, JP-A-1-285941, JP-A-2-20852 and JP-A-2-20855. The particularly preferred form is a six-coordinate complex salt represented by the following formula:

$$[ML_6]^{-n}$$

wherein M represents Ru, Re or Os and n represents 0, 1, 2, 3 or 4.

In this case, the counter ion plays no important role and an ammonium or alkali metal ion is used.

Preferred examples of the ligand include a halide ligand, a cyanide ligand, a cyan coordination compound ligand, a nitrosyl ligand and a thionitrosyl ligand. Specific examples of the complex for use in the present invention are set forth below, but the present invention is by no means limited thereto.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)(CN)_5]^{-2}$ | $[Re(O)_2(CN)_4]^{-3}$ |
| $[RuCl_6]^{-3}$ | $[RuCl_4(H_2O)_2]^{-2}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_6]^{-3}$ | $[OsCl_5(NO)]^{-2}$ | $[Os(NO)(CN)_5]^{-2}$ |
| $[Os(NS)Br_5]^{-2}$ | $[Os(CN)_6]^{-4}$ | $[Os(O)_2(CN)_4]^{-4}$ |

The addition of the compound may be made appropriately at the time of preparation of silver halide emulsion grains or at any stage before coating of the emulsion, but the compound is preferably added at the time of formation of the emulsion to integrate it into a silver halide grain.

In integrating the compound into a silver halide grain by adding it at the time of grain formation of silver halide, a method where a metal complex powder or an aqueous solution having dissolved therein the metal complex together with NaCl or KCl is added to a water-soluble salt solution or a water-soluble halide solution during the grain formation, a method where the compound is added as the third solution when a silver salt solution and a halide solution are mixed simultaneously and silver halide grains are prepared by a double jet method of three solutions, or a method where a necessary amount of aqueous metal complex solution is poured into a reaction vessel during the grain formation may be used. Among these, preferred is a method where a metal complex powder or an aqueous solution having dissolved therein the metal complex together with NaCl or KCl is added to a water-soluble halide solution.

In order to add the compound to the grain surface, a necessary amount of an aqueous solution of the metal complex may be poured into a reaction vessel immediately after the grain formation, during or after the completion of physical ripening, or at the time of chemical ripening.

As the iridium compound for use in the present invention, various compounds may be used and examples thereof include hexachloroiridium, hexammineiridium, trioxalatoiridium and hexacyanoiridium. The iridium compound is used after dissolving it in water or an appropriate solvent and in this case, a method commonly used for stabilizing the iridium compound solution, more specifically, a method of adding an aqueous hydrogen halogenide solution (e.g., hydrochloric acid, bromic acid, fluoric acid) or a halogenated alkali (e.g., KCl, NaCl, KBr, NaBr), may be used. In place of using a water-soluble iridium, the iridium compound may be dissolved by adding separate silver halide grains previously doped with iridium at the time of preparation of silver halide.

To the silver halide grain, other heavy metal salt may be doped. In particular, doping of an Fe salt such as $K_4[Fe(CN)_6]$ is advantageous.

The silver halide grain for use in the present invention may contain a metal atom such as cobalt, nickel, palladium, platinum, gold, thallium, copper and lead. The above-described metal is used preferably in an amount of from $1\times10^{-9}$ to $1\times10^{-4}$ mol per mol of silver halide. The metal may be added as a metal salt in the form of a simple salt, a composite salt or a complex salt at the time of preparation of grains.

The silver halide emulsion of the present invention is preferably subjected to chemical sensitization and known methods such as sulfur sensitization, selenium sensitization, tellurium sensitization, reduction sensitization and noble metal sensitization may be used individually or in combination. In using the methods in combination, for example, sulfur sensitization and gold sensitization, sulfur sensitization, selenium sensitization and gold sensitization, and sulfur sensitization, tellurium sensitization and gold sensitization are particularly preferred.

The sulfur sensitization for use in the present invention is conducted usually by adding a sulfur sensitizer and stirring the emulsion at a high temperature of 40° C. or higher for a fixed time. The sulfur sensitization may be a known compound and in addition to the sulfur compound contained in gelatin, various sulfur compounds such as thiosulfonate, thioureas, thiazoles and rhodanines may be used. Preferred sulfur compounds are a thiosulfate and a thiourea compound. The addition amount of the sulfur sensitizer varies according to various conditions such as the pH, the temperature and the grain size at chemical ripening, but it is preferably from $10^{-7}$ to $10^{-2}$, more preferably from $10^{-5}$ to $10^{-3}$ mol, per mol of silver halide.

The selenium sensitizer for use in the present invention may be a known selenium compound. More specifically, a labile and/or non-labile selenium compound is usually added and the emulsion is stirred at a high temperature, preferably 40° C. or higher, for a fixed time. The labile type selenium compound includes the compounds described in JP-B-44-15748, JP-B-43-13489 and Japanese Patent Application Nos. 2-130976, 2-229300 and 3-121798. In particular, the compounds represented by formulae (VIII) and (IX) of Japanese Patent Application No. 3-121798, KSeCN and NaSeCN are preferred.

The tellurium sensitizer for use in the present invention is a compound which forms a silver telluride assumed to serve as a sensitization speck on the surface or inside of a silver halide grain. The silver telluride formation rate in a silver halide emulsion may be examined according to the method described in JP-A-5-313284.

More specifically, the compounds described in U.S. Pat. Nos. 1,623,499, 3,320,069 and 3,772,031, British Patents 235,211, 1,121,496, 1,295,462 and 1,396,696, Canadian Patent 800,958, Japanese Patent Application Nos. 2-333819, 3-53693, 3-131598 and 4-129787, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai (compiler), *The Chemistry of Organic Selenium and Tellurium Compounds*, Vol. 1 (1986), ibid., Vol. 2 (1987) may be used. In particular, the compounds represented by formulae (II), (III) and (IV) of JP-A-5-313284 are preferred.

The addition amount of the selenium or tellurium sensitizer for use in the present invention may vary depending upon the silver halide grain used or chemical ripening conditions, but it is generally from $10^{-8}$ to $10^{-2}$ mol, preferably from $10^{-7}$ to $10^{-3}$ mol, per mol of silver halide. The conditions for chemical sensitization are not particularly restricted in the present invention, but the pH is from 5 to 8, the pAg is from 6 to 11, preferably from 7 to 10, and the temperature is from 40° to 95° C., preferably from 45° to 85° C.

As the noble metal sensitizer for use in the present invention, gold, platinum or palladium may be used, but the gold sensitization is particularly preferred. Specific examples of the gold sensitizer for use in the present invention include chloroauric acid, potassium chlorate, potassium auritin cyanate and gold sulfide, and the gold sensitizer may be used in an amount of approximately from $10^{-7}$ to $10^{-2}$ mol per mol of silver halide.

In the silver halide emulsion for use in the present invention, a cadmium salt, a sulfite, a lead salt or a thallium salt may be present together during the formation or physical ripening of silver halide grains.

In the present invention, a reduction sensitizer may be used. As the reduction sensitizer, a stannous salt, amines, a formamidinesulfinic acid or a silane compound may be used.

To the silver halide emulsion of the present invention, a thiosulfonic acid compound may be added by the method described in European Patent 293917.

In the light-sensitive material for use in the present invention, one kind of silver halide emulsion may be used or two kinds of silver halide emulsions (for example, those different in the average grain size, different in the halogen composition, different in the crystal habit or different in the chemical sensitization conditions) may be used in combination.

There is no particular limitation on the spectral sensitizing dye for use in the present invention.

The addition amount of the sensitizing dye for use in the present invention varies depending upon the shape or size of the silver halide grain but it is used in the range of from $4\times10^{-6}$ to $8\times10^{-3}$ mol per mol of silver halide. For example, in the case where the silver halide grain size is from 0.2 to 1.3 μm, the addition amount is preferably from $2\times10^{-7}$ to $3.5\times10^{-6}$ mol, more preferably from $6.5\times10^{-7}$ to $2.0\times10^{-6}$ mol, per $m^2$ of the surface area of silver halide grains.

The light-sensitive silver halide emulsion of the present invention may be spectrally sensitized to blue light, green light, red light or infrared light having a relatively long wavelength, by a sensitizing dye. The sensitizing dye which may be used includes a cyanine dye, a merocyanine dye, a complex cyanine dye, a complex merocyanine dye, a holopolar cyanine dye, a styryl dye, a hemicyanine dye, an oxonol dye and a hemioxonol dye.

The useful sensitizing dyes for use in the present invention are described, for example, in Research Disclosure, Item 17643 IV-A, page 23 (December, 1978), ibid., Item 1831X, page 437 (August, 1978) and publications cited therein.

In particular, sensitizing dyes having a spectral sensitivity suitable for spectral characteristics of various scanner light source may be advantageously selected.

For example,

A) for an argon laser light source, simple merocyanines described in JP-A-60-162247, JP-A-2-48653, U.S. Pat. No. 2,161,331, West German Patent 936,071 and JP-A-5-11389; B) for a helium-neon laser light source, three-nuclear cyanine dyes described in JP-A-50-62425, JP-A-54-18726 and JP-A-59-102229; C) for an LED light source or a red semiconductor laser, thiacarbocyanines described in JP-B-48-42172, JP-B-51-9609, JP-B-55-39818, JP-A-62-284343 and JP-A-2-105135; D) for an infrared semiconductor laser light source, tricarbocyanines described in JP-A-59-191032 and JP-A-60-80841 and dicarbocyanines having a 4-quinoline nucleus represented by formula (IIIa) and (IIIb) of JP-A-59-192242 and JP-A-3-67242, are advantageously selected.

These sensitizing dyes may be used individually or may be used in combination and a combination of sensitizing dyes are often used for the purpose of supersensitization. Together with the sensitizing dye, a dye which itself has no spectral sensitization action, or a material which absorbs substantially no visible light, but shows supersensitization, may be incorporated into the emulsion.

Useful sensitizing dyes, combinations of dyes for providing supersensitization and materials which show supersensitization are described in *Research Disclosure,* Vol. 176, 17643, page 23, Item IV-J (December, 1978).

For the argon laser light source, the dyes represented by the following formulae (OS-I) to (OS-IV) are particularly preferably incorporated into the silver halide emulsion layer.

(OS-I)

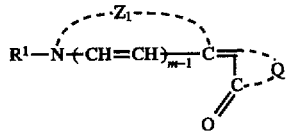

wherein $Z^1$ represents a nonmetallic atom group necessary for forming a 5- or 6-membered heterocyclic ring, Q represents a nonmetallic atom group necessary for forming a 5-membered nitrogen-containing heterocyclic ring, $R^1$ represents an alkyl group or a substituted alkyl group, and m represents 1 or 2;

(OS-II)

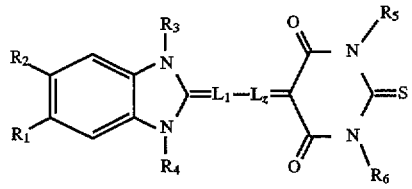

wherein $R_1$ and $R_2$ each represents a hydrogen atom, a halogen atom, an alkyl group, an alkoxy group, a sulfoalkyl group, a trifluoromethyl group, a cyano group, an aryl group, a carboxy group, an alkoxycarbonyl group, a sulfamoyl group, a sulfonamido group, a carbamoyl group, an amido group or an acyl group, $R_3$, $R_4$, $R_5$ and $R_6$ each represents a substituted or unsubstituted alkyl, alkenyl, aryl or heterocyclic group, which groups each may have a substituent at any position, and $L_1$ and $L_2$ each represents a methine carbon which may be substituted by an alkyl group, an alkoxy group, an aralkyl group or an aryl group;

(OS-III)

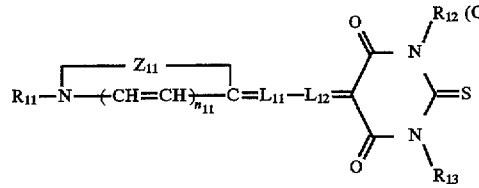

wherein $Z_{11}$ represents a nonmetallic atom group necessary for forming a 5- or 6-membered nitrogen-containing heterocyclic ring exclusive of an imidazole ring, $R_{11}$ has the same meaning as $R_3$ and —$R_4$, $R_{12}$ and $R_{13}$ each has the same meaning as $R_{51}$, $R_6$, $L_{11}$, and $L_{12}$ have the same meaning as $L_1$ and $L_2$, respectively, and $n_{11}$ represents 0 or 1;

(OS-IV)

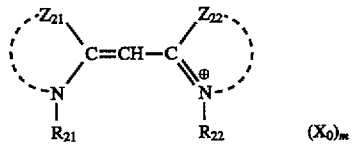

wherein $Z_{21}$ and $Z_{22}$ each represents a nonmetallic atom group necessary for forming a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus or a quinoline nucleus, $R_{21}$ and $R_{22}$ each represents an alkyl group or an aryl group, which may be substituted, and at least one of $R_{21}$ and $R_{22}$ has an acid group, $X_0$ represents a charge balance counter ion, and m represents 0 or 1.

The compound represented by formula (OS-I) is described below.

In formula (OS-I), $Z_1$ represents a nonmetallic atom group necessary for forming a 5- or 6-membered heterocyclic ring and examples of the heterocyclic ring include a thiazole ring, a selenazole ring, an oxazole ring, a benzothiazole ring, a benzoselenazole ring, a benzoxazole ring, a naphthothiazole ring, a naphthoselenazole ring, a naphthoxazole ring, a pyridine ring and a quinoline ring. These heterocyclic rings each may have a substituent and examples of the substituent include a halogen atom (e.g., chlorine, bromine), an alkyl group, preferably an alkyl group having from 1 to 4 carbon atoms (e.g., methyl, ethyl, n-propyl), an alkyl halide (e.g., trifluoromethyl), an alkoxy group, preferably an alkoxy group having from 1 to 4 carbon atoms (e.g., methoxy, ethoxy, n-propyloxy), a hydroxy group and an aryl group (e.g., phenyl).

Q represents a nonmetallic atom group necessary for forming a 5-membered heterocyclic ring. Examples of the heterocyclic ring include a rhodanine ring, a thiohydantoin ring, a thioxazolidinedione ring and a thioselenazolidindione ring. These heterocyclic ring each may have a substituent and preferred examples of the substituent include an alkyl group having from 1 to 4 carbon atoms (e.g., methyl, ethyl, n-propyl, 2-hydroxyethyl, 2-hydroxyethoxyethyl, 2-methoxyethyl, 2-acetoxyethyl, carboxymethyl, 2-carboxyethyl, 3-carboxypropyl, 4-carboxybutyl, 2-sulfoethyl, 3-sulfopropyl, 3-sulfobutyl, 4-sulfobutyl, benzyl, phenethyl, n-butyl), an aryl group (e.g., phenyl, p-sulfophenyl) and a pyridyl group (e.g., 2-pyridyl, 3-pyridyl, methyl-2-pyridyl).

$R_1$ represents an alkyl group or a substituted alkyl group, more specifically, an alkyl group having from 1 to 18, preferably from 1 to 7, more preferably from 1 to 4 carbon atoms (e.g., methyl, ethyl, propyl, isopropyl, butyl, isobutyl, hexyl, octyl, dodecyl, octadecyl) or a substituted alkyl (for example, an aralkyl group (e.g., benzyl, 2-phenylethyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfatoalkyl group (e.g., 3-sulfatopropyl, 4-sulfatobutyl), a heterocyclic substituted alkyl group (e.g., 2-pyrrolidin-2-one-1-yl)ethyl, tetrahydrofurfuryl), 2-acetoxyethyl, carbomethoxymethyl, 2-methanesulfonylaminoethyl) and an allyl group).

Specific examples of the compound represented by formula (OS-I) are set forth below, but the present invention is by no means limited to these.

OSI-1

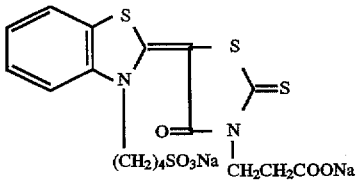

OSI-2

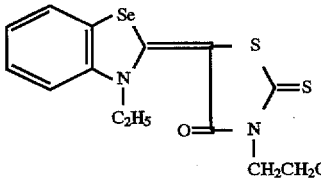

OSI-3

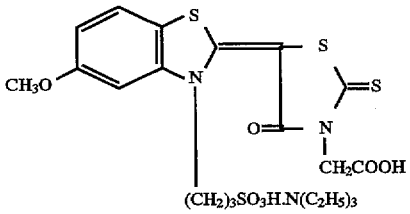

-continued

OSI-4

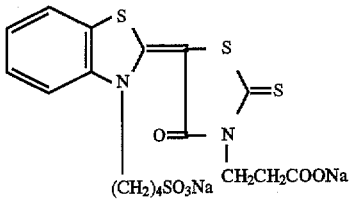

OSI-5

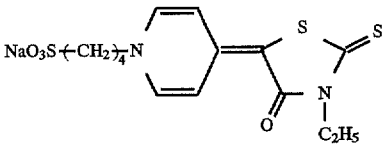

OSI-6

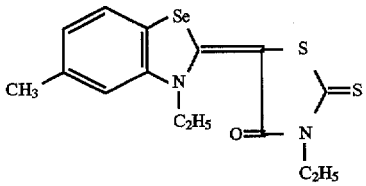

OSI-7

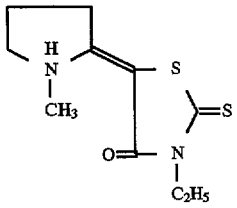

OSI-8

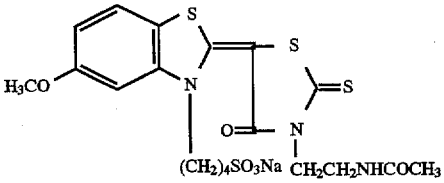

OSI-9

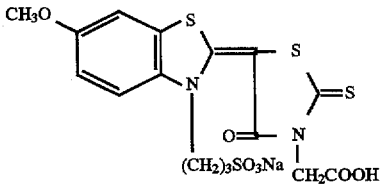

OSI-10

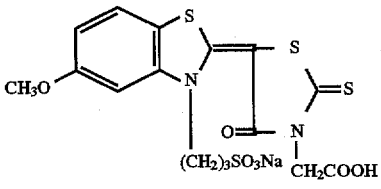

OSI-11

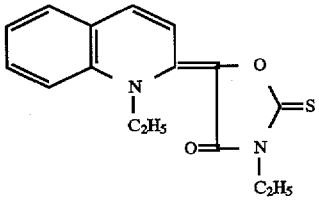

-continued

OSI-12

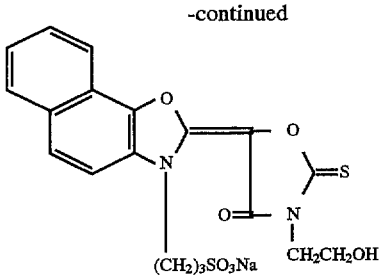

OSI-13

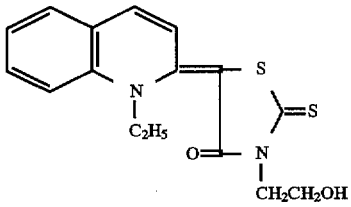

OSI-14

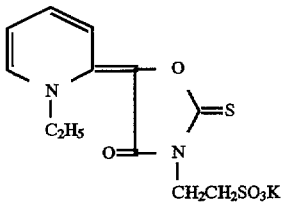

OSI-15

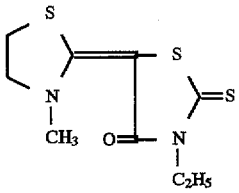

OSI-16

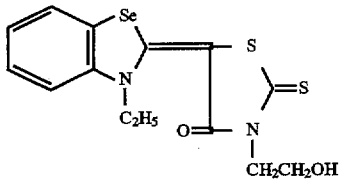

OSI-17

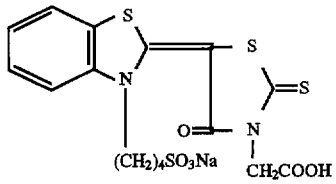

OSI-18

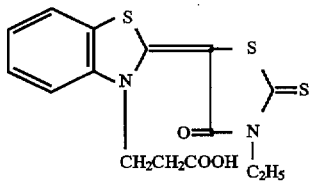

OSI-19

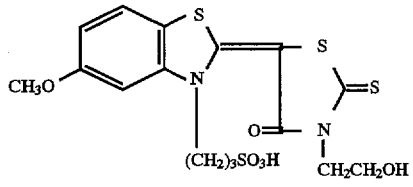

-continued

OSI-20

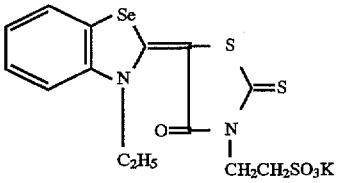

OSI-21

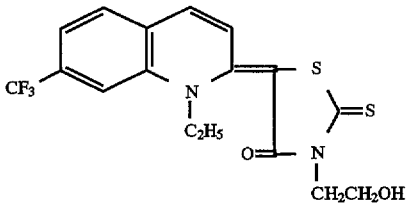

OSI-22

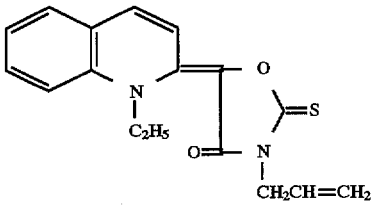

OSI-23

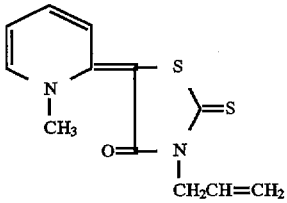

OSI-24

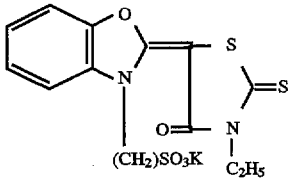

The effective addition amount of the compound represented by formula (OS-I) is generally from $1\times10^{-5}$ to $1\times10^{-2}$ mol per mol of silver.

The compounds represented by formulae (OS-II) and (OS-III) are described below.

In formulae (OS-II) and (OS-III), $R_1$ and $R_2$ each represents a hydrogen atom, a halogen atom (e.g., F, Br, Cl, I), an alkyl group having from 1 to 4 carbon atoms (e.g., methyl, ethyl), an alkoxy group (e.g., methoxy, ethoxy) a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a trifluoromethyl, a cyano group, an aryl group (e.g., phenyl, tolyl, chlorophenyl), a carboxy group, an alkoxycarbonyl group (e.g., ethoxycarbonyl, butoxycarbonyl), a sulfamoyl group (e.g., sulfamoyl, dimethylsulfamoyl), a sulfonamide group (e.g., methanesulfonamide, benzenesulfonamide), a carbamoyl group (e.g., carbamoyl, dimethylcarbamoyl, morpholinocarbamoyl), an amido group (e.g., acetylamino, benzoylamino) or an acyl group (e.g., acetyl, benzoyl).

$R_3$, $R_4$, $R_5$, $R_6$, $R_{11}$, $R_{12}$ and $R_{13}$ each represents an alkyl group having from 1 to 20 carbon atoms (e.g., methyl, ethyl, n-propyl, n-butyl, n-pentyl, n-hexyl, isopropyl, isobutyl, isopentyl, which groups each may be substituted [examples of the substituent include a halogen atom, a nitro group, an alkoxy group (e.g., methoxy, ethoxy), an aryloxy group (e.g., phenoxy), an amido group, an alkynyl group, an alkenyl group, a carbamoyl group, a sulfo group, a hydroxy group, a carboxy group, a sulfate group, an aryl group and a heterocyclic group (e.g., pyridyl, furyl, thienyl, imidazolyl); when the substituent is a sulfo group, the counter ion is an alkali metal or a quaternary ammonium compound and examples thereof include sodium, potassium, pyridium and triethylammonium; the above-described substituents may be present in plurality; and the substituent may be further substituted by these substituents, hereinafter referred to as a substituent group X]), an alkenyl group having from 1 to 20 carbon atoms (e.g., propenyl, which may be substituted by the substituent group X), an aryl group having from 1 to 20 carbon atoms (e.g., phenyl, 1-naphthyl, 2-naphthyl, which group each may be substituted by the substituent group X), or a heterocyclic group (e.g., pyridyl, furyl, thienyl, imidazolyl, which groups each may be substituted by the substituent group X).

Specific examples of the alkyl group which bonds to the methine carbon represented by $L_1$, $L_2$, $L_{11}$, or $L_{12}$ include a methyl group, an ethyl group, a propyl group and a butyl group, specific examples of the alkoxy group include a methoxy group and an ethoxy group, specific examples of the aralkyl group include a benzyl group and a phenethyl group, and specific examples of the aryl group include a phenyl group.

The 5- or 6-membered nitrogen-containing heterocyclic ring formed by $Z_{11}$ include, in addition to the monocyclic ring, a condensed ring and examples thereof include an oxazolidine rig, an oxazoline ring, a benzoxazoline ring, a naphthoxazoline ring, a thiazoline ring, a benzothiazoline ring, a naphthothiazoline ring, a benzoselenazoline ring, a naphthoselenazoline ring, a benzimidazoline ring, a naphthoimidazoline ring, a thiadiazoline ring and a benzotetrazoline ring, which rings each may have a substituent described for $R_1$ and $R_2$ at any position thereon.

Examples of the compounds represented by formulae (OS-II) and (OS-III) which are preferably used in the present invention, include the compounds represented by formulae [D-1] to [D-4] of JP-A-6-110147 and specific compounds D-1 to D-53 described therein.

Specific examples of the compounds represented by formulae (OS-II) and (OS-III) are set forth below, but the present invention is by no means limited to these.

OSII-1

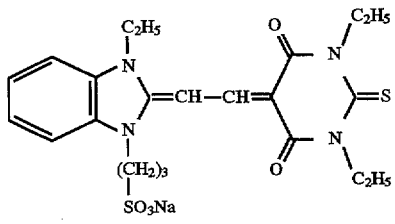

OSII-2

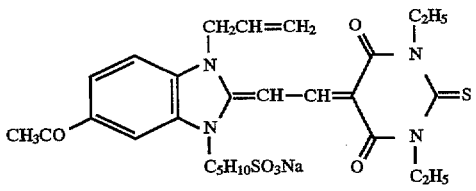

-continued

OSII-3

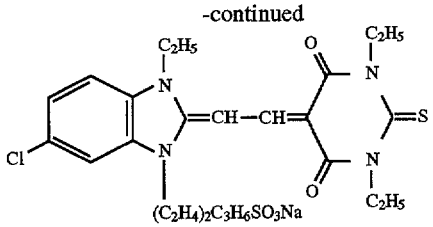

OSIII-1

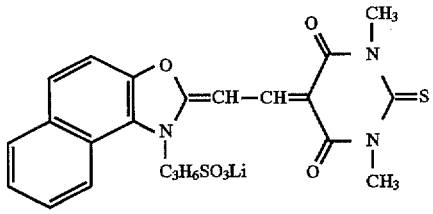

OSIII-2

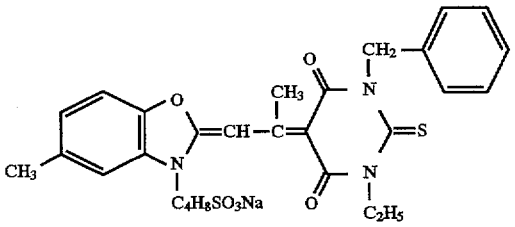

OSIII-3

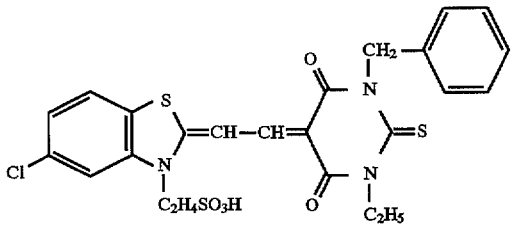

OSI-4

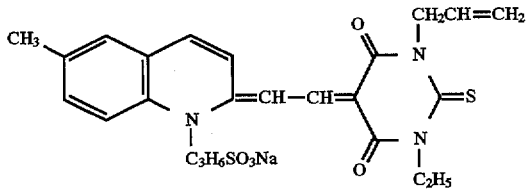

OSIII-5

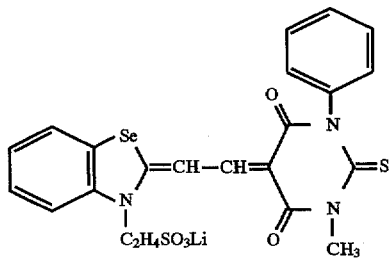

OSIII-6

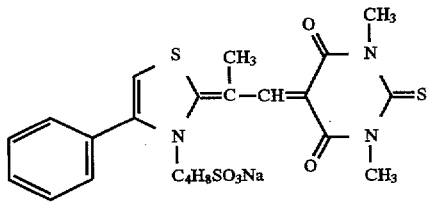

The addition amount of the compound represented by formula (OS-II) or (OS-III) is preferably from $1\times10^{-6}$ to $5\times10^{-2}$ mol, more preferably from $1\times10^{-5}$ to $5\times10^{-3}$ mol, per mol of silver halide.

The compound represented by formula (OS-IV) is described below in detail.

In formula (OS-IV), the heterocyclic ring formed by $Z_{21}$ or $Z_{22}$ is preferably a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus and a quinoline nucleus. In formula (OS-IV), the heterocyclic ring formed by $Z_{21}$ or $Z_{22}$ may be substituted by at least one substituent and examples of the substituent include a halogen atom (e.g., fluorine, chlorine, bromine, iodine), a nitro group, an alkyl group (preferably an alkyl group having from 1 to 4 carbon atoms, e.g., methyl, ethyl, trifluoromethyl, benzyl, phenethyl), an aryl group (e.g., phenyl), an alkoxy group (preferably an alkoxy group having from 1 to 4 carbon atoms, e.g., methoxy, ethoxy, propoxy, butoxy), a carboxyl group, an alkoxycarbonyl group (preferably an alkoxycarbonyl group having from 2 to 5 carbon atoms, e.g., ethoxycarbonyl), a hydroxy group and a cyano group). With respect to $Z_{21}$ and $Z_{22}$ in formula (OS-IV), examples of the benzothiazole nucleus include a benzothiazole nucleus, a 5-chlorobenzothiazole nucleus, a 5-nitrobenzothiazole nucleus, a 5-methylbenzothiazole nucleus, a 6-bromobenzothiazole nucleus, a 5-iodobenzothiazole nucleus, a 5-phenylbenzothiazole nucleus, a 5-methoxybenzothiazole nucleus, a 6-methoxybenzothiazole nucleus, a 5-carboxybenzothiazole nucleus, a 5-ethoxycarbonylbenzothiazole nucleus, a 5-fluorobenzothiazole nucleus, a 5-chloro-6-methylbenzothiazole nucleus and a 5-trifluoromethylbenzothiazole nucleus, examples of the naphthothiazole nucleus include a naphtho[2,1-d]thiazole nucleus, a naphtho[1,2-d]thiazole nucleus, a naphtho[2,3-d]thiazole nucleus, a 5-methoxynaphtho[1,2-d]thiazole nucleus and a 5-methoxynaphtho[2,3-d]thiazole nucleus, examples of the benzoselenazole nucleus include a benzoselenazole nucleus, a 5-chlorobenzoselenazole nucleus, a 5-methoxybenzoselenazole nucleus, a 5-hydroxybenzoselenazole nucleus and a 5-chloro-6-methylbenzoselenazole nucleus, examples of the naphthoselenazole nucleus include a naphtho[1,2-d]selenazole nucleus and a naphtho[2,1-d]selenazole nucleus, examples of the thiazole nucleus include a thiazole nucleus, a 4-methylthiazole nucleus, a 4-phenylthiazole nucleus and a 4,5-dimethylthiazole nucleus, and examples of the thiazoline nucleus include a thiazoline nucleus and a 4-methylthiazoline nucleus.

With respect to $Z_{21}$ and $Z_{22}$ in formula (OS-IV), examples of the benzoxazole nucleus include a benzoxazole nucleus, a 5-chlorobenzoxazole nucleus, a 5-methylbenzoxazole nucleus, a 5-bromobenzoxazole nucleus, a 5-fluorobenzoxazole nucleus, a 5-phenylbenzoxazole nucleus, a 5-methoxybenzoxazole nucleus, a 5-ethoxybenzoxazole nucleus, a 5-trifluorobenzoxazole nucleus, a 5-hydroxybenzoxazole nucleus, a 5-carboxybenzoxazole nucleus, a 6-methylbenzoxazole nucleus, a 6-chlorobenzoxazole nucleus, a 6-methoxybenzoxazole nucleus, a 6-hydroxybenzoxazole nucleus and a 5,6-dimethylbenzoxazole nucleus, examples of the naphthoxazole nucleus include a naphtho[2,1-d]oxazole nucleus, a naphtho[1,2-d]oxazole nucleus, a naphtho[2,3-d]oxazole nucleus and a 5-methoxynaphtho[1,2-d]oxazole nucleus.

Further, with respect to $Z_{21}$ and $Z_{22}$, examples of the oxazole nucleus include an oxazole nucleus, a 4-methyloxazole nucleus, a 4-phenyloxazole nucleus, a 4-methoxyoxazole nucleus, a 4,5-dimethyloxazole nucleus, a 5-phenyloxazole nucleus and a 4-methoxyoxazole nucleus, examples of the pyridine nucleus include a 2-pyridine nucleus, a 4-pyridine nucleus, a 5-methyl-2-pyridine nucleus, a 3-methyl-4-pyridine nucleus, examples of the quinoline nucleus include a 2-quinoline nucleus, a 4-quinoline nucleus, a 3-methyl-2-quinoline nucleus, a 5-ethyl-2-quinoline nucleus, a 8-fluoro-2-quinoline nucleus, a 6-methoxy-2-quinoline nucleus, a 8-chloro-4-quinoline nucleus and a 8-methyl-4-quinoline nucleus, and examples of the benzimidazole nucleus include a 5,6-dichloro-1-ethylbenzimidazole nucleus and a 6-chloro-1-ethyl-5-trifluoromethylbenzimidazole nucleus.

In formula (OS-IV), the alkyl group represented by $R_{21}$ or $R_{22}$ include an unsubstituted or substituted alkyl group and at least one of $R_{21}$ and $R_{22}$ has an acid group such as a sulfo group or a carboxy group. The unsubstituted alkyl group is an unsubstituted alkyl group having preferably 18 or less, more preferably 8 or less carbon atoms, and examples thereof include methyl, ethyl, n-propyl, n-butyl, n-hexyl and n-octadecyl. In the substituted alkyl group, the alkyl moiety has preferably 6 or less, more preferably 4 or less carbon atoms, and examples of the substituted alkyl group include an alkyl group substituted by a sulfo group (the sulfo group may be bonded through an alkoxy group or an aryl group, e.g., 2-sulfoethyl, 3-sulfopropyl, 3-sulfobutyl, 4-sulfobutyl, 2-(3-sulfopropoxy)ethyl, 2-[2-(3-sulfopropoxy)ethoxy]ethyl, 2-hydroxy-3-sulfopropyl, p-sulfophenethyl, p-sulfophenylpropyl), an alkyl group substituted by a carboxy group (the carboxy group may be bonded through an alkoxy group or an aryl group, e.g., carboxymethyl, 2-carboxyethyl, 3-carboxypropyl, 4-carboxybutyl), a hydroxyalkyl group (e.g., 2-hydroxyethyl, 3-hydroxypropyl), an acyloxyalkyl group (e.g., 2-acetoxyethyl, 3-acetoxypropyl), an alkoxyalkyl group (e.g., 2-methoxyethyl, 3-methoxypropyl), an alkoxycarbonylalkyl group (e.g., 2-methoxycarbonylethyl, 3-methoxycarbonylpropyl, 4-ethoxycarbonylbutyl), a vinyl group-substituted alkyl group (e.g., allyl), a cyanoalkyl group (e.g., 2-cyanoethyl), a carbamoylalkyl group (e.g., 2-carbamoylethyl), an aryloxyalkyl group (e.g., 2-phenoxyethyl, 3-phenoxypropyl) and an aralkyl group (e.g., 2-phenethyl, 3-phenylpropyl).

The charge balance counter ion $X_0$ is an anion freely selected to offset the positive charge generated by the quaternary ammonium salt in the heterocyclic ring, and examples thereof include a bromine ion, a chlorine ion, an iodine ion, a p-toluenesulfonate ion, an ethylsulfonate ion, a perchlorate ion, a trifluoromethanesulfonate ion and a thiocyanate ion. In this case, n is 1.

The charge balance counter ion $X_0$ may be a salt in the form of betaine when at least one of $R_{21}$ and $R_{22}$ contains an anion substituent such as a sulfoalkyl substituent, and in this case, the counter ion is not required and n is 0. When $R_{21}$ or $R_{22}$ has two anion substituents, for example, two sulfoalkyl groups, $X_0$ is a cationic counter ion and examples thereof include an alkali metal ion (sodium ion, potassium ion) and an ammonium salt (e.g., triethylammonium).

Examples of the compound represented by formula (OS-IV) which is preferably used in the present invention include the compounds represented by formula (IV) of JP-A-3-87733 and specific compounds IV-1 to IV-27 described therein. Specific examples of the compound represented by formula (OS-IV) are set forth below, but the present invention is by no means limited thereto.

OSIV-1
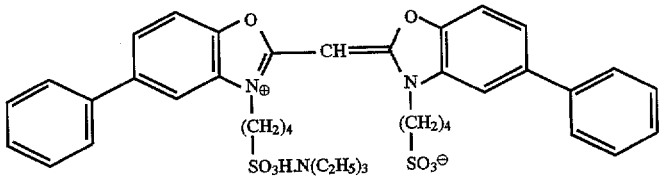
OSIV-2
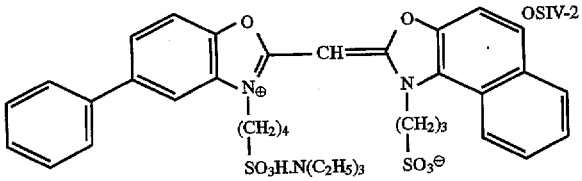
OSIV-3
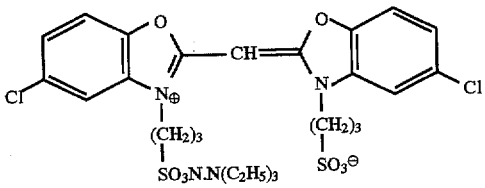
OSIV-4
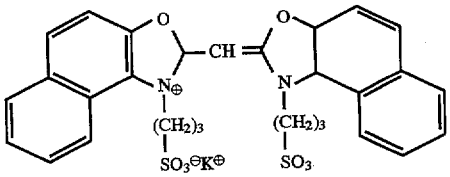
OSIV-5
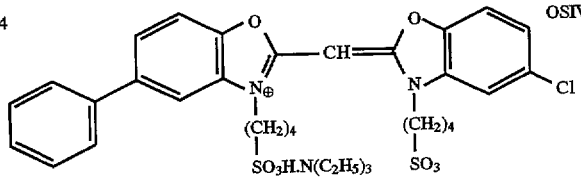
OSIV-6
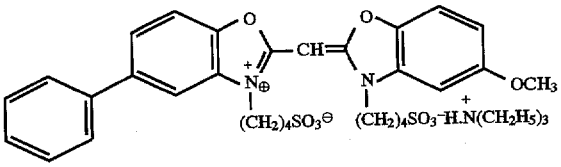
OSIV-7
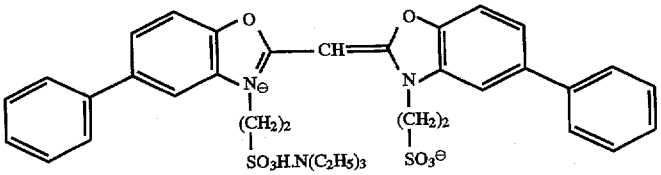
OSIV-8
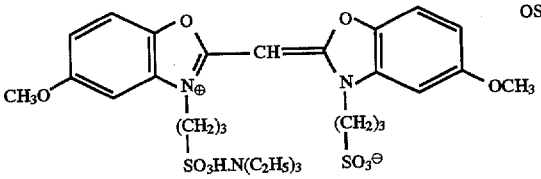
OSIV-9
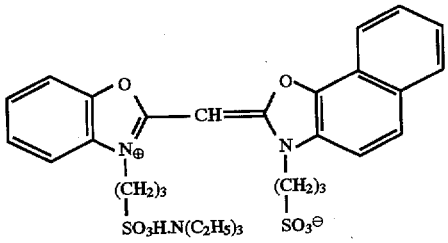
OSIV-10
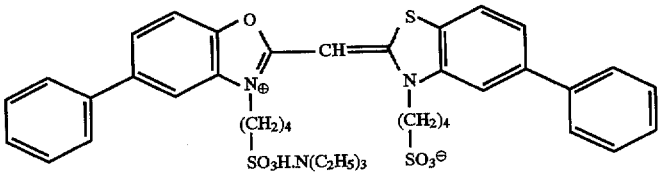
OSIV-11
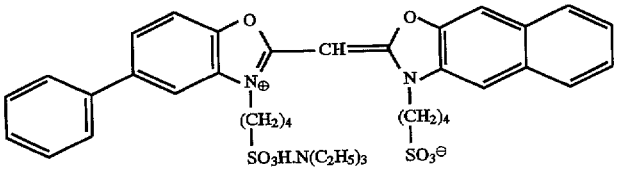
OSIV-12
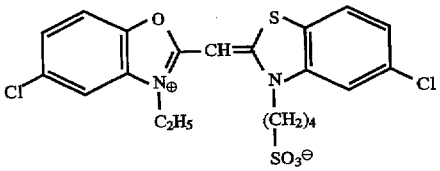
OSIV-13
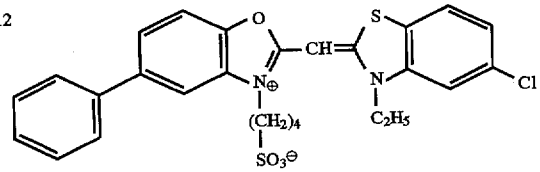

-continued
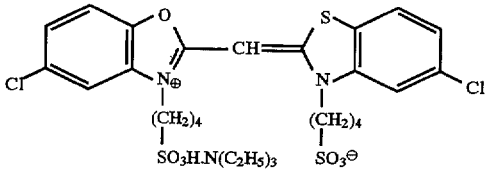
OSIV-14
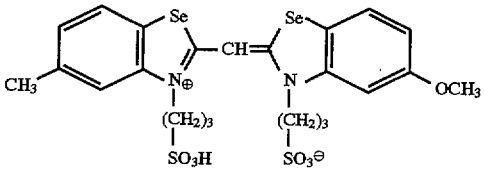
OSIV-15
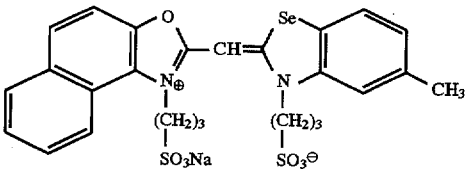
OSIV-16
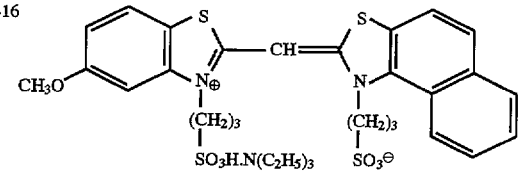
OSIV-17
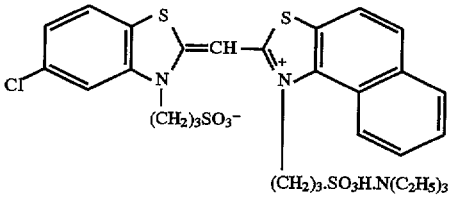
OSIV-18
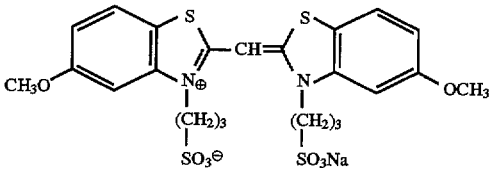
OSIV-19
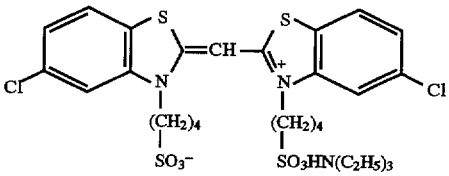
OSIV-20
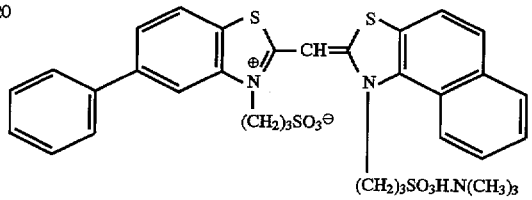
OSIV-21
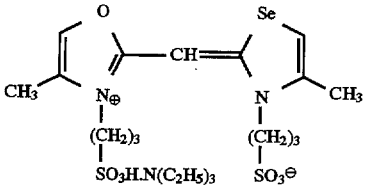
OSIV-22
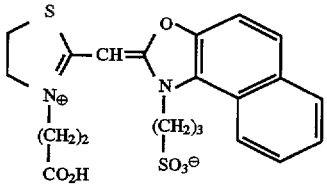
OSIV-23
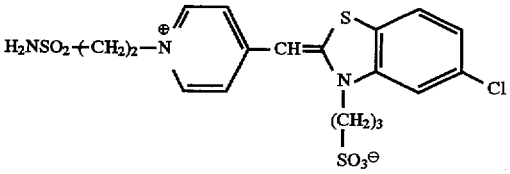
OSIV-24
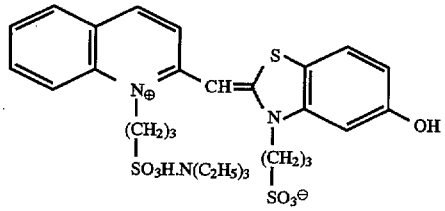
OSIV-25
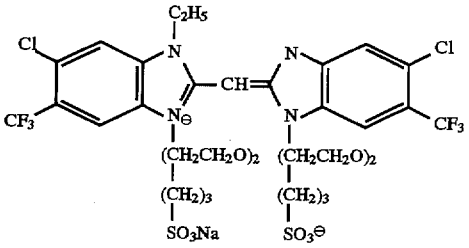
OSIV-26
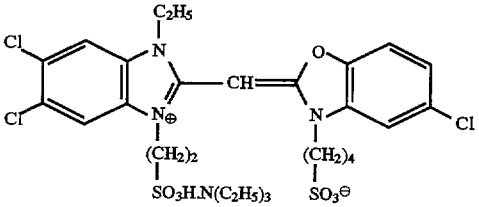
OSIV-27

-continued

OSIV-28

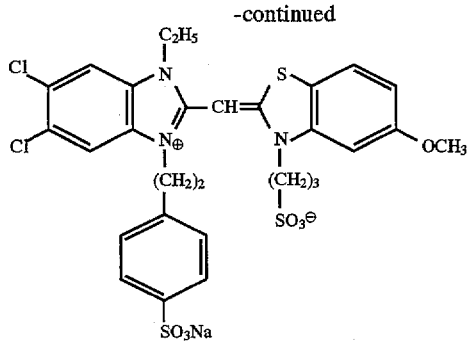

For the helium-neon light source, LED light source and red semiconductor laser, the dye represented by the following formula (OS-V), (OS-VI) or (OS-VII) is preferably incorporated into the silver halide emulsion layer.

(OS-V)

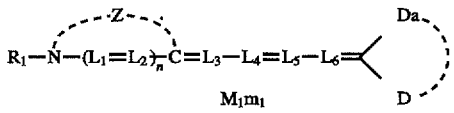

wherein $R_1$ represents an alkyl group, Z represents an atomic group necessary for forming a 5- or 6-membered nitrogen-containing heterocyclic ring, D and Da each represents an atomic group necessary for forming an acyclic or cyclic acidic nucleus, $L_1$, $L_2$, $L_3$, $L_4$, $L_5$ and $L_6$ each represents a methine group, $M_1$ represents a charge neutralizing counter ion, $m_1$ represents a number of 0 or greater necessary for neutralizing the charge in the molecule and n represents 0 or 1;

(OS-VI)

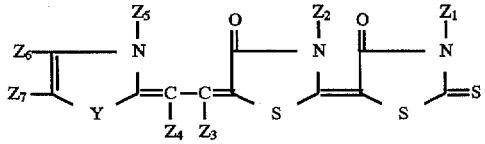

wherein Y represents —S— or —Se—, at least two of $Z_1$, $Z_2$, $Z_3$, $Z_4$ and $Z_5$ represent an organic group having a water-soluble group, $Z_1$ to $Z_5$ other than those representing the organic group having a water-soluble group each represents hydrogen, an alkyl group, a substituted alkyl group, an alkenyl group, a substituted alkenyl group, an aryl group or a substituted aryl group, $Z_6$ and $Z_7$, which may be the same or different, each represents a substituted or unsubstituted alkyl group, a substituted or unsubstituted alkenyl group, a substituted or unsubstituted alkynyl group, a substituted or unsubstituted alkoxy group, a substituted or unsubstituted alkylthio group, a substituted or unsubstituted arylthio group, a substituted or unsubstituted aryl group, a substituted or unsubstituted acyl group, a substituted or unsubstituted alkoxycarbonyl group, a substituted or unsubstituted alkylsulfonyl group, a substituted or unsubstituted carbamoyl group, a sulfamoyl group, a hydrogen atom, a hydroxy group, a halogen atom, a carboxy group or a cyano group, $Z_6$ and $Z_7$ may be combined to accomplish a carbocyclic ring system, and the ring system may have one or more, the same or different, substituents selected from the groups described above for $Z_6$ and $Z_7$;

(OS-VII)

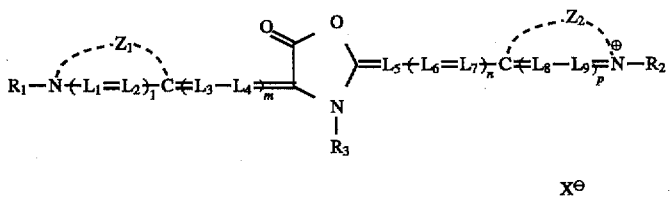

wherein $Z_1$ and $Z_2$ each represents an atomic group necessary for forming a 5- or 6-membered nitrogen-containing heterocyclic ring, $R_1$ and $R_2$ each represents an alkyl group, an alkenyl group, an aralkyl group or an aryl group, $R_3$ represents a group defined for $R_1$ or $R_2$, a substituted amino group, an amido group, an imino group, an alkoxy group or a heterocyclic ring, $L_1$ to $L_9$ each represents a methine group, m and n each represents 0, 1 or 2, p represents 0 or 1 and x represents a counter ion.

Formula (OS-V) is described below in detail.

$R_1$ is preferably an alkyl group having 8 or less carbon atoms, a substituted alkyl group (examples of the substituent include a carboxy group, a sulfo group, a cyano group, a halogen atom), a hydroxy group, an alkoxycarbonyl group, an alkanesulfonylaminocarbonyl group, an alkoxy group, an alkylthio group, an arylthio group, an aryloxy group, an acyloxy group, an acylthio group, an acyl group, a carbamoyl group, a sulfamoyl group or an aryl group, more preferably an unsubstituted alkyl group, a carboxyalkyl group, a sulfoalkyl group or a methanesulfonylcarbamoylmethyl group.

The nucleus formed by Z includes a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, a tellurazole nucleus, a benzotellurazole nucleus, a naphthotellurazole nucleus, a tellurazoline nucleus, a 3,3-dialkylindolenine nucleus, an imidazole nucleus, a benzimidazole nucleus, a naphthoimidazole nucleus, a pyridine nucleus, a quinoline nucleus, an isoquinoline nucleus, an imidazo[4,5-b]quinoxaline nucleus, an oxadiazole nucleus, a thiadiazole nucleus, a tetrazole nucleus and a pyrimidine nucleus, and among these, preferred are a benzothiazole nucleus, a naphthothiazole nucleus, a benzoxazole nucleus, a naphthoxazole nucleus, a 2-quinoline nucleus and a 4-quinoline nucleus.

D and Da each represents an atomic group necessary for forming an acidic nucleus and the acidic nucleus may be in the form of an acidic nucleus of any general merocyanine dye. The term "acidic nucleus" as used herein has the meaning defined, for example, in James (compiler), *The Theory of the Photographic Process,* 4th ed., Macmillan, page 198 (1977). In a preferred form, examples of the substituent participating in the resonance of D include a carbonyl group, a cyano group, a sulfonyl group and a sulfenyl group. D' represents the remaining atomic group necessary for forming the acidic nucleus.

Specific examples thereof include those described in U.S. Pat. Nos. 3,567,719, 3,575,869, 3,804,634, 3,837,862, 4,002,480 and 4,925,777 and JP-A-3-167546.

Preferred are 2-thiohydantoin, 2-oxazolin-5-one and a rhodanine nucleus.

$L_1$, $L_2$, $L_3$, $L_4$, $L_5$ and $L_6$ each represents a methine group or a substituted methine group (e.g., a methine group substituted by a substituted or unsubstituted alkyl group, a substituted or unsubstituted aryl group, a heterocyclic group, a halogen atom, an alkoxy group, an amino group or an alkylthio group), each may form a ring together with other methine group, or each may form a ring together with an auxochrome.

$M_1m_1$ is included in the formula for showing the presence or absence of a cation or an anion when it is required to neutralize the ion charge of the dye.

The compound represented by formula (OS-V) is more preferably a compound represented by the following formula (OS-V-a):

(OS-V-a)

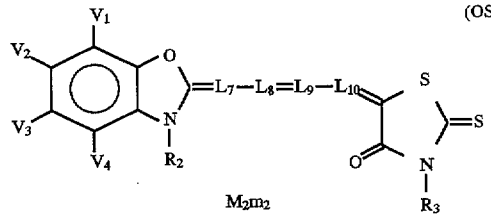

wherein $R_2$ and $R_3$ each represents an alkyl group having a group capable of imparting water-soluble property to the compound, $V_1$, $V_2$, $V_3$ and $V_4$ each represents a hydrogen atom or a monovalent substituent, provided that the substituents ($V_1$, $V_2$, $V_3$ and $V_4$) do not form a ring together and the total molecular weight of the substituents is 100 or less, $L_7$, $L_8$, $L_9$ and $L_{10}$ each represents a methine group, M represents a charge neutralizing counter ion and m represents a number of 0 or greater necessary for neutralizing the charge in the molecule.

Representative examples of the compounds represented by formulae (OS-V) and (OS-V-a) of the present invention are set forth below, but the present invention is by no means limited thereto.

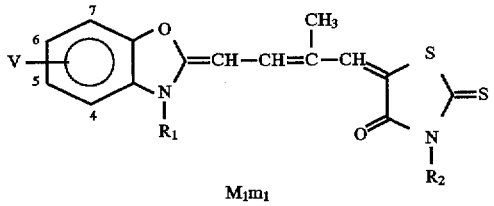

$M_1m_1$

| Compound No. | $R_1$ | $R_2$ | V | $M_1$ | $m_1$ |
|---|---|---|---|---|---|
| OSV-1 | $(CH_2)_2SO_3^-$ | $CH_2CO_2^-$ | H | $NA^+$ | 2 |
| OSV-2 | " | " | " | $K^+$ | " |
| OSV-3 | " | " | " | $(C_2H_5)_3\overset{+}{N}H$ | " |
| OSV-4 | $(CH_2)_4SO_3^-$ | " | " | " | " |
| OSV-5 | $(CH_2)_3SO_3^-$ | " | " | " | " |
| OSV-6 | $(CH_2)_2CH(CH_3)SO_3^-$ | " | " | " | " |
| OSV-7 | $(CH_2)_4SO_3^-$ | " | 5-$OCH_3$ | " | " |
| OSV-8 | " | " | 5-F | $Na^+$ | " |
| OSV-9 | $(CH_2)_2SO_3^-$ | " | 5-$CH_3$ | " | " |
| OSV-10 | " | " | 5,6-$(CH_3)_2$ | " | " |
| OSV-11 | $(CH_2)_4SO_3^-$ | $(CH_2)_2SO_3^-$ | H | $K^+$ | " |
| OSV-12 | $CH_2CO_2^-$ | $CH_2CO_2^-$ | " | $Na^+$ | " |
| OSV-13 | $CH_2CO_2^-$ | $(CH_2)_2SO_3^-$ | " | " | " |
| OSV-14 | $(CH_2)_3CO_3^-$ | " | " | " | " |
| OSV-15 | $(CH_2)_4SO_3^-$ | $(CH_2)_2OH$ | " | $K^+$ | 1 |
| OSV-16 | " | $(CH_2)_2CO_2^-$ | " | " | 2 |
| OSV-17 | " | $(CH_2)_3CO_2^-$ | " | " | " |
| OSV-18 | " | $(CH_2)_5CO_2^-$ | " | " | " |

-continued
| | | | | | |
|---|---|---|---|---|---|
| OSV-19 | " | O<br>‖<br>$(CH_2)_2NHCCH_3$ | " | " | 1 |
OSV-20
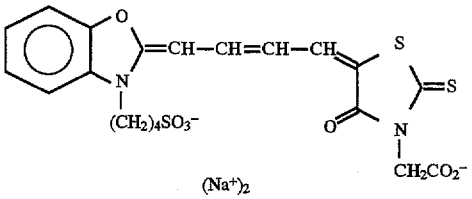
OSV-21
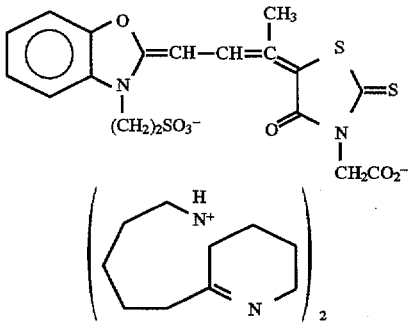
OSV-22
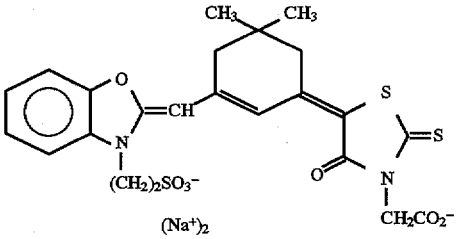
OSV-23
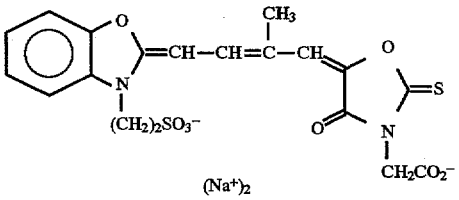
OSV-24
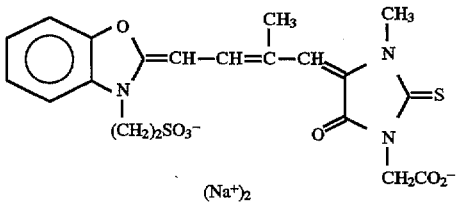
OSV-25
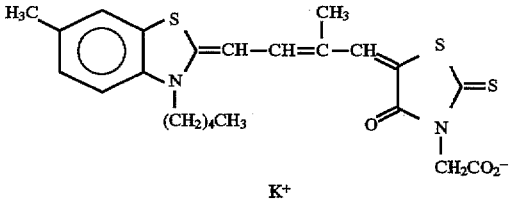

-continued
OSV-26
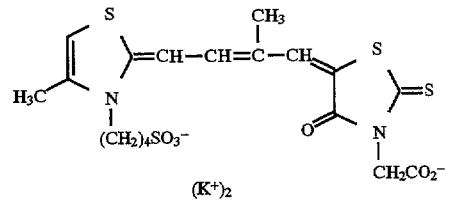
OSV-27
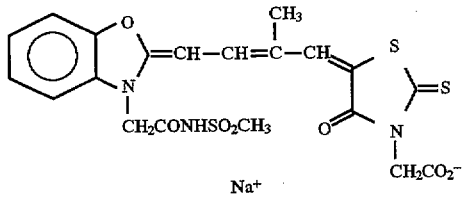
OSV-28
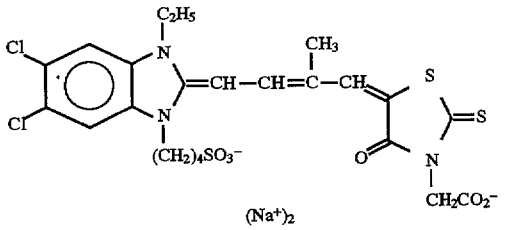
OSV-29
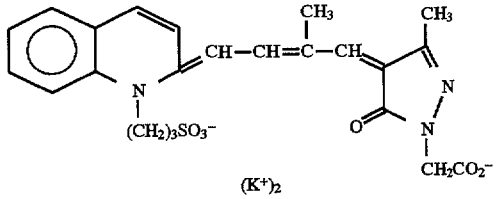
OSV-30
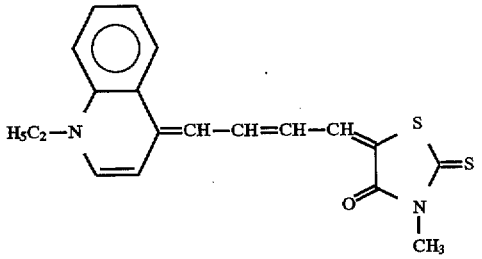
OSV-31
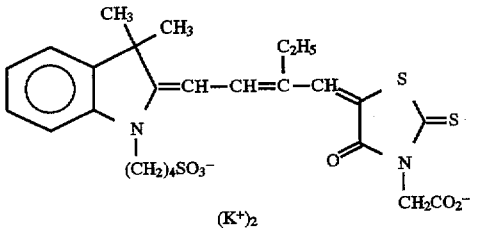
OSV-32
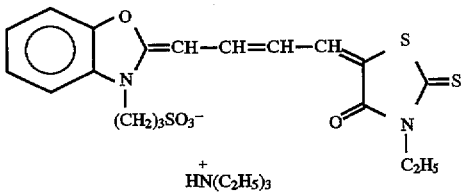

-continued

OSV-33

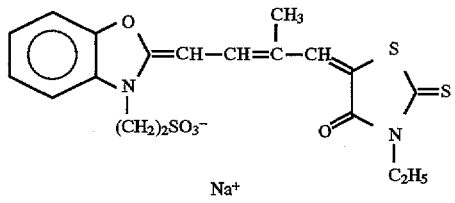

OSV-34

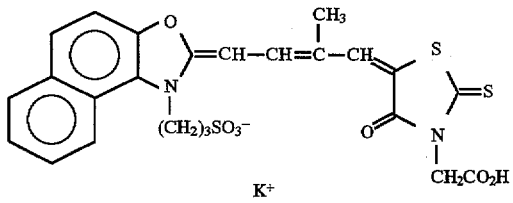

Formula (OS-VI) is described below.

The "water-soluble group" used in formula (OS-VI) indicates a group having a negative $\pi$ value according to the Hansch rule used for showing the relation between the structure of a compound and its physiological activity, so-called structure-activity interrelation. The Hansch rule is described in detail in *J. Med. Chem.*, 16, 1207 (1973) and ibid., 20, 304 (1979).

The number of water-soluble groups in the sensitizing dye used in the present invention is preferably 2 or 3.

Examples of the organic group having a water-soluble group are described below, but the present invention is by no means limited thereto, namely, $-(CH_2)_n-COOM$, $-C_2H_4-COOM$, $-CH_2-C_2H_4-COOM$, $(CH_2)_n-SO_3M$, $-C_2H_4-SO_3M$, $-CH_2-C_2H_4-SO_3M$, $-CH_2-COO-CH_2-COO-R_8$ and $-CH_2-COO-CH_2-COO-R_8$, wherein n represents an integer of from 1 to 4, M represents hydrogen, ammonium, an alkali metal atom or an organic amine salt, and $R_8$ represents an alkyl group.

The groups $Z_1$ to $Z_5$ other than those representing the organic group having a water-soluble group each is selected from hydrogen, an alkyl group such as methyl and ethyl, a substituted alkyl group, an alkenyl group such as aryl, a substituted alkenyl group, an aryl group such as phenyl, and a substituted aryl group such as p-tolyl.

In formula (OS-VI), $Z_6$ and $Z_7$, which may be the same or different, each represents hydrogen, a hydroxy group, a halogen atom, an alkyl group such as methyl, ethyl or propyl, a substituted alkyl group such as trifluoromethyl or 2,2,2-trifluoroethyl, an alkenyl group such as allyl, a substituted alkenyl group, an alkoxy group such as methoxy or ethoxy, an alkylthio group such as ethylthio, a substituted alkylthio group, an arylthio group such as phenylthio, a substituted arylthio group, an aryl group such as phenyl, a substituted aryl group such as p-tolyl, an acyl group such as acetyl or propionyl, an acyloxy group such as acetoxy or propionyloxy, an alkoxycarbonyl group such as methoxycarbonyl, an alkylsulfonyl group such as methylsulfonyl, a carbamoyl group, a substituted carbamoyl group, a sulfamoyl group, a substituted sulfamoyl group, a carboxy group or a cyano group. Or, $Z_7$ and $Z_8$, which may be the same or different, each represents an atom necessary for accomplishing a carbocyclic ring system together, such as a benzene or naphthalene ring system, and the ring system may have one or more substituent selected from the groups described above for $Z_6$ and $Z_7$.

Specific examples of the compound are set forth below, but the present invention is by no means limited thereto.

OSVI-1

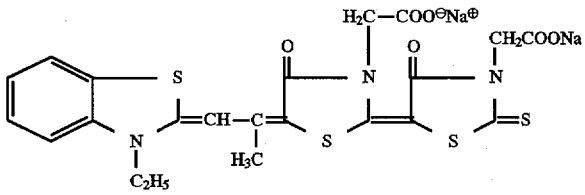

OSVI-2

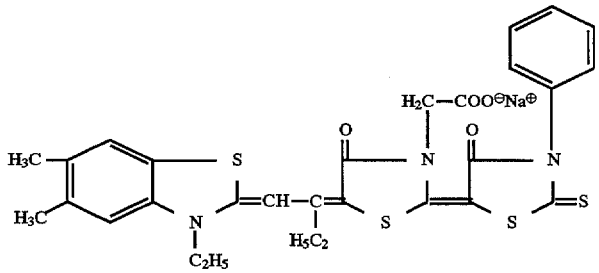

-continued

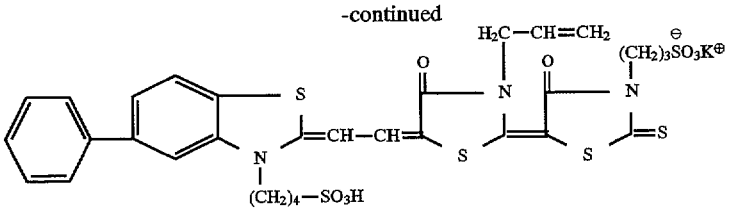

OSVI-3

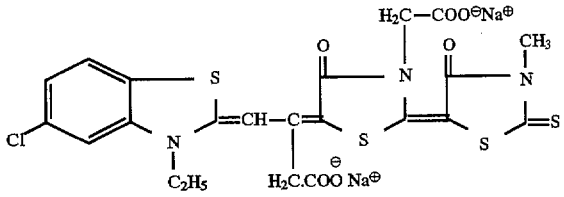

OSVI-4

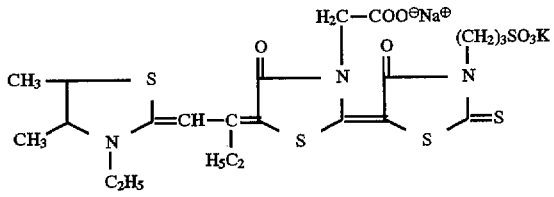

OSVI-5

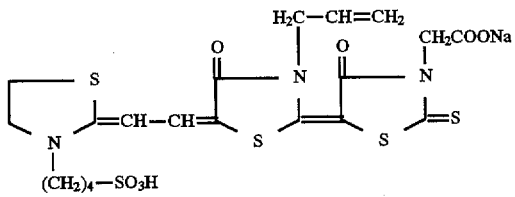

OSVI-6

Formula (OS-VII) is described below in detail.

In formula (OS-VII), $Z_1$ and $Z_2$ each represents an atomic group necessary for accomplishing a heterocyclic ring, $R_1$ and $R_2$ each represents an alkyl group, an alkenyl group, an aralkyl group or an aryl group, $R_3$ represents a group defined for $R_1$ or $R_2$, a substituted amino group, an amido group, an imino group, an alkoxy group or a heterocyclic group, $L_1$ to $L_9$ each represents a methine group, m and n each represents 0, 1 or 2, l and p each represents 0 or 1, and X represents a counter ion.

Examples of the heterocyclic ring formed by $Z_1$ or $Z_2$ in formula (OS-VII) include an oxazoline ring, an oxazole ring, a benzoxazole ring, a benzoisoxazole ring, a naphthoxazole ring, a thiazoline ring, a thiazole ring, a benzothiazole ring, a naphthothiazole ring, a selenazoline ring, a selenazole ring, a benzoselenazole ring, a naphthoselenazole ring, a tellurazole ring, a benzotellurazole ring, a pyrimidine ring, a quinoline ring, a benzoquinoline ring, an indolenine ring, a benzoindolenine ring, a benzimidazole ring and a pyrroline ring.

These heterocyclic rings each may be substituted by a known substituent and examples of the substituent include alkyl, alkoxy, aryl, hydroxy, carboxy, alkoxycarbonyl and halogen.

The alkyl group represented by $R_1$, $R_2$ or $R_3$ in formula (OS-VII) is preferably a linear, branched or cyclic alkyl group having from 1 to 6 carbon atoms. The alkyl group may have a substituent and examples thereof include methyl, ethyl, isopropyl, cyclohexyl, allyl, trifluoromethyl, β-hydroxyethyl, acetoxymethyl, carboxymethyl, ethoxycarbonylmethyl, β-methoxyethyl, γ-methoxypropyl, β-benzoyloxyethyl, γ-sulfopropyl and δ-sulfobutyl.

Examples of the alkenyl group include an allyl group, examples of the aralkyl group include benzyl, phenethyl and sulfobenzyl, and examples of the aryl group include phenyl, tolyl, chlorophenyl and sulfophenyl.

Among the groups represented by $R_3$, examples of the group bonding to the nitrogen atom or the oxygen atom include alkyl, alkenyl, aralkyl, aryl, acyl, alkylsulfonyl and a heterocyclic ring, which may be bonded through a double bond or may form a ring. More specifically, in this case, $R_3$ is dimethylamino, diethylamino, N-methylanilino, 1-piperidino, 1-morpholino, N-methyl-2-pyridinoamino, benzylideneimino, dibenzylamino, N-acetylmethylamino, benzylamino, acetamino, N-methylsulfonylamino, N-methylureido or 3-methylbenzo-thiazolideneimino. Examples of the alkoxy group include methoxy and ethoxy.

The counter ion represented by X is an anion usually used in the cyanine dye and examples thereof include a chlorine ion, a bromine ion, an iodine ion, a thiocyanate ion, a sulfate ion, a perchlorate ion, a p-toluenesulfonate ion, a tetrafluoroborate ion, a methyl sulfate ion and an ethyl sulfate ion. When an inner salt is formed, X is not present, and when two acidic groups (e.g., sulfo, sulfate, carboxyl) are present in the molecule, X represents a cation such as an alkali metal atom or an organic ammonium.

$L_1$ to $L_9$ each represents a methine group which may be substituted by alkyl, aryl or alkoxy.

Specific examples of the compound represented by formula (OS-VII) of the present invention are set forth below, but the present invention is by no means limited thereto.

OSVII-1
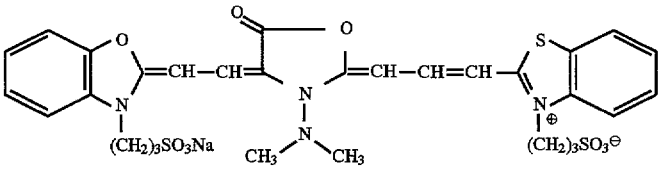
OSVII-2
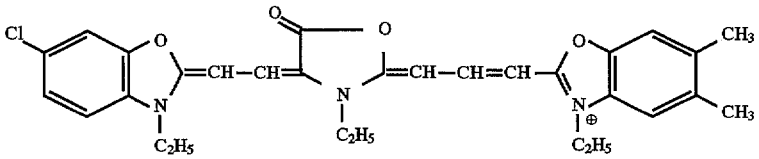
OSVII-3
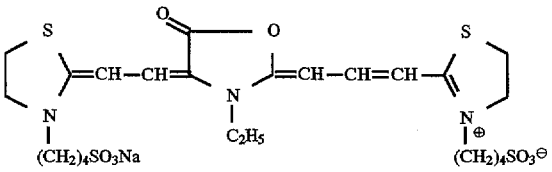
OSVII-4
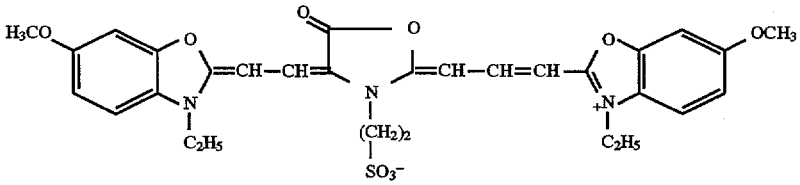
OSVII-5
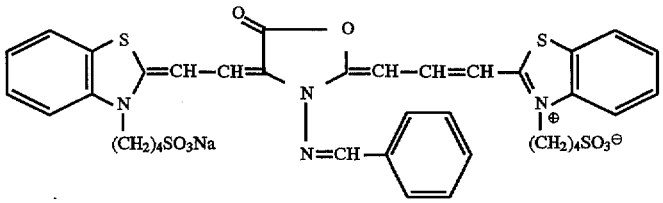
OSVII-6
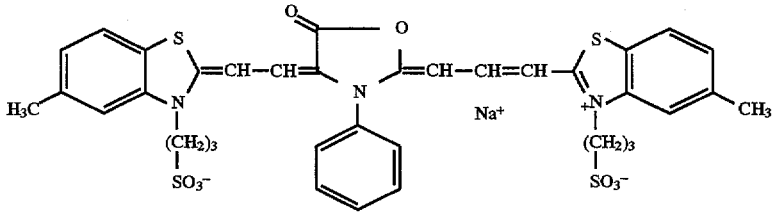
OSVII-7
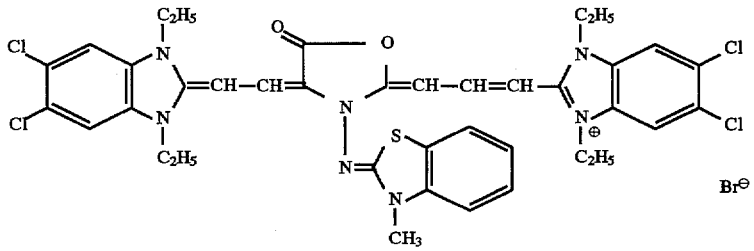
OSVII-8
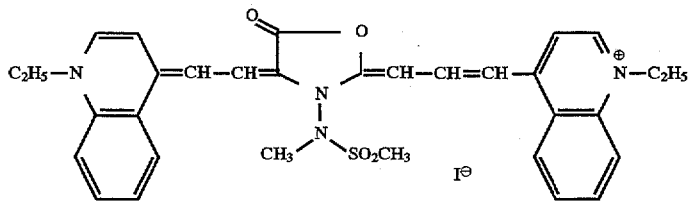

-continued
OSVII-9
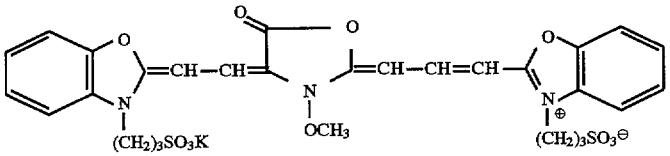
For the infrared semiconductor laser light source, the following-dyes are particularly preferably used.
S4-1
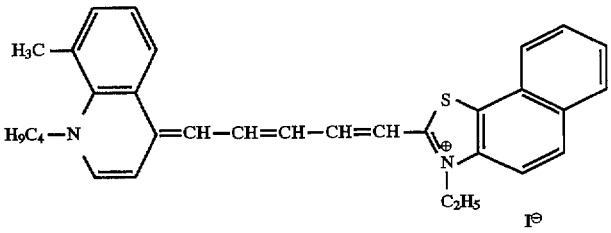
S4-2
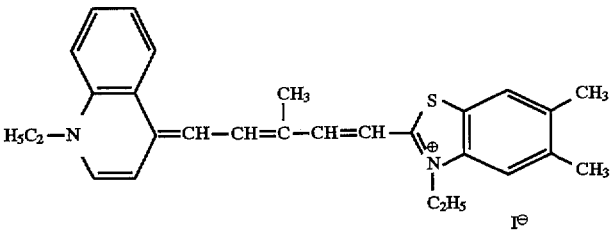
S4-3
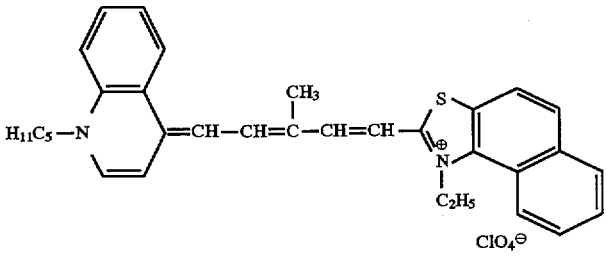
S4-4
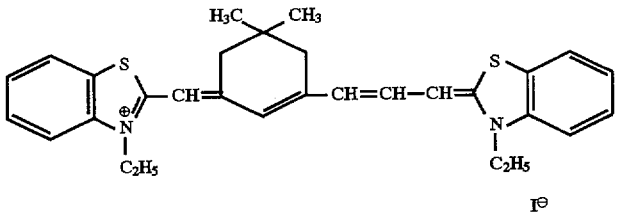
S4-5
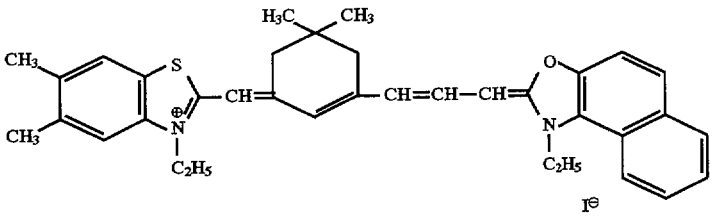
S4-6
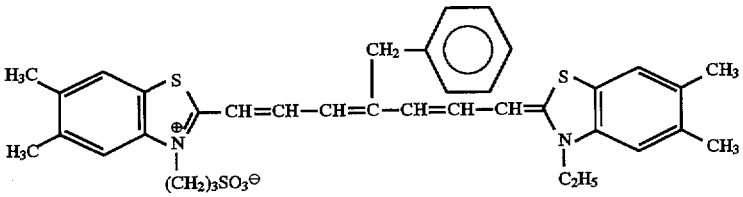

-continued
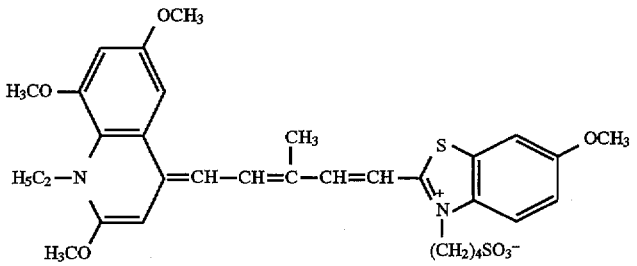
S4-7
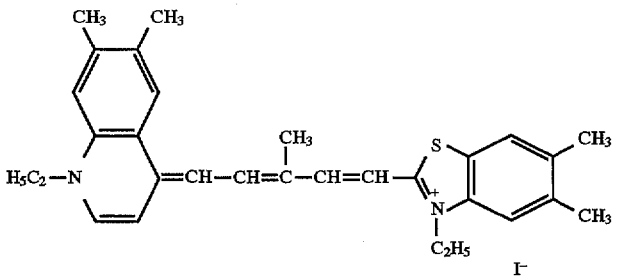
S4-8
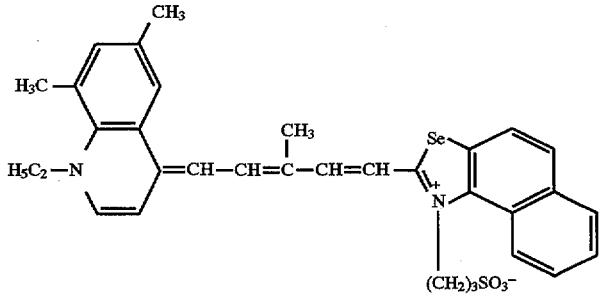
S4-9
For the white light source used in camera photographing, the sensitizing dyes represented by formula (IV) of JP-A-7-36139 (from page 20, line 14 to page 22, line 23) are preferably used. Specific examples of the compound are set forth below.
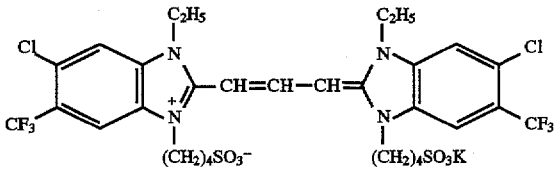
S5-1
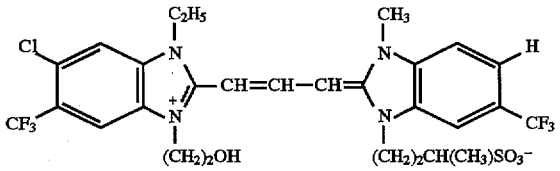
S5-2
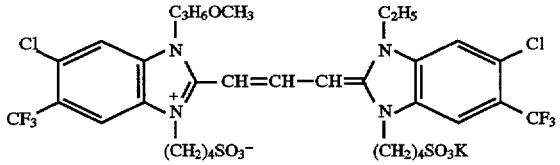
S5-3

-continued
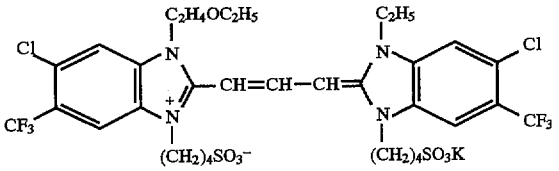
S5-4
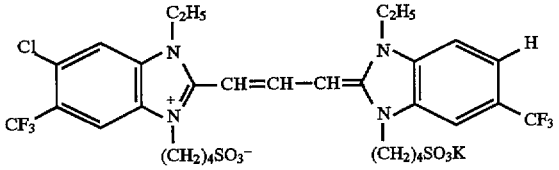
S5-5
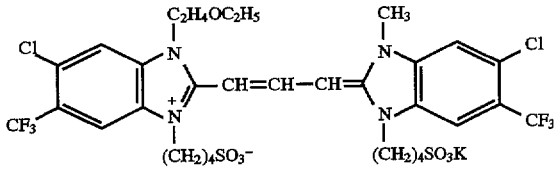
S5-6
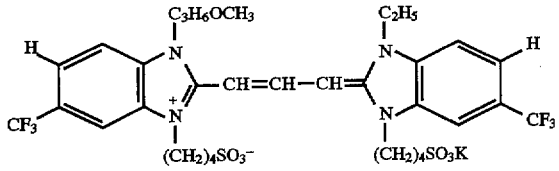
S5-7
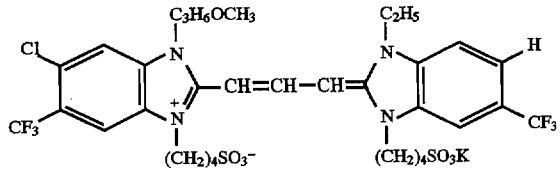
S5-8
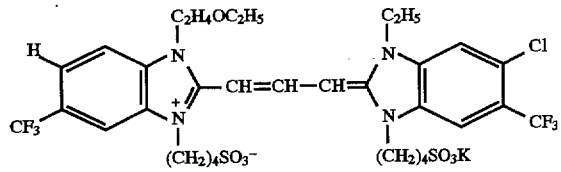
S5-9
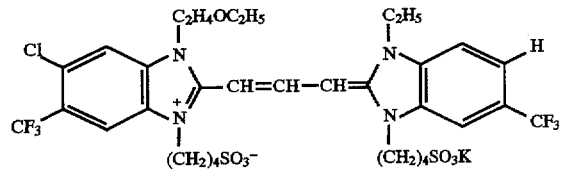
S5-10
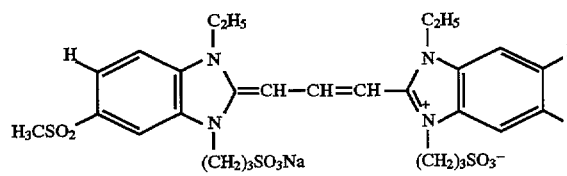
S5-11
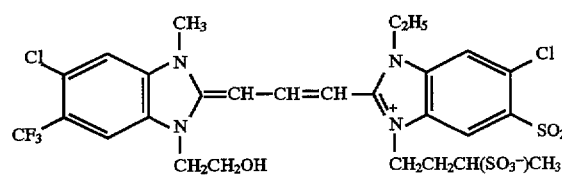
S5-12

-continued

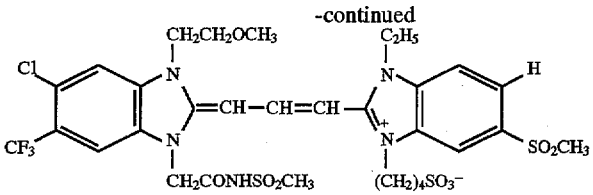

S5-13

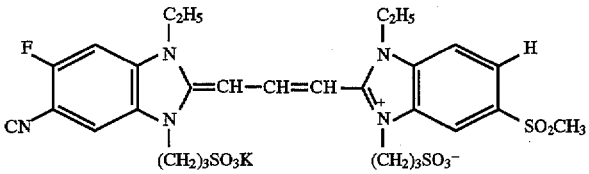

S5-14

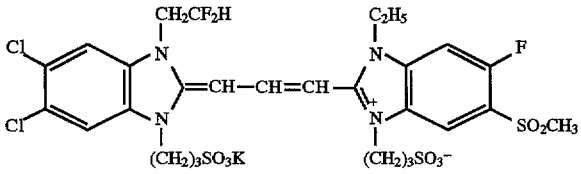

S5-15

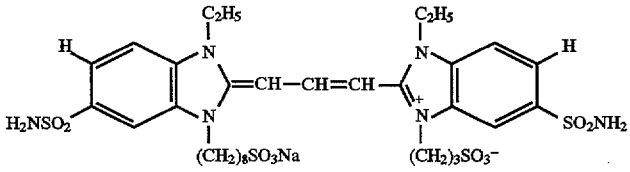

S5-16

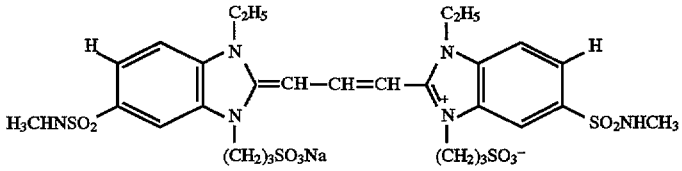

S5-17

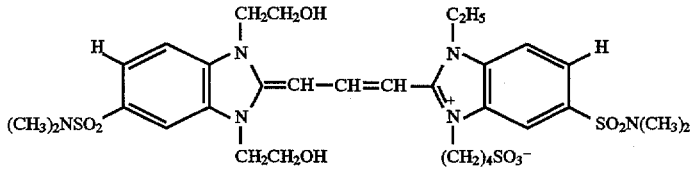

S5-18

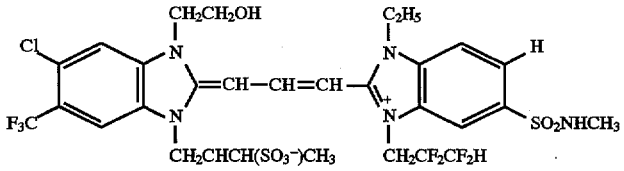

S5-19

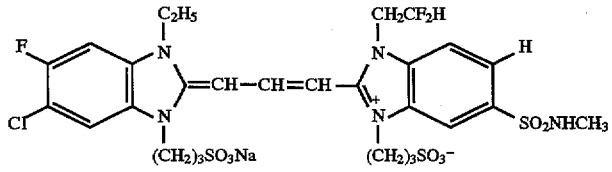

S5-20

The silver halide light-sensitive material of the present invention is generally developed with a developer containing a dihydroxybenzene-base developing agent and an auxiliary developing agent capable of showing super-additivity thereto and having a pH of from 9.5 to 12.0.

In the development processing, a normal automatic processer may be used. The developer charged in the development processing tank at the initiation of development is called a development initiation solution (mother solution) and the developer replenished to the development processing tank upon continuous development is called a development replenisher. In the present invention, it is preferred that both of the development initiation solution and the development replenisher contain a hydroxybenzene-base developing agent or a reductone-base developing agent and an auxiliary developing agent capable of showing super-additivity.

Examples of the dihydroxybenzene-base developing agent for use in the present invention include hydroquinone, chlorohydroquinone, isopropylhydroquinone, methylhydroquinone and hydroquinone monosulfonate, and among these, hydroquinone is preferred.

Examples of the auxiliary developing agent capable of showing super-additivity to the dihydroxybenzene-base developing agent include 1-phenyl-3-pyrazolidones and p-aminophenols. Accordingly, in the present invention, a combination of a dihydroxybenzene-base developing agent with a 1-phenyl-3-pyrazolidone or a combination of a dihydroxybenzene-base developing agent and a p-aminophenol is preferably used.

Examples of the 1-phenyl-3-pyrazolidone developing agent or a derivative thereof for use in the present invention include 1-phenyl-3-pyrazolidone, 1-phenyl-4,4-dimethyl-3-pyrazolidone and 1-phenyl-4-methyl-4-hydroxymethyl-3-pyrazolidone.

Examples of the p-aminophenol-base developing agent for use in the present invention include N-methyl-p-aminophenol, p-aminophenol, N-(β-hydroxyethyl)-p-aminophenol and N-(4-hydroxyphenyl)glycine, and among these, N-methyl-p-aminophenol is preferred.

The dihydroxybenzene-base developing agent is usually used in an amount of preferably from 0.05 to 0.8 mol/l, but in the present invention, it is preferably used in an amount of 0.23 mol/l or more, more preferably from 0.23 to 0.6 mol/l.

In the case when a combination of a dihydroxybenzene and a 1-phenyl-3-pyrazolidone or a p-aminophenol is used, the former is used in an amount of preferably from 0.23 to 0.6 mol/l, more preferably from 0.23 to 0.5 mol/l, and the latter is used in an amount of preferably from 0.06 mol/l or less, more preferably from 0.003 to 0.03 mol/l.

The reductone-base developing agent for use in the present invention is preferably the compound represented by the following formula (R):

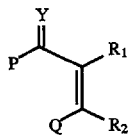

(R)

wherein $R_1$ and $R_2$ each represents a hydroxy group, an amino group (including an amino group substituted by an alkyl group having from 1 to 10 carbon atoms, such as methyl, ethyl, n-butyl, hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxycarbonylamino group (e.g., methoxycarbonylamino), a mercapto group or an alkylthio group (e.g., methylthio, ethylthio), preferably a hydroxy group, an amino group, an alkylsulfonylamino group or an arylsulfonylamino group.

P and Q each represents a hydroxy group, a hydroxyalkyl group, a carboxyl group, a carboxyalkyl group, a sulfo group, a sulfoalkyl group, an amino group, an aminoalkyl group, an alkyl group, an alkoxy group, a mercapto group, or an atomic group necessary when a 5-, 6- or 7-membered ring is formed by combining P and Q and involving two vinyl carbon atoms substituted by $R_1$ and $R_2$ and the carbon atom substituted by Y. More specifically, the ring structure comprises a combination of —O—, —C($R_4$)($R_5$)—, —C($R_6$)=, —C(=O)—, —N($R_7$)— or —N=, wherein $R_4$, $R_5$, $R_6$ and $R_7$ each represents a hydrogen atom, an alkylene group having from 1 to 10 carbon atoms which may be substituted (examples of the substituent includes a hydroxy group, a carboxy group and a sulfo group), a hydroxy group or a carboxy group. Further, a saturated or unsaturated condensed ring may be formed to the 5-, 6- or 7-membered ring.

Examples of the 5-, 6- or 7-membered ring include a dihydrofuranone ring, a dihydropyrone ring, a pyranone ring, a cyclopentenone ring, a cyclohexenone ring, a pyrrolinone ring, a pyrazolidone ring, a pyridone ring, an azacyclohexenone ring and a uracil ring, and among these, preferred are a dihydrofuranone ring, a cyclopentenone ring, a cyclohexenone ring, a pyrazolidone ring, an azacyclohexenone ring and a uracil ring.

Y represents a group comprising =O or =N-$R_3$, wherein $R_3$ represents a hydrogen atom, a hydroxyl group, an alkyl group (e.g., methyl, ethyl), an acyl group (e.g., acetyl), a hydroxyalkyl group (e.g., hydroxymethyl, hydroxyethyl), a sulfoalkyl group (e.g., sulfomethyl, sulfoethyl) or a carboxyalkyl group (e.g., carboxymethyl, carboxyethyl).

Specific examples of the compound represented by formula (R) are set forth below, but the present invention is by no means limited thereto.

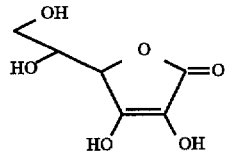

R-1

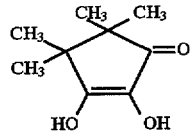

R-2

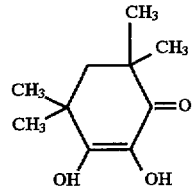

R-3

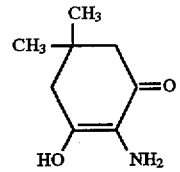

R-4

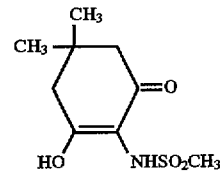

R-5

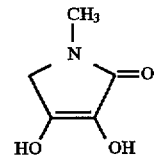

R-6

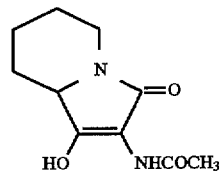

R-7

-continued
R-8
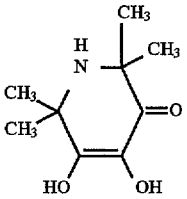
R-9
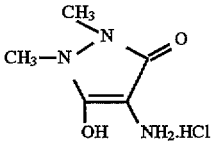
R-10
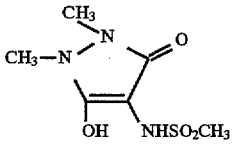
R-11
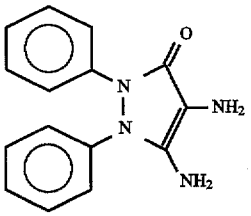
R-12
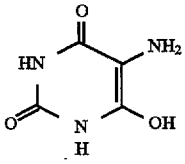
R-13
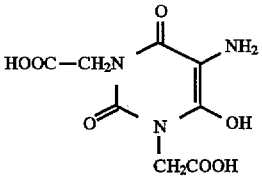
R-14
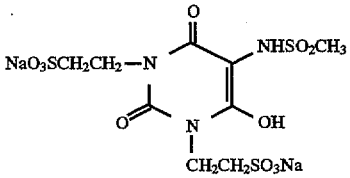
R-15
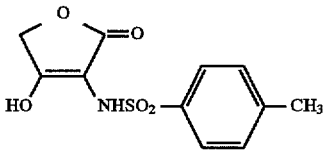
R-16
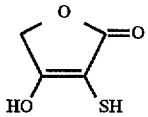
-continued
R-17
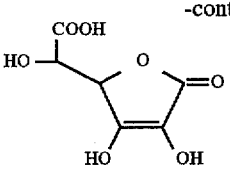
R-18
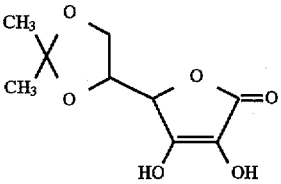
R-19
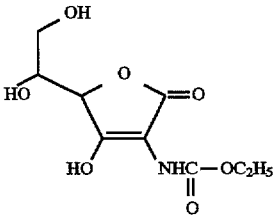
R-20
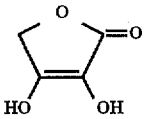
R-21
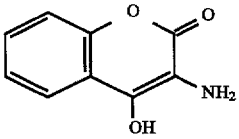
R-22
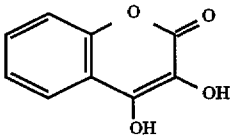
R-23
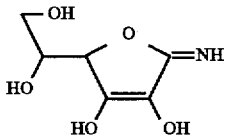
R-24
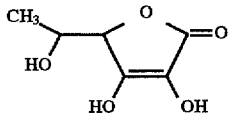
R-25
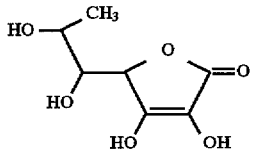
R-26
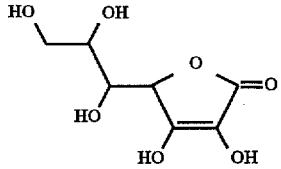

-continued

R-27

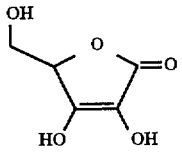

R-28

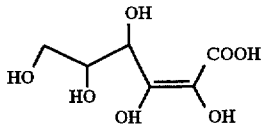

R-29

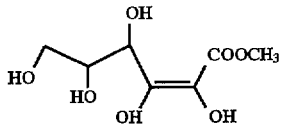

R-30

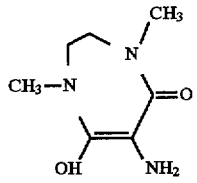

R-31

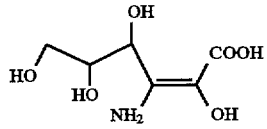

Among these, preferred are an ascorbic acid and an erythorbic acid (a diastereomer of an ascorbic acid).

The use amount of the compound represented by formula (R) is generally from $5\times10^{-3}$ to 1 mol, particularly preferably from $10^{-2}$ to 0.5 mol, per l of the developer.

Examples of the auxiliary developing agent capable of showing super-additivity to the reductone-base developing agent include p-aminophenols and 1-phenyl-3-pyrazolidones and the combination therewith is preferably used in the present invention.

In the present invention, it is preferred that both of the development initiation solution and the development replenisher have property such that "when 0.1 mol of sodium hydroxide is added to 1 l of each solution, the increase in pH is 0.25 or less". In examining whether the development initiation solution or development replenisher used has the above-described property, the development initiation solution or development replenisher to be tested is adjusted to have a pH of 10.5, then 0.1 mol of sodium hydroxide is added to 1 l of the solution and the pH at this time is determined. If the increase of the pH is 0.25 or less, it is judged that the solution has the above-described property. In the present invention, a development initiation solution and a development replenisher showing the increase in pH of 0.2 or less upon the test described above are particularly preferably used.

In order to impart the above-described property to the development initiation solution or a development replenisher, a buffer is preferably used. Examples of the buffer include a carbonate, a boric acid described in JP-A-62-186259, saccharides (e.g., saccharose) described in JP-A-60-93433, oximes (e.g., acetoxime), phenols (e.g., 5-sulfosalicylic acid) and tertiary phosphates (e.g., sodium salt, potassium salt), with a carbonate and a boric acid being preferred. The use amount of the buffer, particularly a carbonate, is preferably 0.5 mol/l or more, more preferably from 0.5 to 1.5 mol/l.

In the present invention, the pH of the development initiation solution is generally from 9.5 to 12.0, preferably from 9.8 to 10.7. The pH of the development replenisher and the pH of the developer in the development tank upon continuous processing also fall within the above-described range.

The alkali agent used for adjusting the pH may be a usual water-soluble inorganic alkali metal salt (e.g., sodium hydroxide, potassium hydroxide, sodium carbonate, potassium carbonate).

In processing 1 $m^2$ of a silver halide photographic light-sensitive material, the replenishing amount of the developer is generally 225 ml or less, preferably from 30 to 225 ml, more preferably from 50 to 180 ml.

The development replenisher may have the same composition as the development initiation solution or the components thereof to be consumed by the development may have a higher-concentration than the initiation solution.

In the present invention, the developer (the development initiation solution and the development replenisher both are collectively called a developer, hereinafter the same) for use in the development processing of a light-sensitive material may contain additives (e.g., preservative, chelating agent) which are commonly used.

Examples of the preservative for use in the present invention include sodium sulfite, potassium sulfite, lithium sulfite, ammonium sulfite, sodium bisulfite, potassium metabisulfite and formaldehyde sodium bisulfite. The sulfite is usually used in an amount of 0.20 mol/l or more, preferably 0.3 mol/l or more, but if it is added in an excessively large amount, silver stains in the developer are caused and therefore, the upper limit of the addition amount is preferably 1.2 mol/l. The addition amount is more preferably from 0.35 to 0.7 mol/l.

As the preservative of a dihydroxybenzene-base developing agent, a small amount of an ascorbic acid derivative may be used in combination with the sulfite. The ascorbic acid derivative as used herein includes an ascorbic acid, an erythorbic acid as a stereoisomer and an alkali metal salt thereof (e.g., sodium salt, potassium salt). The use of sodium erythorbate is preferred in view of the cost for materials. The addition amount is, in terms of a molar ratio to the dihydroxybenzene-base developing agent, preferably from 0.03 to 0.12, more preferably from 0.05 to 0.10. In case when an ascorbic acid derivative is used as a preservative, the developer preferably contains no boron compound.

In addition to the above-described additives, a development inhibitor such as sodium bromide and potassium bromide; an organic solvent such as ethylene glycol, diethylene glycol, triethylene glycol and dimethylformamide; a development accelerator such as alkanolamine (e.g., diethanolamine, triethanolamine), imidazole and a derivative thereof; or an antifoggant or a black pepper inhibitor such as a mercapto-base compound, an indazole-base compound, a benzotriazole-base compound and a benzimidazole-base compound may be used. Specific examples thereof include 5-nitroindazole, 5-p-nitrobenzoylaminoindazole, 1-methyl-5-nitroindazole, 6-nitoindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazole-2-yl)thio]butanesulfonate, 5-amino-1,3,4-thiadiazole-2-thiol, methylbenzotriazole, 5-methylbenzotriazole and 2-mercaptobenzotriazole. The amount of the antifoggant is generally from 0.01 to 10 mmol, more preferably from 0.1 to 2 mmol, per l of the developer.

Further, in the developer of the present invention, various organic and inorganic chelating agents may be used in combination. As the inorganic chelating agent, a sodium tetrapolyphosphate or a sodium hexametaphosphate may be used.

As the organic chelating agent, an organic carboxylic acid, an aminopolycaroxylic acid, an organic phosphonic acid, an aminophosphonic acid or an organic phosphonocarboxylic acid may be used.

Examples of the organic carboxylic acid include an acrylic acid, an oxalic acid, a malonic acid, a succinic acid, a glutaric acid, an adipic acid, a pimelic acid, an acielaic acid, a sebacic acid, a nonanedicarboxylic acid, a decanedicarboxylic acid, an undecanedicarboxylic acid, a maleic acid, an itaconic acid, a malic acid, a citric acid and a tartaric acid, however, the organic carboxylic acid is by no means limited to these.

Examples of the aminopolycarboxylic acid include an imidiodiacetic acid, a nitrilotriacetic acid, a nitrilotripropionic acid, an ethylenediaminemonohydroxyethyltriacetic acid, an ethylenediaminetetraacetic acid, a glycol ether tetraacetic acid, a 1,2-diaminopropanetetraacetic acid, a diethylenetriaminepentaacetic acid, a triethylenetetraminehexaacetic acid, a 1,3-diamino-2-propanoltetraacetic acid, a glycol ether diaminetetraacetic acid and the compounds described in JP-A-52-25632, JP-A-55-67747, JP-A-57-102624 and JP-B-53-40900.

Examples of the organic phosphonic acid include a hydroxyalkylidene-diphosphonic acid described in U.S. Pat. Nos. 3,214,454 and 3,794,591 and West German Patent Application (OLS) 2,227,639 and the compounds described in *Research Disclosure,* Vol. 181, Item 18170 (May, 1979).

Examples of the aminophosphonic acid include aminotris (methylenephosphonic acid), ethylenediaminetetramethylenephosphonic acid, aminotrimethylenephosphonic acid and the compounds described in Research Disclosure (cited above), No. 18170, JP-A-57-208554, JP-A-54-61125, JP-A-55-29883 and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure* (cited above), No. 18170.

The chelating agent may be used in the form of an alkali metal salt or an ammonium salt. The addition amount of the chelating agent is preferably from $1\times10^{-4}$ to $1\times10^{-1}$ mol, more preferably from $1\times10^{-3}$ to $1\times10^{-2}$ mol, per 1 of the developer.

Further, as the silver stain inhibitor, the compounds described in JP-A-56-24347, JP-B-56-46585, JP-B-62-2849 and JP-A-4-362942 may be used in the developer.

Furthermore, the compounds described in JP-A-62-212651 may be used as the development unevenness inhibitor and the compounds described in JP-A-61-267759 may be used as the dissolution aid.

Still further, if desired, a color tone adjuster, a surface active agent, a defoaming agent or a hardening agent may be added.

The temperature and the time of the development processing have an interrelation with each other and are determined in relation to the total processing time, however, the development temperature is generally from about 20° to about 50° C., preferably from 25° to 45° C., and the development time is generally from 5 seconds to 2 minutes, preferably from 7 seconds to 1 minute and 30 seconds.

For the purpose of reducing the transportation cost of the processing solution, the cost for the packaging material or the space, it is preferred that the processing solution is concentrated and diluted upon use. In concentrating the developer, it is effective to convert the salt components contained in the developer into potassium salts.

The fixing solution used in the fixing step is an aqueous solution containing sodium thiosulfate or ammonium thiosulfate, and if desired, a tartaric acid, a citric acid, a gluconic acid, a boric acid, an iminodiacetic acid, a 5-sulfosalicylic acid, a glucoheptanic acid, Tailon, an ethylenediaminetetraacetic acid, a diethylenetriaminepentaacetic acid, a nitrilotriacetic acid or a salt of these. In view of environmental conservation advocated in recent years, it is preferred to contain no boric acid.

The fixing agent in the fixing solution for use in the present invention may be sodium thiosulfate or ammonium thiosulfate and although in view of the fixing rate, ammonium thiosulfate is preferred, in view of environmental conservation advocated in recent years, sodium thiosulfate may also be used. The use amount of these known fixing agents may be varied appropriately but it is generally from about 0.1 to about 2 mol/l, more preferably from 0.2 to 1.5 mol/l.

The fixing solution may contain, if desired, a hardening agent (e.g., water-soluble aluminum compound), a preservative (e.g., sulfite, bisulfite), a pH buffer (e.g., acetic acid), a pH adjusting agent (e.g., ammonia, sulfuric acid), a chelating agent, a surface active agent, a wetting agent or a fixing accelerator.

Examples of the surface active agent include an anionic surface active agent such as a sulfide and a sulfonated product, a polyethylene-base surface active agent and an amphoteric surface active agent described in JP-A-57-6740. Further, a known defoaming agent may be added. Examples of the wetting agent include alkanolamine and alkylene glycol. Examples of the fixing accelerator include thiourea derivatives described in JP-B-45-35754, JP-B-58-122535 and JP-B-58-122536, alcohols having a triple bond in the molecule, thioether compounds described in U.S. Pat. No. 4,126,459, mesoionic compounds described in JP-A-4-229860 and compounds described in JP-A-2-44355.

Examples of the pH buffer include an organic acid such as an acetic acid, a malic acid, a succinic acid, a tartaric acid, a citric acid, an oxalic acid, a maleic acid, a glycolic acid and an adipic acid, and an inorganic buffer such as a boric acid, a phosphate and a sulfite. Preferred are an acetic acid, a tartaric acid and a sulfite.

The pH buffer is used here for the purpose of preventing the increase of pH of the fixing agent due to the developer carried over, and it is used in an amount of from 0.01 to 1.0 mol/l, preferably from 0.02 to 0.6 mol/l.

The pH of the fixing solution is preferably from 4.0 to 6.5, more preferably from 4.5 to 6.0.

Further, as the dye elution accelerator, the compound described in JP-A-64-4739 may be used.

The hardening agent for use in the fixing solution of the present invention includes a water-soluble aluminum salt and a chromium salt. Preferred is a water-soluble aluminum compound and examples thereof include aluminum chloride, aluminum sulfate and potassium alum. The addition amount of the hardening agent is preferably from 0.01 to 0.2 mol/l, more preferably from 0.03 to 0.08 mol/l.

The fixing temperature is generally from about 20° to about 50° C., preferably from 25° to 45° C., and the fixing time is generally from 5 seconds to 1 minute, preferably from 7 to 50 seconds.

The replenishing amount of the fixing solution is, based on the processing amount of the light-sensitive material, 600 $ml/m^2$ or less, preferably 500 $ml/m^2$ or less.

After the development and the fixing, the light-sensitive material is subsequently subjected to water washing or stabilization. The water washing or stabilization is conducted using the washing water in an amount of usually 20 l or less per $m^2$ of the silver halide light-sensitive material or it may be conducted at a replenishing amount of 3 l or less (including 0 l, in other words, standing water washing). That is, not only water saving processing may be conducted but also the installation of an automatic processer may be done without piping.

As a method for reducing the replenishing amount of washing water, a multi-stage countercurrent system (for example, 2-stage or 3-stage) has been known from the old. If the multi-stage countercurrent system is adopted in the present invention, the light-sensitive material after fixing may be processed by gradually coming into contact with the processing solutions in the normal direction, in other words, with the processing solutions free of staining by the fixing solution in sequence, and as a result, further efficient water washing may be made.

In conducting water washing using a small amount of water, it is preferred to provide a rinsing tank using a squeeze roller or a crossover roller described in JP-A-63-18350 and JP-A-62-287252. Or, in order to reduce the pollution load as a problem caused in the case of water washing using a small amount of water, various oxidizing agents may be added or filter filtration may be used in combination.

Further, the overflow solution from water washing or stabilization bath which is generated in replenishing water subjected to anti-mold treatment to the water washing or stabilization bath according to the processing in the method of the present invention, may be partly or wholly used in the processing solution having fixing ability as a previous processing step of the water washing or stabilization as described in JP-A-60-235133.

Furthermore, in order to prevent bubble unevenness readily generated in the case of small-amount water washing and/or transfer of processing agent ingredients attached to the squeeze roller to the processed film, a water-soluble surface active agent or a defoaming agent may be added.

Still further, for the purpose of preventing stains by the dye dissolved out from the light-sensitive material, a dye adsorbent described in JP-A-63-163456 may be provided in the water washing tank.

In some cases, stabilization may be conducted subsequent to the above-described water washing and as one example, a bath containing the compound described in JP-A-2-201357, JP-A-2-132435, JP-A-1-102553 and JP-A-46-44446 may be used as a final bath of the light-sensitive material.

The stabilization bath may also contain, if desired, an ammonium compound, a metal compounds such as Bi or Al, a fluorescent brightening agent, various chelating agents, a layer pH adjusting agent, a hardening agent, a bactericide, an anti-mold, an alkanolamine or a surface active agent. The water for use in the water washing or stabilization step may be tap water and in addition, deionized water or water sterilized by halogen, an ultraviolet bactericidal lamp or various oxidizing agents (e.g., ozone, hydrogen peroxide, chlorate) is preferably used. Further, washing water containing a compound described in JP-A-4-39652 and JP-A-5-241309 may also be used.

The temperature and the time in the water washing or stabilization bath are preferably from 0° to 50° C. and from 5 seconds to 2 minutes, respectively.

The processing solutions for use in the present invention are preferably stored in a packaging material having a low oxygen permeability described in JP-A-61-73147.

In the case when the replenishing amount is reduced, it is preferred to prevent evaporation or air oxidation of the solution by reducing the contact area of the processing tank with air. The roller conveyance type automatic processer is described in U.S. Pat. Nos. 3,025,779 and 3,545,971, and in the present invention, it is referred to simply as a roller conveyance type processor. The roller conveyance type processor comprises four steps consisting of development, fixing, water washing and drying, and also in the present invention, the above-described four-step processing is most preferred although other steps (e.g., stopping step) are not rejected. A four-step processing using stabilization in place of water washing may also be employed.

The components as solids resulting from removing water from the composition of the developer or fixing solution may be supplied and upon use as a developer or a fixing solution, they may be dissolved in a predetermined amount of water. This type of processing agent is called a solid processing agent. The solid processing agent may be in the form of powder, tablet, granule, lump or paste, and preferred are the shape described in JP-A-61-259921 and a tablet. The tablet may be produced by a common method described, for example, in JP-A-51-61837, JP-A-54-155038, JP-A-52-88025 and British Patent 1,213,808, and the granule processing agent may be produced by a common method described, for example, in JP-A-2-109042, JP-A-2-109043, JP-A-3-39735 and JP-A-3-39739. Also, the powder processing agent may be produced by a common method described, for example, in JP-A-54-133332, British Patents 725,892 and 729,862, and German Patent 3,733,861.

The bulk density of the solid processing agent is, in view of its solubility and effects on the object of the present invention, preferably from 0.5 to 6.0 g/$cm^3$, more preferably from 1.0 to 5.0 g/$cm^3$.

The solid processing agent may be prepared by a method where out of materials constituting the processing agent, at least two kinds of granular materials reactive with each other are placed as layers such that the layers are separated by at least one intervening separation layer formed of a material inactive to the reactive materials, a bag capable of vacuum package is used as a packaging material and the bag is evacuated and sealed. In this case, the term "inactive" as used herein means that the materials do not react under a normal state in the package when they are physically put into contact with each other or even if any reaction is caused, it is not so extreme. The inactive material may be sufficient, apart from being inactive to two materials reactive with each other, if it is inactive upon the intended use of two reactive materials. Further, the inactive material is a material used simultaneously with two reactive materials. For example, in the developer, hydroquinone and sodium hydroxide react when they come into direct contact and therefore, sodium sulfite is used as a separation layer between the hydroquinone and the sodium hydroxide in vacuum packaging, thereby ensuring a long-term storage of the developer in the package. The packaging material used as such a vacuum packaging material is a bag formed of an inactive plastic film or formed of a laminate of a plastic material and a metal foil.

There is no particular limitation on various additives for use in the light-sensitive material of the present invention and, for example, the materials described in the following may be preferably used.

| Item | Pertinent Portion |
|---|---|
| 1) Surface active agent, antistatic agent | JP-A-2-12236, page 9, from right upper column, line 7 to right lower column, line 7; JP-A-2-18542, from page 2, left lower column, line 13 to page 4, right lower column, line 18; compounds represented by formula (II) of Japanese Patent Application No. 6-47961 |
| 2) Antifoggant, stabilizer | JP-A-2-103536, from page 17, right lower column, line 19 to page 18, right upper column, line 4 and page 18, right lower column, lines 1 to 5; thiosulfinic acid compounds described in JP-A-1-237538 |
| 3) Polymer latex | JP-A-2-103536, page 18, left lower column, lines 12 to 20 |
| 4) Compound having acid group | JP-A-2-103536, from page 18, right lower column, line 5 to page 19, left upper column, line 1; JP-A-2-55349, from page 8, right lower column, line 13 to page 11, left upper column, line 8 |
| 5) Matting agent, lubricant, plasticizer | JP-A-2-103536, page 19, from left upper column, line 15 to right upper column, line 15 |
| 6) Hardening agent | JP-A-2-103536, page 18, right upper column, lines 5 to 17 |
| 7) Dye | JP-A-2-103536, page 17, right lower column, lines 1 to 18; JP-A-2-30042, from page 4, right upper column, line 1 to page 6, right upper column, line 5; solid dyes described in JP-A-2-294638 and JP-A-5-11382 |
| 8) Binder | JP-A-2-18542, page 3, right lower column, lines 1 to 20 |
| 9) Black pepper inhibitor | compounds described in U.S. Pat. No. 4,956,257 and JP-A-1-118832 |
| 10) Redox compound | compounds represented by formula (I) (particularly Compounds 1 to 50) of JP-A-2-301743; compounds represented by formulae (R-1), (R-2) and (R-3) and Compounds 1 to 75 described on pages 3–20 of JP-A-3-174143; compounds described in Japanese Patent Application No. 3-69466 and JP-A-4-278939 |
| 11) Monomethine compound | compounds represented by formula (II) (particularly, Compounds II-1 to II-26) of JP-A-2-287532 |
| 12) Dihydroxybenzenes | compounds described in JP-A-3-39948, from page 11, left upper column to page 12, left lower column and EP 452772A |

The present invention will be described below in greater detail by referring to Examples, but the present invention should not be construed as being limited thereto.

For the purpose of comparison with the nucleating agent and the nucleation accelerator of the present invention, the following comparative compounds were used as a nucleating agent or a nucleation accelerators were used.

Comparative Compound H-A

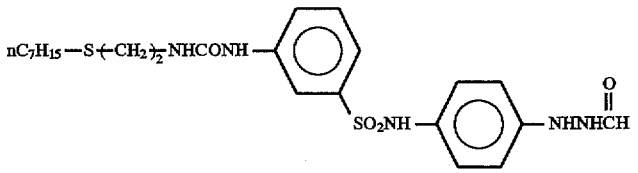

Comparative Compound H-B

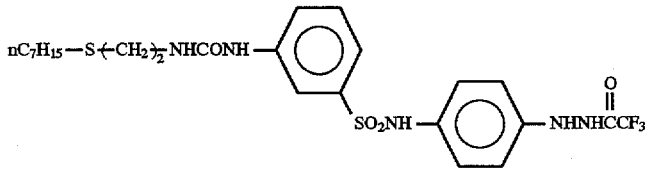

Comparative Compound H-C

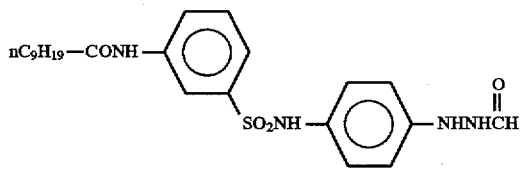

-continued

Comparative Compound H-D

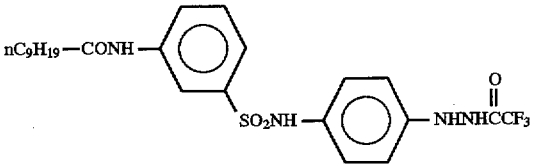

Comparative Compound H-E

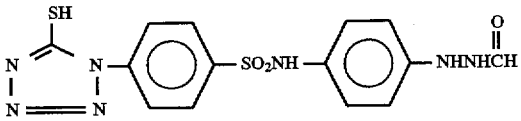

Comparative Compound H-F

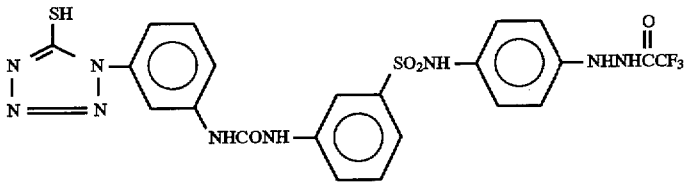

Comparative Compound H-G

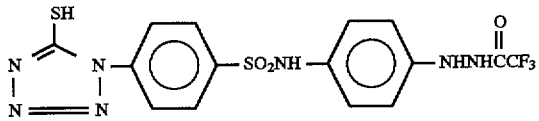

Comparative Compound A-A

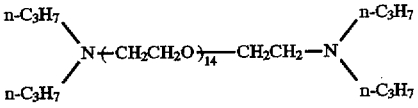

Comparative Compound A-B

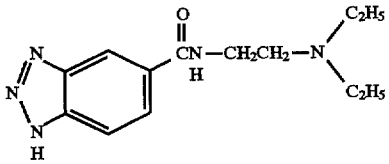

Comparative Compound A-C

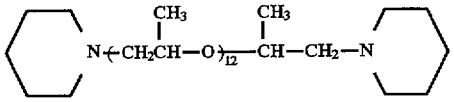

EXAMPLE 1

Preparation of Silver Halide Light-sensitive Material

Preparation of Emulsion

Emulsion A was prepared according to the following method.

[Emulsion A]

An aqueous silver nitrate solution and an aqueous halogen salt solution containing potassium bromide, sodium chloride, $K_3IrCl_6$ in an amount corresponding to $3.5\times10^{-7}$ mol/mol-Ag and $K_2Rh(H_2O)Cl_5$ in an amount corresponding to $2.0\times10^{-7}$ mol/mol-Ag were added to an aqueous gelatin solution containing sodium chloride and 1,3-dimethyl-2-imidazolidinethione while stirring by a double jet method to prepare silver chlorobromide grains having an average grain size of 0.25 μm and a silver chloride content of 70 mol %.

Thereafter, the emulsion was washed with water by a flocculation method according to a usual method, 40 g/mol-Ag of gelatin was added thereto, further 7 mg/mol-Ag of sodium benzenethiosulfonate and 2 mg/mol-Ag of benzenesulfinic acid were added thereto, the pH and the pAg were adjusted to 6.0 and 7.5, respectively, and the emulsion was subjected to chemical sensitization by adding 2 mg/mol-Ag of sodium thiosulfate and 4 mg/mol-Ag of chloroauric acid so as to show optimal sensitivity at 60° C. Then, 150 mg of 4-hydroxy-6-methyl-1,3,3a,7-tetrazaindene was added as a stabilizer and 100 mg of Proxel was added as an antiseptic. The resulting grains had an average grain size of 0.25 μm and each grain was a silver chlorobromide cubic grain having a silver chloride content of 70 mol % (coefficient of variation: 10%).

Preparation of Coated Sample

On a polyethylene terephthalate film support undercoated by a moisture-proofing layer containing vinylidene chloride, a UL layer, an EM layer, a PC layer and an OC layer were coated in this order from the support side to prepare a coated sample.

The preparation method and the coating amount of each layer are described below.

(UL Layer)

To an aqueous gelatin solution, 30 wt % on a gelatin basis of polyethyl acrylate dispersion was added, and the resulting solution was coated to give a gelatin coverage of 0.5 g/m$^2$.

(EM Layer)

To Emulsion A prepared above, $5\times10^{-4}$ mol/mol-Ag of the following Compound (S-1) and $5\times10^{-4}$ mol/mol-Ag of Compound (S-2) as sensitizing dyes, $3\times10^{-4}$ mol/mol-Ag of a mercapto compound shown below as Compound (a), $4\times10^{-4}$ mol/mol-Ag of a mercapto compound shown below as Compound (b), $4\times10^{-4}$ mol/mol-Ag of a triazine compound shown below as Compound (c), $2\times10^{-3}$ mol/mol-Ag of 5-chloro-8-hydroxyquinoline, $5\times10^{-4}$ mol/mol-Ag of the following Compound (p), and $4\times10^{-4}$ mol/mol-Ag of the compound shown in Table 1 as a nucleation accelerator were added. Further, hydroquinone and an N-oleyl-N-methyltaurine sodium salt were added to give a coated amount of 100 and 30 mg/m$^2$, respectively. Thereafter, $1\times10^{-5}$ mol/m$^2$ of a nucleating agent (a hydrazine derivative) shown in Table 1 (in case of the nucleating agent affixed by the mark *, $2\times10^{-6}$ mol/m$^2$), 200 mg/m$^2$ of a water-soluble latex shown below as Compound (d), 200 mg/m$^2$ of a polyethyl acrylate dispersion, 200 mg/m$^2$ of P-4, 200 mg/m$^2$ of colloidal silica having an average particle size of 0.02 μm, and 200 mg/m$^2$ of 1,3-divinylsulfonyl-2-propanol as a hardening agent were added. The pH of the resulting solution was adjusted to 5.65 by adding an acetic acid. The solution was coated to give a coated silver amount of 3.5 g/m$^2$.

(PC Layer)

To an aqueous gelatin solution, 50 wt % on a gelatin basis of an ethyl acrylate dispersion, Surface Active Agent (w) shown below and 1,5-dihydroxy-2-benzaldoxime in an amount necessary for giving a coated amount of 5 mg/m$^2$ and 10 mg/m$^2$, respectively, were added, and the resulting solution was coated to give a gelatin coverage of 0.5 g/m$^2$.

(OC Layer)

0.5 g/m$^2$ of gelatin, 40 mg/m$^2$ of an amorphous $SiO_2$ matting agent having an average particle size of about 3.5 μm, 0.1 g/m$^2$ of methanol silica, 100 mg/m$^2$ of polyacrylamide, 20 mg/m$^2$ of silicone oil, and as coating aids, 5 mg/m$^2$ of a fluorine-surface active agent shown below by chemical formula (e) and 100 mg/m$^2$ of sodium dodecylbenzenesulfonate were coated.

(S-1)

-continued

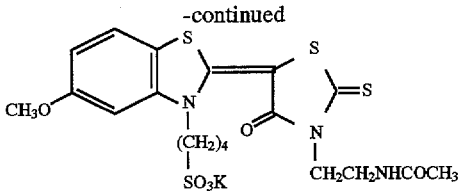

(S-2)

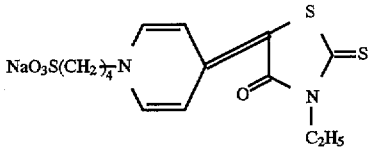

(a)

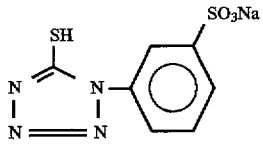

(b)

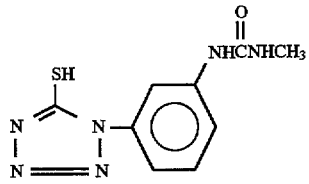

(c)

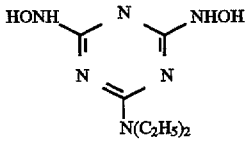

(d)

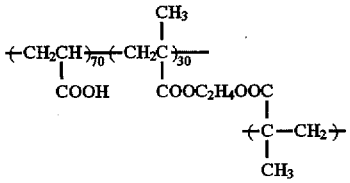

(e)

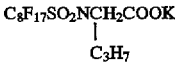

(p)

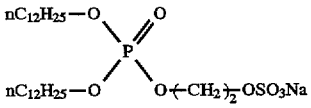

(w)

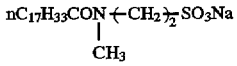

The coated samples each had a back layer and a back protective layer having the following compositions.

| [Formulation of Back Layer] | |
|---|---|
| Gelatin | 3 g/m² |
| Latex: polyethyl acrylate | 2 g/m² |
| Surface active agent: sodium p-dodecylbenzenesulfonate | 40 mg/m² |
| $CH_2{=}CHSO_2CH_2CONH$ — $(CH_2)_2$ — $CH_2{=}CHSO_2CH_2CONH$ | 110 mg/m² |
| $SnO_2$/Sb (weight ratio: 90/10, average particle size: 0.20 μm) | 200 mg/m² |
| Dye: a mixture of Dyes [a], [b] and [c] | |
| Dye [a] | 70 mg/m² |
| Dye [b] | 70 mg/m² |
| Dye [c] | 90 mg/m² |

Dye [a]

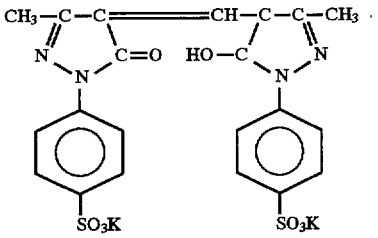

Dye [b]

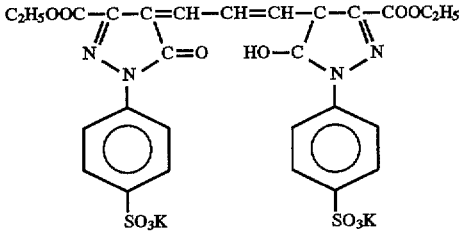

Dye [c]

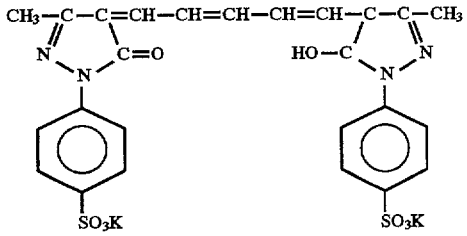

| [Back protective Layer] | |
|---|---|
| Gelatin | 0.8 mg/m² |
| Polymethyl methacrylate fine particle (average particle diameter: 4.5 μm) | 30 mg/m² |
| Dihexyl-α-sulfosuccinato sodium salt | 15 mg/m² |
| Sodium p-dodecylbenzenesulfonate | 15 mg/m² |
| Sodium acetate | 40 mg/m² |

Evaluation of Photographic Performance (1) Exposure and Development

The thus-prepared samples each was exposed to a xenon flash light using a step wedge through an interference filter having a peak at 488 nm for a luminescence time of $10^{-5}$ sec and then developed with Developer A having the following composition at 35° C. for 30 seconds, followed by fixing, water washing and drying.

| Developer A: | |
|---|---|
| Potassium hydroxide | 35.0 g |
| Diethylenetriaminepentaacetic acid | 2.0 g |
| Potassium carbonate | 12.0 g |
| Sodium metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Sodium erysorbate | 3.0 g |
| Water to make | 1 l |
| pH adjusted by adding potassium hydroxide | 10.5 |

The fixing solution according to the following formulation was used.

| (Formulation of Fixing Solution) | |
|---|---|
| Ammonium thiosulfate | 359.1 g |
| Disodium ethylenediaminetetraacetate dihydrate | 0.09 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH (adjusted by sulfuric acid or sodium hydroxide) | 4.85 |
| Water to make | 3 l |

(2) Evaluation of Contrast of Image

With respect to the index (γ) for showing the contrast of an image, a point giving fog+density of 0.1 in a characteristic curve and a point giving fog+density of 3.0 were connected by a straight line and the gradient of the straight line was shown as the γ value. In other words, γ=(3.0–0.1)/[log(exposure amount necessary for giving density of 3.0) −(exposure amount necessary for giving density of 0.1)], and the larger the γ value, the higher the contrast. As the light-sensitive material for graphic arts, the γ value is preferably 10 or more, more preferably 15 or more.

(3) Evaluation of Storability

The coated samples each was allowed to stand under conditions of 60° C. and RH 65% for 3 days.

(i) Determination of Nucleating Agent Residual Rate

From each of the samples aged as abvoe and the samples immediately after the above-described coating, a nucleating agent was extracted with an organic solvent and determined on the quantity using an HPLC.

Nucleating agent residual rate (%)=[(amount of nucleating agent extracted from the sample aged at 65° C. and 65% for 3 days)/(amount of nucleating agent extracted from the sample immediately after the coating)]×100

(ii) Change in Sensitivity

The aged samples and the samples immediately after the coating each was developed and determined on the sensitivity and the change in sensitivity ($\Delta S_{1.5}$) was calculated from the values obtained.

Sensitivity ($S_{1.5}$): a logarithm of the exposure amount necessary for giving density of 1.5 →The smaller the value, the higher the sensitivity.

$\Delta S_{1.5}$=|($S_{1.5}$ of sample immediately after the coating)−($S_{1.5}$ of sample aged at 65° C. and 65% for 3 days)|→The smaller the value, the better the performance with small change in sensitivity.

(4) Evaluation of Pressure Property

The pressure property was evaluated as follows. One end of each coated sample was fixed while facing the emulsion surface inwardly under moisture conditioning at a relative humidity of 40% and the sample was bent by rotating it along a piano wire having a diameter of 1 mm to 180° at a bending rate of 360°/sec. This bending was conducted 10 seconds before the exposure.

The resulting sample was exposed and developed under the above-described conditions and sensitivities on the bent area and on the area free of bending were compared and evaluated according to 5-rank rating.

5 is the best level and 1 is the worst level. The samples rated 3 or lower cannot be used in practice.

TABLE 1

| No. | Nucleating Agent | Nucleation Accelerator | γ | Storability: Nucleating Agent Residual Rate | Storability: $\Delta S_{1.5}$ | Pressure Property | Remarks |
|---|---|---|---|---|---|---|---|
| 101 | Comparative Compound H-A | Comparative Compound A-A | 10.2 | 91 | 0.02 | 2 | Comparison |
| 102 | Comparative Compound H-A | Comparative Compound A-C | 10.1 | 92 | 0.01 | 1 | Comparison |
| 103 | Comparative Compound H-A | A-112 | 11.0 | 93 | 0.02 | 1 | Comparison |
| 104 | Comparative Compound H-B | Comparative Compound A-A | 13.6 | 18 | 0.12 | 2 | Comparison |
| 105 | Comparative Compound H-B | Comparative Compound A-B | 15.4 | 23 | 0.11 | 2 | Comparison |
| 106 | Comparative Compound H-B | A-112 | 18.1 | 29 | 0.10 | 1 | Comparison |
| 107 | H-3 | Comparative Compound A-A | 15.2 | 78 | 0.04 | 3 | Comparison |
| 108 | H-3 | Comparative Compound A-C | 14.8 | 76 | 0.05 | 3 | Comparison |
| 109 | H-3 | A-112 | 19.2 | 95 | 0 | 5 | Invention |
| 110 | H-3 | A-214 | 20.1 | 94 | 0 | 5 | Invention |
| 111 | H-3 | A-256 | 18.6 | 93 | 0.01 | 5 | Invention |
| 112 | H-5 | A-112 | 19.4 | 94 | 0.02 | 5 | Invention |
| 113 | H-5 | A-215 | 18.8 | 95 | 0.01 | 5 | Invention |
| 114 | H-6 | A-112 | 17.2 | 92 | 0.01 | 5 | Invention |
| 115 | H-6 | A-217 | 17.9 | 94 | 0 | 5 | Invention |
| 116 | H-8* | A-214 | 19.8 | 96 | 0 | 5 | Invention |
| 117 | H-8* | A-217 | 19.4 | 95 | 0 | 5 | Invention |
| 118 | H-10 | A-112 | 18.2 | 94 | 0.01 | 5 | Invention |
| 119 | H-10 | A-259 | 19.1 | 92 | 0.02 | 5 | Invention |
| 120 | H-13* | A-214 | 19.1 | 98 | 0 | 5 | Invention |
| 121 | H-13* | A-259 | 19.3 | 97 | 0 | 5 | Invention |
| 122 | H-14 | A-112 | 17.9 | 92 | 0.02 | 5 | Invention |
| 123 | H-14 | A-258 | 18.1 | 93 | 0.01 | 5 | Invention |
| 124 | H-21 | A-112 | 18.9 | 93 | 0 | 5 | Invention |
| 125 | H-21 | A-256 | 18.7 | 94 | 0.01 | 5 | Invention |
| 126 | H-22* | A-214 | 19.1 | 98 | 0 | 5 | Invention |
| 127 | H-22* | A-263 | 19.2 | 97 | 0 | 5 | Invention |
| 128 | H-23 | A-112 | 18.9 | 99 | 0 | 5 | Invention |

Results

It is seen from the results in Table 1 that samples other than those using a combination of the nucleating agent of the present invention with the onium salt compound of the present invention failed to achieve photographic performance (γ) and at the same time, the storability and the pressure property. The combination according to the present invention provided a light-sensitive material for argon scanner exhibiting high γ and excellent storability and pressure property.

EXAMPLE 2

Preparation of Silver Halide Light-sensitive Material

Preparation of Emulsion

Emulsion B was prepared as follows.

[Emulsion B]

Emulsion B was prepared in the same manner as Emulsion A except that chemical sensitization was conducted by adding 1 mg/mol-Ag of a selenium sensitizer having the following chemical formula, 1 mg/mol-Ag of sodium thiosulfate and 4 mg/mol-Ag of chloroauric acid to show optimal sensitivity at 60° C.

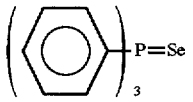

Preparation of Coated Sample

Samples were prepared in the same manner as in Example 1 except that $2.1\times10^{-4}$ mol/mol-Ag of the following Compound (S-3) was used in place of the sensitizing dye in the EM layer of Example 1 and Emulsion B was used as the emulsion of the EM layer.

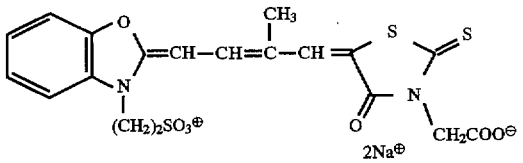

(S-3)

Evaluation of Photographic Performance (i) Exposure and Development

The thus-obtained samples each was exposed to a xenon flash light using a step wedge through an interference filter having a peak at 633 nm for a luminescence time of $10^{-6}$ second. The samples each was developed with Developer A described in Example 1 at 35° C. for 30 seconds and then fixed (the same as in Example 1), water washed and dried.

The contrast of an image and the storability were evaluated in the same manner as in Example 1.

Results

By using a combination of the nucleating agent and the nucleation accelerator of the present invention, light-sensitive materials for a helium-neon laser scanner having a high γ value and good storability could be obtained.

EXAMPLE 3

Preparation of Silver Halide Light-sensitive Material

Samples were prepared in the same manner as in Example 2 except for changing the sensitizing dye in the EM layer of Example 2 to the following Compound (S-4).

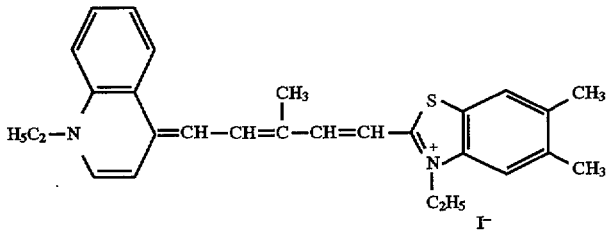

(S-4)

Evaluation of Photographic Performance

The thus-obtained samples each was exposed to a xenon flash light using a step wedge through an interference filter having a peak at 780 nm for a luminescence time of $10^{-6}$ second. The samples each was developed with Developer A described in Example 1 at 35° C. for 30 seconds and then fixed (the same as in Example 1), water washed and dried.

The contrast of an image and the storability were evaluated in the same manner as in Example 2.

Results

By using a combination of the nucleating agent and the nucleation accelerator of the present invention, light-sensitive materials for semiconductor laser scanner having a high γ value and good storability could be obtained.

EXAMPLE 4

Preparation of Silver Halide Light-sensitive Material

Samples were prepared in the same manner as in Example 2 except for changing the sensitizing dye in the EM layer of Example 2 to the following Compound (S-5). The nucleating agents and the nucleation accelerators used are shown in Table 2.

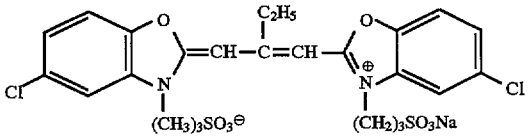

(S-4)

Evaluation of Photographic Performance

The thus-obtained samples each was exposed to a tungsten light of 3,200° K. using a step wedge. The samples each was developed with Developer A described in Example 1 at 35° C. for 30 seconds and then fixed, water washed and dried. The fixing solution used was GR-F1 (produced by Fuji Photo Film Co., Ltd.).

The contrast of an image and the storability were evaluated in the same manner as in Example 2.

TABLE 2

| No. | Nucleating Agent | Nucleation Accelerator | γ | Storability: Nucleating Agent Residual Rate | Storability: $\Delta S_{1.5}$ | Pressure Property | Remarks |
|---|---|---|---|---|---|---|---|
| 201 | Comparative Compound H-C | Comparative Compound A-A | 11.0 | 92 | 0.02 | 1 | Comparison |
| 202 | Comparative Compound H-C | Comparative Compound A-C | 10.7 | 91 | 0.01 | 2 | Comparison |
| 203 | Comparative Compound H-C | A-112 | 12.3 | 94 | 0.02 | 2 | Comparison |
| 204 | Comparative Compound H-D | Comparative Compound A-A | 14.3 | 34 | 0.12 | 1 | Comparison |
| 205 | Comparative Compound H-D | Comparative Compound A-B | 13.8 | 38 | 0.11 | 2 | Comparison |
| 206 | Comparative Compound H-D | A-112 | 18.9 | 45 | 0.10 | 1 | Comparison |
| 207 | H-2 | Comparative Compound A-A | 14.2 | 81 | 0.04 | 3 | Comparison |

TABLE 2-continued

| No. | Nucleating Agent | Nucleation Accelerator | γ | Storability: Nucleating Agent Residual Rate | Storability: $\Delta S_{1.5}$ | Pressure Property | Remarks |
|---|---|---|---|---|---|---|---|
| 208 | H-2 | Comparative Compound A-C | 13.8 | 80 | 0.05 | 3 | Comparison |
| 209 | H-2 | A-112 | 19.4 | 95 | 0 | 5 | Invention |
| 210 | H-2 | A-214 | 19.1 | 94 | 0 | 5 | Invention |
| 211 | H-2 | A-256 | 17.6 | 94 | 0.01 | 5 | Invention |
| 212 | H-5 | A-112 | 18.2 | 93 | 0.02 | 5 | Invention |
| 213 | H-5 | A-215 | 18.4 | 94 | 0.01 | 5 | Invention |
| 214 | H-6 | A-112 | 17.6 | 93 | 0.01 | 5 | Invention |
| 215 | H-6 | A-217 | 17.3 | 94 | 0 | 5 | Invention |
| 216 | H-8* | A-214 | 19.4 | 97 | 0 | 5 | Invention |
| 217 | H-8* | A-217 | 19.1 | 94 | 0 | 5 | Invention |
| 218 | H-12 | A-112 | 18.7 | 93 | 0.01 | 5 | Invention |
| 219 | H-12 | A-259 | 19.2 | 94 | 0.02 | 5 | Invention |
| 220 | H-13* | A-214 | 19.3 | 97 | 0 | 5 | Invention |
| 221 | H-13* | A-259 | 19.6 | 96 | 0 | 5 | Invention |
| 222 | H-15 | A-112 | 17.1 | 91 | 0.02 | 5 | Invention |
| 223 | H-15 | A-258 | 18.4 | 92 | 0.01 | 5 | Invention |
| 224 | H-20 | A-112 | 19.3 | 93 | 0 | 5 | Invention |
| 225 | H-20 | A-256 | 18.3 | 93 | 0.01 | 5 | Invention |
| 226 | H-22* | A-214 | 19.4 | 97 | 0 | 5 | Invention |
| 227 | H-22* | A-263 | 19.1 | 96 | 0 | 5 | Invention |
| 228 | H-23 | A-112 | 18.5 | 98 | 0 | 5 | Invention |

Results

Similarly to Example 2, by using the nucleating agent of the present invention, light-sensitive materials for photographing having a high γ value and good storability could be obtained.

EXAMPLE 5

Based on the formulation of a light-sensitive material in Example 5 of JP-A-7-43867, a coated sample having added thereto the hydrazine derivative and the nucleation accelerator of the present invention was prepared and then, developed and evaluated in the same manner as in Example 4.

Similarly to Example 4, by using the nucleating agent and the nucleation accelerator, a light-sensitive material for photographing having a high γ value and good storability could be obtained.

EXAMPLE 6

Preparation of Emulsion

Emulsion C: To a 1.5% aqueous gelatin solution kept at 40° C., containing sodium chloride and $3\times10^{-5}$ mol/mol-Ag of the following Compound (f) and having a pH of 2.0, an aqueous silver nitrate solution and an aqueous sodium chloride solution containing $3.5\times10^{-5}$ mol/mol-Ag of $(NH_4)_2Rh(H_2O)Cl_5$ were added simultaneously by a double jet method at an electric potential of 95 mV over 3 minutes and 30 seconds to prepare core grains having a size of 0.12 μm. Thereafter, an aqueous silver nitrate solution and an aqueous sodium chloride solution containing $(NH_4)_2Rh(H_2O)Cl_5$ in an amount of $10.5\times10^{-5}$ mol per mol of gold were added over 7 minutes in the same manner as above to prepare silver chloride cubic grains having an average grain size of 0.15 μm (coefficient of variation: 12%).

Then, thereto $1.5\times10^{-3}$ mol/mol-Ag of 4-hydroxy-6-methyl-1,3,3a,7-tetrazaindene was added.

Further, the emulsion was washed with water by a flocculation method well known in the art to remove soluble salts, then gelatin was added and without subjecting the emulsion to chemical sensitization, 50 mg/mol-Ag of the following Compound (g) and 50 mg/mol-Ag of phenoxyethanol as an antiseptic and $3\times10^{-3}$ mol/mol-Ag of 4-hydroxy-6-methyl-1,3,3a,7-tetrazaindene as a stabilizer were added (pH=5.7, pAg=7.5, Rh=$6\times10^{-5}$ mol/mol-Ag).

Preparation of Coating Solution for Emulsion Layer and Coating of the Solution

To Emulsion C, the following compounds were added and the mixture was coated to provide a silver halide emulsion layer having a gelatin coated amount of 1.1 g/m² and a coated silver amount of 25 g/m².

| | |
|---|---|
| 4-Hydroxy-6-methyl-1,3,3a,7-tetrazaindene | 10 mg/m² |
| N-Oleyl-N-methyltaurine sodium salt | 35 mg/m² |
| Compound (h) | 10 mg/m² |
| Compound (i) | 20 mg/m² |
| P-4 | 900 mg/m² |
| Compound (j) (hardening agent) | 150 mg/m² |

The nucleation accelerator and the nucleating agent shown in Table 3 were added to give a coated amount of $4.0\times10^{-5}$ mol/m² and $4.5\times10^{-5}$ mol/m², respectively.

On the thus-provided emulsion layer, an emulsion protective lower and upper layers were coated.

Preparation of Coating Solution of Emulsion Protective Lower Layer and Coating of the Solution To an aqueous gelatin solution, the following compounds were added and the solution was coated to give a gelatin coated amount of 0.7 g/m².

| | |
|---|---|
| Gelatin ($Ca^{++}$ content: 2,700 ppm) | 0.7 g/m² |
| Sodium p-dodecylbenzenesulfonate | 15 mg/m² |
| Compound (g) | 5 mg/m² |
| Compound (l) | 10 mg/m² |
| Compound (m) | 20 mg/m² |

Preparation of Coating Solution of Emulsion Protective Upper Layer and Coating of the Solution To an aqueous gelatin solution, the following compounds were added and the solution was coated to give a gelatin coated amount of 0.8 g/m².

| | |
|---|---|
| Gelatin ($Ca^{++}$ content: 2,700 ppm) | 0.8 g/m$^2$ |
| Amorphous silica matting agent (average particle size: 3.5 μm, pore diameter: 25Å, surface area: 700 m$^2$/g) | 40 mg/m$^2$ |
| Amorphous silica matting agent (average particle size: 2.5 μm, pore diameter: 170Å, surface area: 300 m$^2$/g) | 10 mg/m$^2$ |
| Potassium N-perfluoroctanesulfonyl-N-propylglycine | 5 mg/m$^2$ |
| Sodium dodecylbenzenesulfonate | 30 mg/m$^2$ |
| Compound (g) | 5 mg/m$^2$ |
| Solid Disperse Dye-$G_1$ | 100 mg/m$^2$ |
| Solid Disperse Dye-$G_2$ | 50 mg/m$^2$ |

Then, on the opposite surface of the support, an electrically conductive layer and a back layer described below were coated simultaneously.

Preparation of Coating Solution of Electrically Conductive Layer and Coating of the Solution To an aqueous gelatin solution, the following compounds were added and the solution was coated to give a gelatin coated amount of 77 mg/m$^2$.

| | |
|---|---|
| $SnO_2$/Sb (9/1 by weight, average particle size: 0.25 μm) | 200 mg/m$^2$ |
| Gelatin ($Ca^{++}$ content: 3,000 ppm) | 77 g/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| Compound (g) | 7 mg/m$^2$ |

Preparation of Coating Solution for Back Layer and Coating Thereof

To an aqueous gelatin solution, the following compounds were added and the solution was coated to give a gelatin coated amount of 2.92 g/m$^2$.

| | |
|---|---|
| Gelatin ($Ca^{++}$ content: 30 ppm) | 2.92 g/m$^2$ |
| Polymethyl methacrylate fine particle (average particle size: 3.4 μm) | 54 mg/m$^2$ |
| Compound (h) | 140 mg/m$^2$ |
| Compound (r) | 140 mg/m$^2$ |
| Compound (s) | 40 mg/m$^2$ |

-continued

| | |
|---|---|
| Sodium dodecylbenzenesulfonate | 75 mg/m$^2$ |
| Sodium dihexyl-α-sulfosuccinate | 20 mg/m$^2$ |
| Compound (t) | 5 mg/m$^2$ |
| Potassium N-perfluoroctanesulfonyl-N-propylglycine | 5 mg/m$^2$ |
| Sodium sulfate | 50 mg/m$^2$ |
| Sodium acetate | 85 mg/m$^2$ |

(Support and Undercoat Layer)

On both surfaces of a biaxially stretched polyethylene terephthalate support (thickness: 100 μm), undercoat first and second layers each having the following composition were coated.

| Undercoat First Layer: | |
|---|---|
| Core-shell Type Vinylidene Chloride Copolymer (i) | 15 g |
| 2,4-Dichloro-6-hydroxy-s-triazine | 0.25 g |
| Polystyrene fine particle (average particle size: 3 μm) | 0.05 g |
| Compound (u) | 0.20 g |
| Colloidal silica (Snowtex ZL, produced by Nissan Chemical KK, particle size: 70 to 100 μm) | 0.12 g |
| Water to make | 100 g |

Further, the coating solution was adjusted to have a pH of 6 by adding 10 wt % of KOH and coated to give a dry thickness of 0.9 μm at a drying temperature of 180° C. within 2 minutes.

| Undercoat Second Layer | |
|---|---|
| Gelatin | 1 g |
| Methyl cellulose | 0.05 g |
| Compound (v) | 0.02 g |
| $C_{12}H_{25}O(CH_2CH_2O)_{10}H$ | 0.03 g |
| Compound (g) | $3.5 \times 10^{-3}$ g |
| Acetic acid | 0.2 g |
| Water to make | 10.0 g |

The thus-obtained coating solution was coated to give a dry thickness of 0.1 μm at a drying temperature of 170° C. for 2 minutes.

(f)

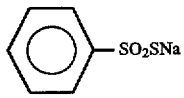

(g)

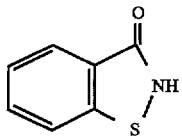

(h)

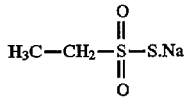

(i)

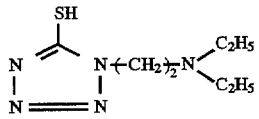

(j)

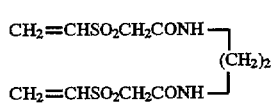

-continued
(k)
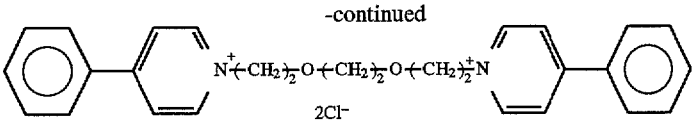
(l)
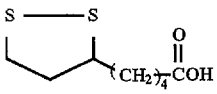
(m)
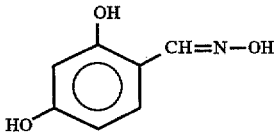
Solid Disperse Dye $G_1$
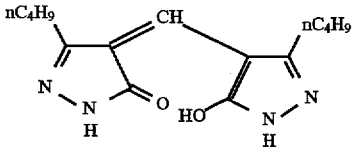
Solid Disperse Dye $G_2$
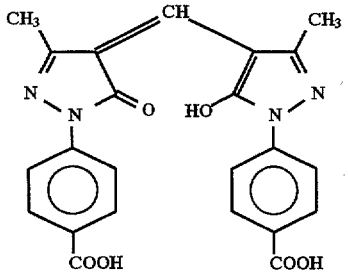
(n)
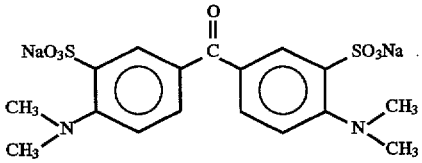
(r)
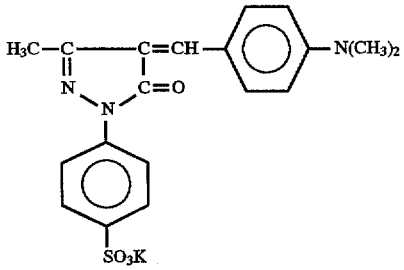
(s)
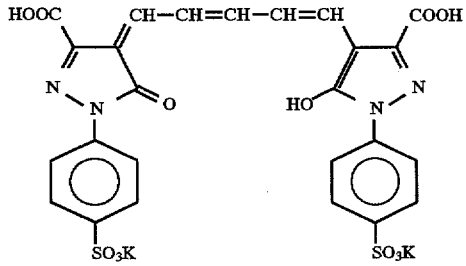
$C_8F_{17}SO_3Li$ (t)

-continued

Core-shell Type Vinylidene Chloride Copolymer (i)

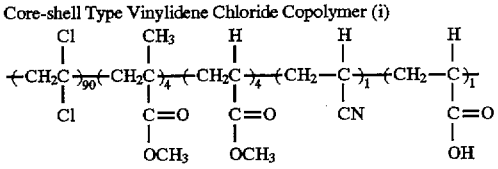

VDC MMA MA AN AA

Core: VDC/MMA/MA (80 wt%)
Shell: VDC/AN/AA (20 wt%)
Average particle size: 70 nm

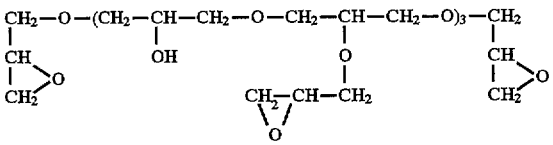

(u)

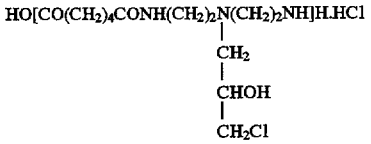

(v)

Evaluation of Photographic Performance (1) Exposure and Development

The thus-obtained samples each was exposed through an optical wedge using P-627FM Printer manufactured by Dai-nippon Screen KK and then processed with Developer A described in Example 1 in an automatic processor FG-680AG manufactured by Fuji Photo Film Co., Ltd. at 38° C. for 20 seconds, followed by fixing, water washing and drying. The fixing solution used was the same as used in Example 1.

The contract of an image and the storability were evaluated in the same manner as in Example 1.

TABLE 3

| No. | Nucleating Agent | Nucleation Accelerator | γ | Storability: Nucleating Agent Residual Rate | Storability: $\Delta S_{1.5}$ | Pressure Property | Remarks |
|---|---|---|---|---|---|---|---|
| 301 | Comparative Compound H-E | Comparative Compound A-A | 10.8 | 92 | 0.02 | 2 | Comparison |
| 302 | Comparative Compound H-E | Comparative Compound A-C | 11.4 | 91 | 0.01 | 2 | Comparison |
| 303 | Comparative Compound H-E | A-215 | 12.1 | 94 | 0.02 | 1 | Comparison |
| 304 | Comparative Compound H-F | Comparative Compound A-A | 13.6 | 50 | 0.12 | 1 | Comparison |
| 305 | Comparative Compound H-F | Comparative Compound A-B | 12.7 | 52 | 0.11 | 2 | Comparison |
| 306 | Comparative Compound H-F | A-215 | 18.6 | 61 | 0.10 | 2 | Comparison |
| 307 | Comparative Compound H-G | Comparative Compound A-A | 14.2 | 48 | 0.09 | 1 | Comparison |
| 308 | Comparative Compound H-G | Comparative Compound A-C | 13.8 | 48 | 0.09 | 1 | Comparison |
| 309 | Comparative Compound H-G | A-215 | 19.4 | 60 | 0.06 | 2 | Comparison |
| 310 | H-8 | Comparative Compound A-A | 19.1 | 81 | 0.04 | 3 | Comparison |
| 311 | H-8 | Comparative Compound A-C | 17.6 | 83 | 0.04 | 3 | Comparison |
| 312 | H-8 | A-205 | 18.2 | 96 | 0.01 | 5 | Invention |
| 313 | H-8 | A-215 | 18.4 | 94 | 0.01 | 5 | Invention |
| 314 | H-8 | A-256 | 17.6 | 94 | 0.01 | 5 | Invention |
| 315 | H-7 | A-214 | 17.3 | 93 | 0 | 5 | Invention |
| 316 | H-7 | A-264 | 19.4 | 96 | 0 | 5 | Invention |
| 317 | H-9 | A-217 | 19.1 | 95 | 0 | 5 | Invention |
| 318 | H-9 | A-259 | 18.7 | 92 | 0.01 | 5 | Invention |
| 319 | H-10 | A-215 | 19.2 | 91 | 0.02 | 5 | Invention |
| 320 | H-10 | A-258 | 19.3 | 96 | 0 | 5 | Invention |
| 321 | H-13 | A-215 | 19.6 | 97 | 0 | 5 | Invention |

TABLE 3-continued

| No. | Nucleating Agent | Nucleation Accelerator | γ | Storability: Nucleating Agent Residual Rate | Storability: $\Delta S_{1.5}$ | Pressure Property | Remarks |
|---|---|---|---|---|---|---|---|
| 322 | H-13 | A-264 | 17.1 | 91 | 0.02 | 5 | Invention |
| 323 | H-21 | A-217 | 18.4 | 92 | 0.01 | 5 | Invention |
| 324 | H-21 | A-256 | 19.3 | 95 | 0 | 5 | Invention |
| 325 | H-22 | A-214 | 18.3 | 93 | 0.01 | 5 | Invention |
| 326 | H-22 | A-262 | 19.4 | 97 | 0 | 5 | Invention |
| 327 | H-24 | A-215 | 19.1 | 96 | 0 | 5 | Invention |
| 328 | H-24 | A-260 | 18.5 | 98 | 0 | 5 | Invention |

Results

By using the nucleating agent and the nucleation accelerator of the present invention in combination, bright room light type light-sensitive materials for contact work having a high γ value and good storability could be obtained.

EXAMPLE 7

The light-sensitive materials prepared in Examples 1 to 6 were developed under the conditions in respective Examples using the following Developer B or C in place of Developer A used in Examples 1 to 6.

| Developer B: | |
|---|---|
| Potassium hydroxide | 35 g |
| Diethylenetriaminepentaacetic acid | 2 g |
| Potassium carbonate | 100 g |
| Potassium bromide | 3 g |
| 5-Methylbenzotriazole | 0.08 g |
| Sodium 2-Mercaptobenzimidazole-5-sulfonate | 0.15 g |
| 2,3,5,6,7,8-Hexahydro-2-thioxo-4-(1H)-quinazolinone | 0.03 g |
| Sodium metabisulfite | 54 g |
| 4-Hydroxymethy1-4-methyl-1-phenyl-3-pyrazolidone | 0.45 g |
| Hydroquinone | 30 g |
| Sodium erysorbate | 3 g |
| Water to make | 1 l |
| pH adjusted | 10.5 |
| **Developer C:** | |
| Sodium hydroxide | 10.0 g |
| Diethylenetriaminepentaacetic acid | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |
| Sodium 2-mercaptobenzimidazole-5-sulfonate | 0.15 g |
| 4-Hydroxymethyl-4-methyl-1-phenyl-3 pyrazolidone | 0.40 g |
| Sodium erysorbate | 30.0 g |
| Water to make | 1 l |
| pH adjusted by adding potassium hydroxide | 10.5 |

Developer B was prepared using a processing agent stored in the form of solid.

The solid processing agent was produced by forming ingredients of a developer into solids and packing a laminate of the solids into a bag formed of a plastic material coated with an aluminum foil. The order of layers in laminating was as follows from the upper side:

First layer hydroquinone

Second layer other ingredients

Third layer sodium bisulfite

Fourth layer potassium carbonate

Fifth layer potassium hydroxide pellets

The bag was evacuated according to a usual method to vacuumize the system and sealed.

Results

Similar results to those with Developer A were obtained even when the development processing in Examples 1 to 6 was conducted using Developer B or C.

EXAMPLE 8

Preparation of Silver Halide Light-sensitive Material

Preparation of Emulsion

Emulsion A was prepared in the same manner as in Example 1.

Preparation of Coated Sample

On a polyethylene terephthalate film support undercoated by a moisture-proofing layer containing vinylidene chloride, a UL layer, an EM layer, a PC layer and an OC layer were coated in this order from the support side to prepare a coated sample.

The preparation method and the coating amount of each layer are described below.

(UL Layer)

To an aqueous gelatin solution, 30 wt % on a gelatin basis of polyethyl acrylate dispersion was added, and the resulting solution was coated to give a gelatin coverage of 0.5 g/m$^2$.

(EM Layer)

To Emulsion A, $5\times10^{-4}$ mol/mol-Ag of the following Compound (S-1) and $5\times10^{-4}$ mol/mol-Ag of Compound (S-2) as sensitizing dyes, $3\times10^{-4}$ mol/mol-Ag of a mercapto compound shown below as Compound (a), $4\times10^{-4}$ mol/mol-Ag of a mercapto compound shown below as Compound (b), $4\times10^{-4}$ mol/mol-Ag of a triazine compound shown below as Compound (c), $2\times10^{-3}$ mol/mol-Ag of 5-chloro-8-hydroxyquinoline, $5\times10^{-4}$ mol/mol-Ag of the following Compound (p), and $4\times10^{-4}$ mol/mol-Ag of the following Compound (A) as a nucleation accelerator were added. Further, hydroquinone and an N-oleyl-N-methyltaurine sodium salt were added to give a coated amount of 100 and 30 mg/m$^2$, respectively. Thereafter, $1\times10^{-5}$ mol/m$^2$ of a nucleating agent (a hydrazine derivative) of the present invention or for comparison shown in Table 4, 200 mg/m$^2$ of a water-soluble latex shown below as Compound (d), 200 mg/m$^2$ of a polyethyl acrylate dispersion, 200 mg/m$^2$ of a latex copolymer of methyl acrylate, 2-acrylamido-2-methylpropanesulfonato sodium salt and 2-acetoacetoxyethyl methacrylate (weight ratio: 88:5:7), 200 mg/m$^2$ of colloidal silica having an average particle size of 0.02 μm, 30 mg/m$^2$ of sodium dodecylbenzenesulfonate, and 200 mg/m$^2$ of 1,3-divinylsulfonyl-2-propanol as a hardening agent were added. The pH of the resulting solution was adjusted to 5.65 by adding an acetic acid. The solution was coated to give a coated silver amount of 3.5 g/m$^2$.

TABLE 4

| | Sample | Compound added to EM Layer |
|---|---|---|
| 1 | 8-1 | — |
| 2 | 8-2 | Comparative Nucleating Agent-a |
| 3 | 8-3 | Comparative Nucleating Agent-b |
| 4 | 8-4 | H-2 (Invention) |
| 5 | 8-5 | H-3 (Invention) |
| 6 | 8-6 | H-8 (Invention) |
| 7 | 8-7 | H-13 (Invention) |

(PC Layer)

To an aqueous gelatin solution, 50 wt % on a gelatin basis of an ethyl acrylate dispersion, Surface Active Agent (w') shown below and 1,5-dihydroxy-2-benzaldoxime in an amount necessary for giving a coated amount of 5 mg/m$^2$ and 10 mg/m$^2$, respectively, were added, and the resulting solution was coated to give a gelatin coverage of 0.5 g/m$^2$.

(OC Layer)

0.5 g/m$^2$ of gelatin, 40 mg/m$^2$ of an amorphous $SiO_2$ matting agent having an average particle size of about 3.5 μm, 0.1 g/m$^2$ of methanol silica, 100 mg/m$^2$ of polyacrylamide, 20 mg/m$^2$ of silicone oil, and as coating aids, 5 mg/m$^2$ of a fluorine surface active agent shown below by chemical formula (e) and 100 mg/m$^2$ of sodium dodecylbenzenesulfonate, were coated.

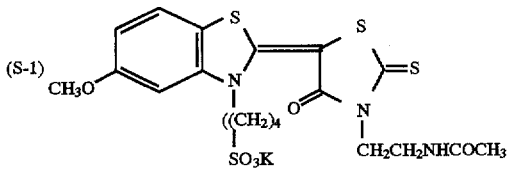

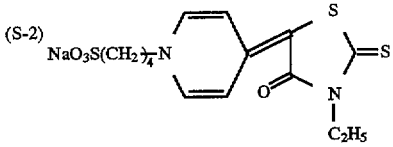

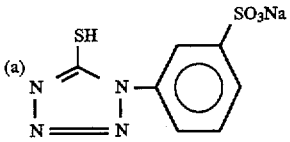

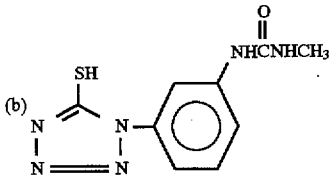

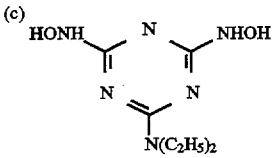

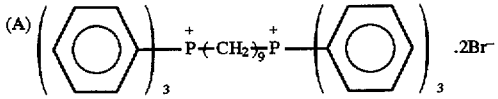

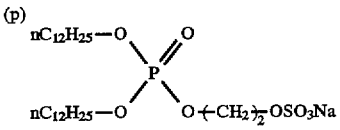

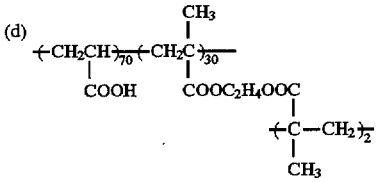

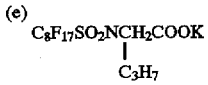

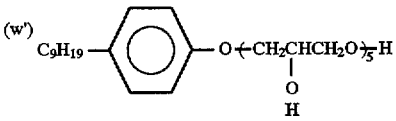

Comparative Nucleating Agent-a

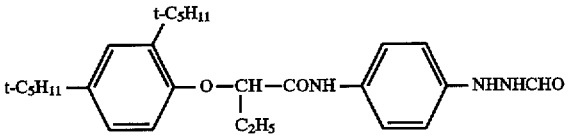

-continued

Comparative Nucleating Agent-b

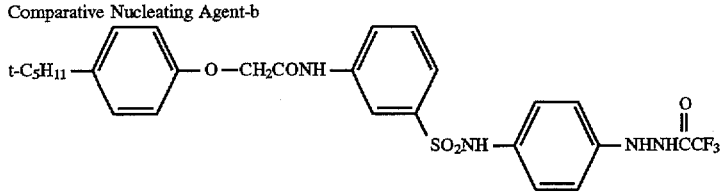

The coated samples each had a back layer and a back protective layer having the same compositions as those used in Example 1.

Evaluation of Photographic Performance (1) Exposure and Development

The thus-prepared samples each was exposed to a xenon flash light using a step wedge through an interference filter having a peak at 488 nm for a luminescence time of $10^{-5}$ sec and then developed with Developer $A_O$, $B_O$, $C_O$ or $D_O$ shown in Table 5 at 35° C. for 30 seconds, followed by fixing, water washing and drying. In Table 5, the amount of sodium metabisulfite is 0.105 mol/l.

The fixing solution used in Example 1 was used.

TABLE 5

| | Developer-$A_0$ (g) | Developer-$B_0$ (g) | Developer-$C_0$ (g) | Developer-$D_0$ (g) |
|---|---|---|---|---|
| Potassium hydroxide | 25.0 | 25.0 | 25.0 | 25.0 |
| Diethylenetriaminepentaacetic acid | 2.0 | 2.0 | 2.0 | 2.0 |
| Potassium carbonate | 42.0 | 42.0 | 42.0 | 42.0 |
| Sodium metabisulfite | 20.0 | 20.0 | 20.0 | 20.0 |
| Potassium bromide | 1.0 | 1.0 | 1.0 | 1.0 |
| Hydroquinone | — | — | 25.0 | 25.0 |
| Sodium hydroquinonemonosulfonate | 8.0 | 8.0 | — | — |
| 5 -Methylbenzotriazole | 1.0 | 1.0 | 1.0 | 1.0 |
| N-Methyl-p-aminophenol | 4.5 | — | 1.5 | 1.5 |
| Boric acid | 12.0 | 12.0 | 12.0 | 12.0 |
| Sodium erysorbate | 30.0 | 30.0 | — | 3.1 |
| 4-Hydroxymethyl-4-methyl-1-phenyl-3-pyrazolidone | — | 1.5 | — | — |
| Water to make (pH was adjusted to 9.8) | | 1.0 l | | |

(2) Evaluation of Contrast of Image

With respect to the index (γ) for showing the contrast of an image, a point giving fog+density of 0.1 in a characteristic curve and a point giving fog+density of 3.0 were connected by a straight line and the gradient of the straight line was shown as the γ value. In other words, γ=(3.0–0.1)/[log(exposure amount necessary for giving density of 3.0)–(exposure amount necessary for giving density of 0.1)], and the larger the γ value, the higher the contrast. As the light-sensitive material for graphic arts, the γ value is preferably 10 or more, more preferably 15 or more.

(3) Evaluation of Dot Quality (DQ)

The dots of each light-sensitive material exposed through a contact screen were observed though a magnifier and the sharpness and the smoothness were evaluated by 5-rank rating. [5] indicates that the sharpness and the smoothness both are on a highest level and [1] indicates that they are on a lowest level. Samples on a level of [3] or higher are tolerable in practical use with respect to the sharpness and the smoothness on the on/off area of an image upon actual scanner exposure.

(4) Evaluation of Dependency on pH of Developer

Samples developed with Developer $A_O$ and showing high contrast such that the γ value was 10 or more were evaluated with respect to the dependency on pH of the developer. Based on Developer $A_O$, Developer $A_O$-II lowered in the pH by 0.2 and Developer $A_O$-III increased in the pH by 0.2 were prepared. The dependency on pH was evaluated by the difference (ΔS) between the sensitivity with Developer $A_O$ and the sensitivity with Developer $A_O$-II or $A_O$-III. The smaller the difference, the smaller the dependency on pH and the better.

Results

The results obtained are shown in Tables 6 and 7 below.

TABLE 6

| Light-sensitive Material | | Developer | Contrast (γ) | Dmax | Dot Quality |
|---|---|---|---|---|---|
| Sample | 8-1 | $A_0$ | 5.1 | 3.28 | 2 |
| | 8-2 | | 6.0 | 3.50 | 2 |
| | 8-3 | | 15.0 | 4.65 | 5 |
| | 8-4 | | 18.6 | 4.89 | 5 |
| | 8-5 | | 18.0 | 4.91 | 5 |
| | 8-6 | | 19.3 | 4.73 | 5 |
| | 8-7 | | 15.7 | 4.71 | 5 |
| Sample | 8-1 | $B_0$ | 5.3 | 3.30 | 2 |
| | 8-2 | | 6.1 | 3.53 | 2 |
| | 8-3 | | 14.2 | 4.53 | 5 |
| | 8-4 | | 17.6 | 4.77 | 5 |
| | 8-5 | | 17.5 | 4.74 | 5 |
| | 8-6 | | 18.0 | 4.69 | 5 |
| | 8-7 | | 15.5 | 4.64 | 5 |
| Sample | 8-1 | $C_0$ | 5.0 | 3.25 | 2 |
| | 8-2 | | 5.4 | 3.31 | 2 |
| | 8-3 | | 5.7 | 3.27 | 2 |
| | 8-4 | | 5.7 | 3.41 | 2 |
| | 8-5 | | 5.9 | 3.30 | 2 |
| | 8-6 | | 5.6 | 3.30 | 2 |
| | 8-7 | | 5.4 | 3.31 | 2 |
| Sample | 8-1 | $D_0$ | 5.2 | 3.31 | 2 |
| | 8-2 | | 5.5 | 3.35 | 2 |
| | 8-3 | | 5.7 | 3.39 | 2 |
| | 8-4 | | 5.7 | 3.35 | 2 |
| | 8-5 | | 5.9 | 3.41 | 2 |

TABLE 6-continued

| Light-sensitive Material | Developer | Contrast (γ) | Dmax | Dot Quality |
|---|---|---|---|---|
| 8-6 | | 5.7 | 3.37 | 2 |
| 8-7 | | 5.5 | 3.33 | 2 |

TABLE 7

| Light-sensitive Material | Dependency on pH of Developer (ΔS) | |
|---|---|---|
| | −0.2 ($A_O$-II) | +0.2 ($A_O$-III) |
| 8-3 | −0.21 | +0.19 |
| 8-4 | −0.18 | +0.11 |
| 8-5 | −0.10 | +0.03 |
| 8-6 | −0.14 | +0.08 |
| 8-7 | −0.15 | +0.14 |

It is seen from the data in Table 6 that when Samples 8-3 to 8-7 each was developed with Developer $A_O$ or $B_O$, an image of ultrahigh contrast having a γ value of 10 or more, high Dmax and good dot quality could be obtained. Further, it is seen from Table 7 that Samples 8-4 to 8-7 were small in the dependency on pH of the developer and preferred.

EXAMPLE 9

Developers $A_O$-a to $A_O$-f were prepared according to the same formulation as Developer $A_O$ except for changing the amount of sodium metabisulfite as follows.

The numerals in parenthesis are the addition amount (mol/l) of sodium metabisulfite:

$A_O$-a (0.01), $A_O$-b (0.03), $A_O$-c (0.10, the same as Developer $A_O$), $A_O$-d (0.3), $A_O$-e (0.5), $A_O$-f (1.0).

Sample 8-5 prepared in Example 8 was processed using these developers and the results obtained are shown in Table 8. The residual color was determined by visually evaluating the coloration of film when it was processed by cooling the temperature of the fixing solution to 5° C. The evaluation was made by 3-rank rating, more specifically, 1 is the case when the coloration of a dye clearly remained, 2 is the case when it was slightly observed, and 3 is the case when it could not be observed.

The silver sludge of the developer was determined by visually evaluating the developer after 16 $m^2$ of a light-sensitive material was processed using 2 l of a developer without replenishing the developer. Rank 1 indicates the sludge degree such that the turbidity of developer and deposits on the bottom of the developer were observed, rank 2 such that the turbidity of developer was slightly observed, and rank 3 such that the turbidity was not observed at all.

TABLE 8

| | $A_O$-a | $A_O$-b | $A_O$-c | $A_O$-d | $A_O$-e | $A_O$-f |
|---|---|---|---|---|---|---|
| Residual Color | 1 | 3 | 3 | 3 | 3 | 3 |
| Silver Sludge | 3 | 3 | 3 | 3 | 2 | 1 |

As seen from the data in Table 8, good results could be obtained with respect to the residual color and the silver sludge when the sulfite concentration was 0.5 mol/l or less, preferably from 0.03 to 0.3 mol/l.

EXAMPLE 10

Preparation of Silver Halide Light-sensitive Material

Preparation of Emulsion

Emulsion A was prepared in the same manner as in Example 1 above.

Preparation of Coated Sample

On a polyethylene terephthalate film support undercoated by a moisture-proofing layer containing vinylidene chloride, a UL layer, an EM layer, a PC layer and an OC layer were coated in this order from the support side to prepare samples. The UL layer, PC layer, OC layer, back layer, back protecitive layer were provided in the same manner as in Example 1.

The EM layer was provided according to the following method.

(EM Layer)

To Emulsion A prepared above, $5\times10^{-4}$ mol/mol-Ag of the following Compound (S-1) and $5\times10^{-4}$ mol/mol-Ag of Compound (S-2) as sensitizing dyes, $3\times10^{-4}$ mol/mol-Ag of a mercapto compound shown below as Compound (a), $4\times10^{-4}$ mol/mol-Ag of a mercapto compound shown below as Compound (b), $4\times10^{-4}$ mol/mol-Ag of a triazine compound shown below as Compound (c), $2\times10^{-3}$ mol/mol-Ag of 5-chloro-8-hydroxyquinoline, $5\times10^{-4}$ mol/mol-Ag of the following Compound (A), $5\times10^{-4}$ mol/mol-Ag of the following Compound (p), and a contrast accelerator shown in Table 9 were added. Further, hydroquinone and an N-oleyl-N-methyltaurine sodium salt were added to give a coated amount of 100 and 30 mg/$m^2$, respectively. Thereafter, $5\times10^{-4}$ mol/mol-Ag of a nucleating agent shown in Table 9, 200 mg/$m^2$ of a water-soluble latex shown below as Compound (d), 200 mg/$m^2$ of a polyethyl acrylate dispersion, 200 mg/$m^2$ of a latex copolymer of methyl acrylate, 2-acrylamido-2-methylpropanesulfonato sodium salt and 2-acetoacetoxyethyl methacrylate (weight ratio: 88:5:7), 200 mg/$m^2$ of colloidal silica having an average particle size of 0.02 μm, and 200 mg/$m^2$ of 1,3-divinylsulfonyl-2-propanol as a hardening agent were added. The pH of the resulting solution was adjusted to 5.65 by adding an acetic acid. The solution was coated to give a coated silver amount of 3.5 g/$m^2$.

(S-1)

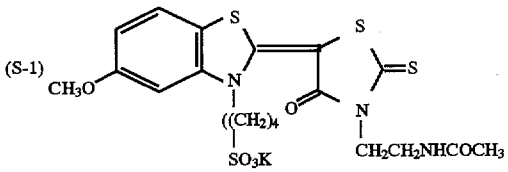

(S-2)

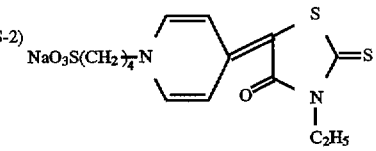

-continued (a)

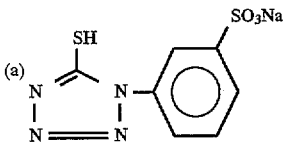

(b)

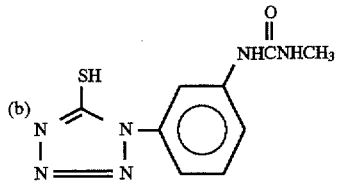

(c)

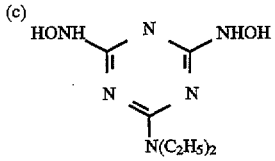

(A)

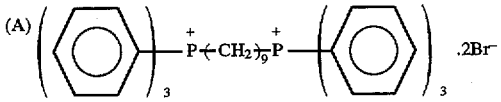

(p)

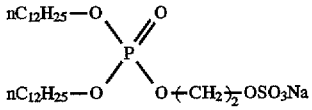

(d)

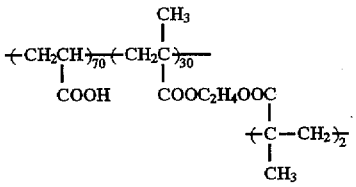

(Comparative compounds as the hydrazine-base nucleating agent)

Comparative Compound B

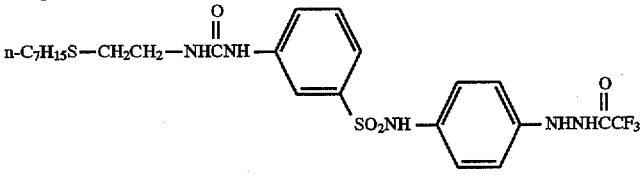

Comparative Compound F

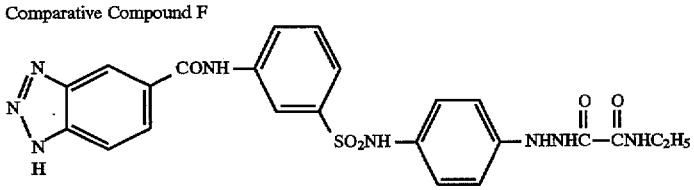

Evaluation of Photographic Performance (1) Exposure and Development

The thus-prepared samples each was exposed to a xenon flash light using a step wedge through an interference filter having a peak at 488 nm for a luminescence time of $10^{-5}$ sec and then developed at 35° C. for 30 seconds, followed by fixing, water washing and drying. The same developer and fixing solution as those used in Example 1 were used.

(2) Contrast of Image

With respect to the index (γ) for showing the contrast of an image, a point giving fog+density of 0.1 in a characteristic curve and a point giving fog+density of 3.0 were connected by a straight line and the gradient of the straight line was shown as the γ value. In other words, γ=(3.0–0.1)/[log(exposure amount necessary for giving density of 3.0)–(exposure amount necessary for giving density of 0.1)], and the larger the γ value, the higher the contrast.

In this Example, the smoothness of dots was evaluated when the nucleation activity was conformed and therefore, the γ value was adjusted to from 18 to 20 by adding an accelerator. When the γ value is higher or lower than this range, the dot smoothness is liable to be worsened.

(3) Evaluation of Dot Smoothness

Plain dots of 50% were output on each coated light-sensitive material with 100 lines using an argon light source color scanner M-656 manufactured by Crossfield Co., the light-sensitive material was developed under the above-described processing conditions, and the smoothness of dots was visually evaluated through a magnifier at a magnification of 200. The evaluation was made by 5-point rating (5: good; 1: bad) and the results obtained are shown in Table 9. The point of 4 or higher is practically required.

TABLE 9

| Run No. | Nucleating Agent No. | Accelerator No. | Accelerator Addition Amount (mmol/mol-Ag) | Photographic Performance γ | Photographic Performance Dot Smoothness | Remarks |
|---|---|---|---|---|---|---|
| 1 | Comparative Compound B | — | — | 7.0 | 1 | Comparison |
| 2 | " | 4-1 | 1.0 | 19.7 | 3 | Comparison |
| 3 | Comparative Compound F | — | — | 6.8 | 1 | Comparison |
| 4 | " | 4-1 | 1.0 | 18.4 | 3 | Comparison |
| 5 | H-3* | — | — | 6.9 | 1 | Comparison |
| 6 | " | 4-1 | 1.0 | 18.6 | 5 | Invention |
| 7 | H-2 | " | " | 18.7 | 5 | Invention |
| 8 | H-10 | " | " | 18.4 | 4 | Invention |
| 9 | H-16 | " | " | 18.8 | 4 | Invention |
| 10 | H-22 | " | " | 18.9 | 4 | Invention |
| 11 | H-23 | " | " | 19.9 | 5 | Invention |
| 12 | H-3* | 1-8 | 1.0 | 19.3 | 4 | Invention |
| 13 | " | 2-13 | 0.8 | 19.1 | 4 | Invention |
| 14 | " | 3-6 | 1.2 | 18.5 | 4 | Inventton |
| 15 | " | 5-1 | 0.8 | 19.2 | 4 | Invention |
| 16 | " | 6-1 | 1.0 | 18.3 | 5 | Invention |
| 17 | " | 7-5 | 1.0 | 18.9 | 5 | Invention |

*K salt

Results

It is seen from the results in Table 9 that only when the nucleating agent and the accelerator of the present invention were used in combination, a great improvement in the dot smoothness was unexpectedly obtained.

According to the constitution of the present invention, a light-sensitive material for argon laser scanner having a high γ value and good dot smoothness could be obtained.

EXAMPLE 11

Preparation of Silver Halide Light-sensitive Material

Preparation of Emulsion

| [Emulsion $A_1$] | |
|---|---|
| Solution 1: | |
| Water | 750 ml |
| Gelatin | 20 g |
| Sodium chloride | 2 g |
| 1,3-Dimethylimidazolidine-2-thione | 20 mg |
| Sodium thiosulfonate | 10 mg |
| Solution 2: | |
| Water | 300 ml |
| Silver nitrate | 150 g |
| Solution 3: | |
| Water | 300 ml |
| Sodium chloride | 38 g |
| Potassium bromide | 32 g |
| $K_3IrCl_6$ | 0.25 mg |
| $K_2Rh(H_2O)Cl_5$ | 0.07 mg |
| Solution 4: | |
| Water | 100 ml |
| Silver nitrate | 50 g |
| Solution 5: | |
| Water | 100 ml |
| Sodium chloride | 14 g |
| Potassium bromide | 11 g |

To Solution 1 kept at 38° C. and a pH of 4.5, Solution 2 and Solution 3 each in an amount corresponding to 90% were added simultaneously while stirring over 20 minutes to form core grains having a size of 0.19 μm. Subsequently, Solution 4 and Solution 5 described below were added over 8 minutes and then Solution 2 and Solution 3 each in an amount corresponding to the remaining 10% were added over 2 minutes to obtain silver chlorobromide grains having an average grain size of 0.22 μm and a silver chloride content of 70 mol %.

Thereafter, $1\times10^{-3}$ mol of a KI solution was added to the resulting emulsion to effect conversion, then the emulsion was washed with water by a flocculation method in a usual manner, 40 g/mol-Ag of gelatin was added thereto, further 7 mg/mol-Ag of sodium benzenethiosulfonate and 2 mg/mol-Ag of benzene-sulfinic acid were added, the pH and the pAg were adjusted to 5.7 and 7.5, respectively, and the emulsion was subjected to chemical sensitization by adding 1 mg/mol-Ag of sodium thiosulfate, Compound (CS-A) and 5 mg of chloroauric acid so as to show optimal sensitivity at 55° C. Then, 150 mg of 4-hydroxy-6-methyl-1,3,3a,7-tetrazaindene as a stabilizer and 100 mg of Proxel as an antiseptic were added. The resulting grains had an average grain size of 0.22 μm and each grain was a silver iodochlorobromide cubic grain having a silver chloride content of 70 mol % (coefficient of variation: 10%).

Compound (CS-A)

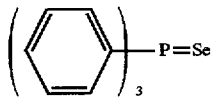

Preparation of Coated Sample

On a polyethylene terephthalate film support undercoated by a moisture-proofing layer containing vinylidene chloride, a UL layer, an EM layer, a PC layer and an OC layer were coated in this order from the support side to prepare a sample.

The preparation method and the coating amount of each layer are described below.

(UL Layer)

As a UL layer, 0.5 g/m$^2$ of gelatin, 150 mg/m$^2$ of a polyethyl acrylate dispersion and 5 mg/m$^2$ of the following dye [a] were coated.

(EM layer)

To the emulsion prepared above, $5\times10^{-4}$ mol/mol-Ag of a sensitizing dye shown in Table 10, 5 mg/mol-Ag of KBr, $3\times10^{-4}$ mol/mol-Ag of a mercapto compound shown below as Compound (a), $4\times10^{-4}$ mol/mol-Ag of a mercapto compound shown below as Compound (b), $4\times10^{-4}$ mol/mol-Ag of a triazine compound shown below as Compound (c), $2\times10^{-3}$ mol/mol-Ag of 5-chloro-8-hydroxyquinoline, $1\times10^{-4}$ mol/mol-Ag of a hydrazine nucleating agent shown in Table 10, and as nucleation accelerators, $4\times10^{-4}$ mol/mol-Ag of Compound A-1 shown below and $4\times10^{-4}$ mol of Compound A-2 shown below were added. Further, hydroquinone, N-oleyl-N-methyltaurine sodium salt, sodium dodecylbenzenesulfonate, Compound (d) and colloidal silica having an average particle size of 0.02 μm were added to give a coated amount of 100 mg/m$^2$, 20 mg/m$^2$, 20 mg/m$^2$, 15 mg/m$^2$ and 200 mg/m$^2$, respectively. Thereafter, 200 mg/m$^2$ of a water-soluble latex shown below as Compound (e), 200 mg/m$^2$ of a polyethyl acrylate dispersion, 200 mg/m$^2$ of a latex copolymer of methyl acrylate, 2-acrylamido-2-methylpropane-sulfonato sodium salt and 2-acetoacetoxyethyl methacrylate (weight ratio: 88:5:7), and 200 mg/m$^2$ of 1,3-divinylsulfonyl-2-propanol as a hardening agent were added. The pH of the resulting solution was adjusted to 5.5 by adding an acetic acid. The solution was coated to give a coated silver amount of 3.5 g/m$^2$ and a gelatin coverage of 1.5 g/m$^2$.

(PC Layer)

0.5 g/m$^2$ of gelatin, 250 mg/m$^2$ of a polyethyl acrylate dispersion, 5 mg/m$^2$ of sodium ethylsulfonate and 10 mg/m$^2$ of 1,5-dihydroxy-2-benzaldoxime were coated.

(OC Layer)

0.3 g/m$^2$ of gelatin, 40 mg/m$^2$ of an amorphous $SiO_2$ matting agent having an average particle size of about 3.5 μm, 100 mg/m$^2$ of colloidal silica having an average particle size of 0.02 μm, 100 mg/m$^2$ of methanol silica, 100 mg/m$^2$ of polyacrylamide, 20 mg/m$^2$ of silicone oil, 30 mg/m$^2$ of Compound (f) shown below, and as coating aids, 5 mg/m$^2$ of a fluorine surface active agent shown below by chemical formula (g) and 50 mg/m$^2$ of sodium dodecylbenzenesulfonate were coated.

Dye [a]

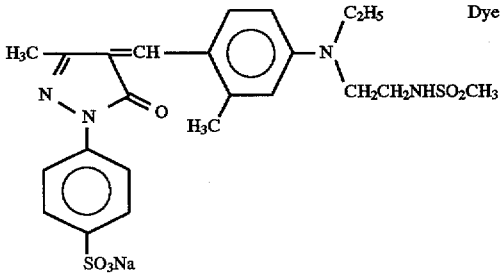

(a)

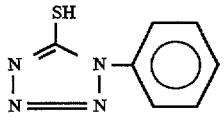

(b)

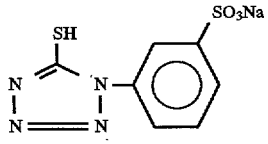

-continued (c)

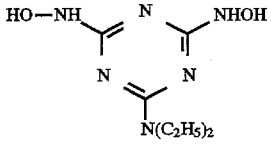

(d)

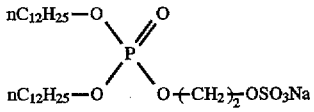

(e)

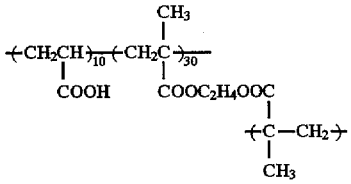

(f)

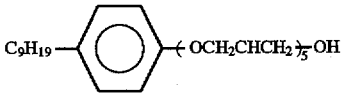

(g)

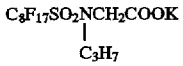

A-1

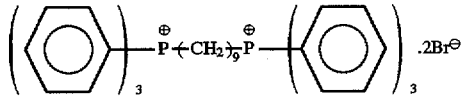

A-2)

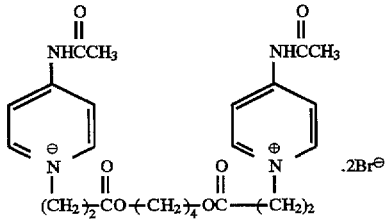

The coated samples each had a back layer and a back protective layer having the following compositions.

[Formulation of Back Layer]

| | |
|---|---|
| Gelatin | 3 g/m$^2$ |
| Latex: polyethyl acrylate | 2 g/m$^2$ |
| Surface active agent: sodium p-dodecylbenzenesulfonate | 40 mg/m$^2$ |
| Compound [a] | 110 mg/m$^2$ |

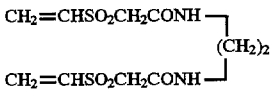

| | |
|---|---|
| $SnO_2$/Sb (weight ratio: 90/10, average particle size: 0.20 μm) | 200 mg/m$^2$ |

Dye: a mixture of Dyes [b], [c] and [d]

| | |
|---|---|
| Dye [b] | 100 mg/m$^2$ |
| Dye [c] | 30 mg/m$^2$ |
| Dye [d] | 60 mg/m$^2$ |

Dye [b]

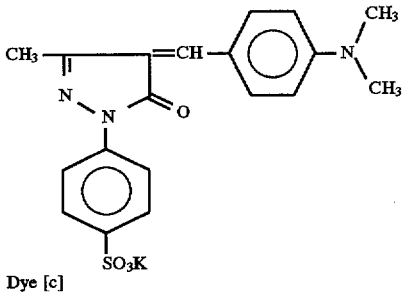

Dye [c]

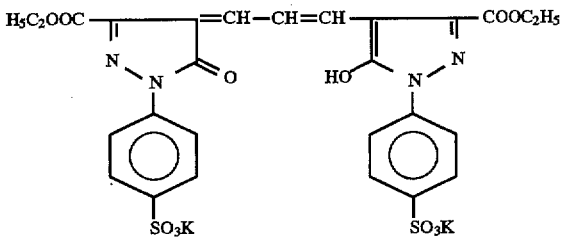

Dye [d]

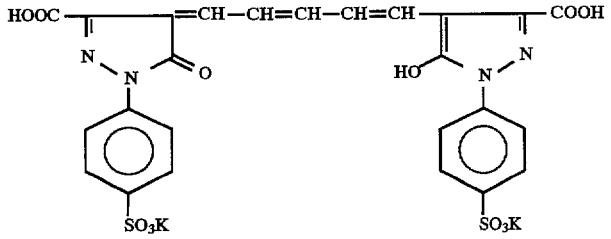

[Back Protective Layer]

| | |
|---|---|
| Gelatin | 0.8 mg/m$^2$ |
| Polymethyl methacrylate fine particle (average particle size: 4.5 μm) | 30 mg/m$^2$ |
| Dihexyl-α-sulfosuccinato sodium salt | 15 mg/m$^2$ |
| Sodium p-dodecylbenzenesulfonate | 15 mg/m$^2$ |
| Sodium acetate | 40 mg/m$^2$ |

Exposure and Development

(1) Evaluation of Photographic Performance

The thus-prepared samples each was exposed to a xenon flash light using a step wedge through an interference filter having a peak at 488 nm for a luminescence time of $10^{-5}$ sec and then developed (at 35° C. for 30 seconds), fixed, water washed and dried in an automatic processor FG-680AG manufactured by Fuji Photo Film Co., Ltd. The developer and the fixing solution used each had the following composition.

| Formulation of Developer (Developer A'): | |
|---|---|
| Potassium hydroxide | 35.0 g |
| Diethylenetriaminepentaacetic acid | 2.0 g |
| Sodium metabisulfite | 40.0 g |
| Potassium carbonate | 40.0 g |
| Potassium bromide | 3.0 g |
| 5-Methylbenzotriazole | 0.08 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Hydroquinone | 25.0 g |
| 4-Hydroxymethyl-4-methyl-1-phenyl-3-pyrazolidone | 0.45 g |
| Sodium erysorbate | 3.0 g |
| Diethylene glycol | 20.0 g |
| Water to make | 1 l |
| pH adjusted by adding potassium hydroxide | 10.45 |
| **Formulation of Fixing Solution:** | |
| Ammonium thiosulfate | 359.1 g |
| Disodium ethylenediaminetetraacetate dihydrate | 0.09 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH (adjusted by sulfuric acid or sodium hydroxide) | 4.85 |
| Water to make | 3 l |

The sensitivity was shown by a relative value to the reciprocal of the exposure amount necessary for giving a density of 1.5 and the larger the value, the higher the sensitivity. With respect to the index (γ) for showing the contrast of an image, a point giving fog+density of 0.3 in a characteristic curve and a point giving fog+density of 3.0 were connected by a straight line and the gradient of the straight-line was shown as the γ value. In other words, γ=(3.0–0.3)/[log(exposure amount necessary for giving density of 3.0)–log(exposure amount necessary for giving density of 0.3)], and the larger the γ value, the higher the contrast.

(2) Evaluation of Black Pepper

The black pepper was evaluated according to 5-rank rating by observing the expression area through a microscope, and "5" indicates the highest level where black pepper was not generated at all and "1" indicates the lowest quality where black pepper was generated tremendously. The rank "3" is a limiting level where the generation of black pepper is tolerable in practical use.

(3) Evaluation of Safety for Safelight

Light of 20 Lux was illuminated using SLF-1B (safelight for yellow light) manufactured by Fuji Photo Film Co., Ltd. and the time until the fog increased was determined. The larger the value, the better the safety for safelight.

(4) Evaluation of Running Stability

The processing and the evaluation were conducted in the same manner as in (1) evaluation of the photographic performance except for using the following Fatigue Developer 1 or 2 in place of Developer A'.

Fatigue Developer 1

A sample having a blacking ratio of 80% was processed with Developer A' at a processing rate of 50 $m^2$ per day while replenishing the developer in an amount of 160 ml/$m^2$ using an automatic processor FG-680A manufactured by Fuji Photo Film Co., Ltd. and the developer after running until 300 $m^2$ in total of sample was processed was used as Fatigue Developer 1.

Fatigue Developer 2

A sample having a blacking ratio of 20% was processed with Developer A' at a processing rate of 5 $m^2$ per day while replenishing the developer in an amount of 160 ml/$m^2$ using an automatic processor FG-680A and the developer after running until 300 $m^2$ in total of sample was processed was used as Fatigue Developer 2.

(5) Evaluation of Storability

The samples prepared above each was allowed to stand under conditions of 60° C. and 65% RH for 3 days and then the photographic properties were evaluated in the same conditions as in item (1) above. The change in sensitivity is shown by a variation from the sensitivity, taken as 100, of a sample aged at normal temperature for 3 days.

TABLE 10

| | | | Photographic Properties | | | | | | | | | | After Enforced Aging | |
|---|---|---|---|---|---|---|---|---|---|---|---|---|---|---|
| | | Hydrazine | (Developer A) | | | | Fatigue Developer 1 | | | Fatigue Developer 2 | | | Change in | |
| No. | Sensitizin Dye | Nucleating Agent | Sensitivity | γ | Black Pepper | Safelight | Sensitivity | γ | Black Pepper | Sensitivity | γ | Black Pepper | Sensitivity | γ |
| 1 | I-5 | H-3 | 100 | 23 | 5 | >20' | 98 | 22 | 5 | 103 | 24 | 5 | +2 | 23 |
| 2 | I-8 | " | 110 | 22 | 5 | >20' | 108 | 21 | 5 | 113 | 23 | 5 | ±0 | 22 |
| 3 | II-1 | " | 105 | 22 | 5 | >20' | 102 | 20 | 5 | 108 | 23 | 5 | −3 | 22 |
| 4 | III-1 | " | 102 | 22 | 5 | >20' | 99 | 20 | 5 | 105 | 23 | 5 | −2 | 22 |
| 5 | IV-17 | " | 100 | 21 | 5 | >20' | 96 | 19 | 5 | 104 | 22 | 5 | −3 | 21 |
| 6 | D-A | " | 110 | 20 | 2 | 5' | 108 | 17 | 2 | 125 | 16 | 1 | −28 | 18 |
| 7 | D-B | " | 95 | 18 | 5 | >20' | 85 | 12 | 5 | 110 | 16 | 2 | +3 | 18 |
| 8 | I-8 | H-1 | 95 | 22 | 5 | >20' | 92 | 21 | 5 | 98 | 22 | 5 | +2 | 22 |
| 9 | " | H-2 | 98 | 22 | 5 | >20' | 95 | 21 | 5 | 100 | 23 | 5 | ±0 | 22 |
| 10 | " | H-8 | 95 | 20 | 5 | >20' | 93 | 20 | 5 | 97 | 22 | 5 | −3 | 21 |
| 11 | " | H-26 | 95 | 22 | 5 | >20' | 93 | 21 | 5 | 97 | 23 | 5 | +4 | 22 |
| 12 | " | H-A | 96 | 16 | 5 | >20' | 78 | 9 | 5 | 105 | 16 | 5 | −2 | 16 |
| 13 | " | H-B | 105 | 22 | 5 | >20' | 103 | 19 | 5 | 109 | 23 | 5 | −35 | 9 |

Sensitizing Dyes:

D-A

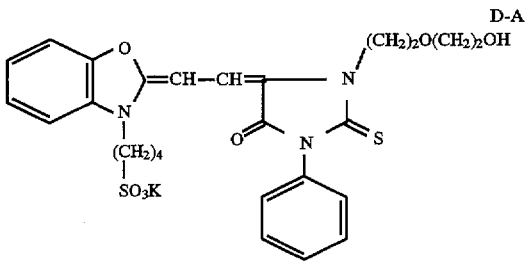

D-B

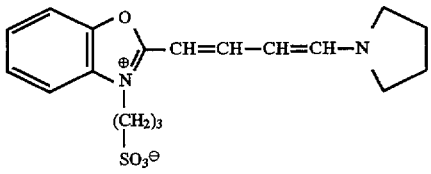

Results

In samples using a sensitizing dye represented by formula (OS-I), (OS-II), (OS-III) or (OS-IV), the contrast was high and the safelight safety was excellent, the change in sensitivity and gradation was small even when they were processed with a fatigue developer, and also the change in performance after enforced aging was small, whereas in samples using Sensitizing Dye D-A, the safelight safety was bad and the reduction in sensitivity after aging was large, and in samples using Sensitizing Dye D-B, the change in performance was large when processed with a fatigue developer. Further, in samples using Nucleating Agent A, the change in performance was large when processed with a fatigue developer and in samples using Nucleating Agent B, the reduction in sensitivity after aging was large although the change in performance in the processing with a fatigue developer was small. Thus, it is clearly understood that according to the present invention, a light-sensitive material for an Ar scanner which shows high contrast upon exposure at the wavelength of 488 nm, is excellent in the yellow safelight property, has superior running stability and ensures good storability can be obtained.

EXAMPLE 12

Comparative compounds of the nucleating agent are set forth below.

Comparative Nucleating Agents:

A-

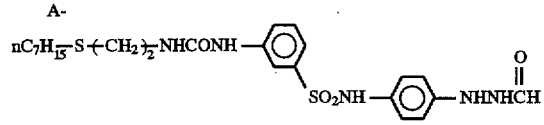

B

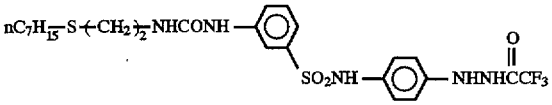

Selenium Sensitizer used in the Preparation of Emulsion below

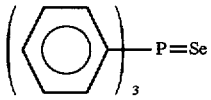

Preparation of Silver Halide Emulsion

[Emulsion $A_2$]

An aqueous silver nitrate solution and an aqueous halogen salt solution containing potassium bromide, sodium chloride, $K_3IrCl_6$ in an amount corresponding to $3.5\times10^{-7}$ mol/mol-Ag and $K_2Rh(H_2O)Cl_5$ in an amount corresponding to $2.0\times10^{-7}$ mol/mol-Ag were added to an aqueous gelatin solution containing sodium chloride and 1,3-dimethyl-2-imidazolidinethione while stirring by a double jet method to prepare silver chlorobromide grains having an average grain size of 0.25 μm and a silver chloride content of 70 mol %.

Thereafter, the emulsion was washed with water by a flocculation method according to a usual method, 40 g/mol-Ag of gelatin was added thereto, further 7 mg/mol-Ag of sodium benzenethiosulfonate and 2 mg/mol-Ag of benzenesulfinic acid were added thereto, the pH and the pAg were adjusted to 6.0 and 7.5, respectively, and the emulsion was subjected to chemical sensitization by adding 1 mg/mol-Ag of the above-described selenium sensitizer, 1 mg/mol-Ag of sodium thiosulfate and 4 mg/mol-Ag of chloroauric acid so as to show optimal sensitivity at 60° C. Then, 150 mg of 4-hydroxy-6-methyl-1,3,3a,7-tetrazaindene was added as a stabilizer and 100 mg of Proxel was added as an antiseptic. The resulting grains had an average grain size of 0.25 μm and each grain was a silver chlorobromide cubic grain having a silver chloride content of 70 mol % (coefficient of variation: 10%).

Preparation of Silver Halide Light-sensitive Material

On a polyethylene terephthalate film support undercoated by a moisture-proofing layer containing vinylidene chloride, a UL layer, an EM layer, a PC layer and an OC layer were coated in this order from the support side to prepare samples.

The preparation method and the coating amount of each layer are described below.

(UL Layer)

To an aqueous gelatin solution, 30 wt % on a gelatin basis of polyethyl acrylate dispersion was added, and the resulting solution was coated to give a gelatin coverage of 0.5 g/m$^2$.

(EM Layer)

To Emulsion $A_2$ prepared above, $5\times10^{-4}$ mol/mol-Ag of the following Compound (S-1) and $5\times10^{-4}$ mol/mol-Ag of Compound (S-2) as sensitizing dyes, $3\times10^{-4}$ mol/mol-Ag of a mercapto compound shown below as Compound (a), $4\times10^{-4}$ mol/mol-Ag of a mercapto compound shown below as Compound (b), $4\times10^{-4}$ mol/mol-Ag of a triazine compound shown below as Compound (c), $2\times10^{-3}$ mol/mol-Ag of 5-chloro-8-hydroxyquinoline, $1.4\times10^{-4}$ mol/mol-Ag of a nucleating agent (hydrazine derivative) shown in Table 11, and $2.5\times10^{-4}$ mol/mol-Ag of a nucleation accelerator shown in Table 11, $6.8\times10^{-4}$ mol of a surface active agent (corresponding to the compound represented by formula (SA-1), (SA-2), (SA-3) or (SA-4)), and $3\times10^{-2}$ mol/mol-Ag of hydroquinone were added. Further, 200 mg/m$^2$ of a polyethyl acrylate dispersion, 200 mg/m$^2$ of a latex copolymer of methyl acrylate, 2-acrylamido-2-methylpropanesulfonato sodium salt and 2-acetoacetoxyethyl methacrylate (weight ratio: 88:5:7), 200 mg/m$^2$ of colloidal silica having an average particle size of 0.02 μm, and 200 mg/m$^2$ of Compound (d) as a hardening agent were added. The resulting solution was coated to give a coated silver amount of 3.5 g/m$^2$.

In this case, samples aged at 40° C. for 8 hours before adding chemicals to be added subsequent to polyethyl acrylate and samples immediately coated with those chemicals but not aged were prepared. The pH of the solution before the addition of polyethyl acrylate was adjusted to 5.7 by an acetic acid.

(PC Layer)

To an aqueous gelatin solution, 50 wt % on a gelatin basis of an ethyl acrylate dispersion, 5 mg/m$^2$ of Surface Active Agent (w) shown below and 1,5-dihydroxy-2-benzaldoxime in an amount necessary for giving a coated amount of 10 mg/m$^2$ were added, and the resulting solution was coated to give a gelatin coverage of 0.5 g/m$^2$.

(OC Layer)

0.5 g/m$^2$ of gelatin, 40 mg/m$^2$ of an amorphous $SiO_2$ matting agent having an average particle size of about 3.5 μm, 0.1 g/m$^2$ of methanol silica, 100 mg/m$^2$ of polyacrylamide, 20 mg/m$^2$ of silicone oil, and as coating aids, 5 mg/m$^2$ of a fluorine surface active agent shown below by chemical formula (e) and 100 mg/m$^2$ of sodium dodecylbenzenesulfonate were coated.

Additives used in Example 12

(S-1)

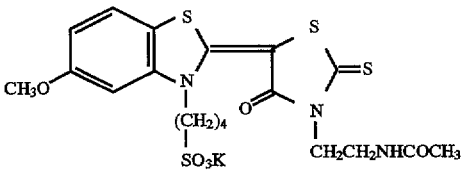

(S-2)

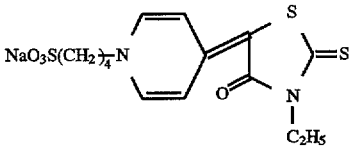

(a)

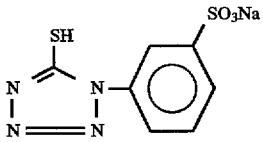

(b)

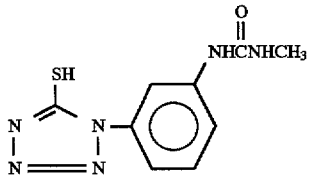

(c)

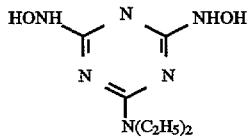

(d)

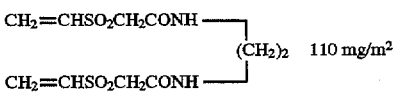

The coated samples each had a back layer and a back protective layer having the following compositions.

[Formulation of Back Layer]

| | |
|---|---|
| Gelatin | 3 g/m$^2$ |
| Latex: polyethyl acrylate | 2 g/m$^2$ |
| Surface active agent: sodium p-dodecylbenzenesulfonate | 40 mg/m$^2$ |
| Hardening agent: (d) above | 200 mg/m$^2$ |
| $SnO_2$/Sb (weight ratio: 90/10, average particle size: 0.20 μm) | 200 mg/m$^2$ |
| Dye: a mixture of Dyes [a], [b] and [c] | |
| Dye [a] | 70 mg/m$^2$ |
| Dye [b] | 70 mg/m$^2$ |
| Dye [c] | 90 mg/m$^2$ |

Dye [a]

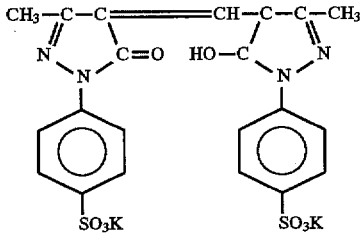

Dye [b]

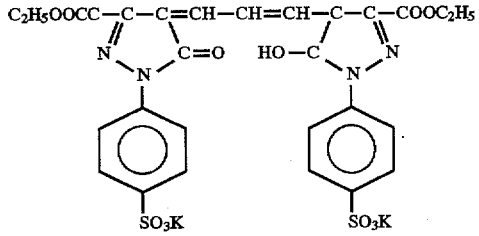

Dye [c]

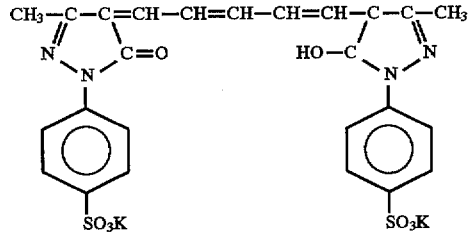

[Back Protective Layer]

| | |
|---|---|
| Gelatin | 0.8 mg/m$^2$ |
| Polymethyl methacrylate fine particle (average particle diameter: 4.5 μm) | 30 mg/m$^2$ |
| Dihexyl-α-sulfosuccinato sodium salt | 15 mg/m$^2$ |
| Sodium p-dodecylbenzenesulfonate | 15 mg/m$^2$ |
| Sodium acetate | 40 mg/m$^2$ |

Evaluation of Performance

The thus-prepared samples each was exposed to a xenon flash light using a step wedge through an interference filter having a peak at 488 nm for a luminescence time of $10^{-5}$ sec and then developed with Developer A" having the following composition at 35° C. for 30 seconds, followed by fixing, water washing and drying.

| Developer A": | |
|---|---|
| Potassium hydroxide | 35.0 g |
| Diethylenetriaminepentaacetic acid | 2.0 g |
| Potassium carbonate | 12.0 g |
| Sodium metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.15 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Sodium erysorbate | 3.0 g |
| Water to make | 1 l |
| pH adjusted by adding potassium hydroxide | 10.5 |

The fixing solution according to the following formulation was used.

| (Formulation of Fixing Solution) | |
|---|---|
| Ammonium thiosulfate | 359.1 ml |
| Disodium ethylenediaminetetraacetate dihydrate | 0.09 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH (adjusted by sulfuric acid or sodium hydroxide) | 4.85 |
| Water to make | 1 l |

(1) Change in Sensitivity due to Dissolution Aging of Coating Solution of EM Layer (i) The processed samples each was determined on the density and the change in sensitivity ($\Delta S_{1.5}$) was examined.

$\Delta S_{1.5}$: change in sensitivity upon dissolution aging of the emulsion coating solution (the difference ($\Delta$logE) in exposure amount necessary for giving a density 1.5 between a sample free of dissolution aging and a sample underwent dissolution aging; the larger the numerical value, the greater the increase in sensitivity).

(2) Evaluation of Storability of Nucleating Agent in Coated Sample and Evaluation of Photographic Properties Samples immediately after coating were designated as fresh samples.

Samples allowed to stand under conditions of 60° C. and 65% for 3 days were designated as thermostated samples.

(i) Determination of Nucleating Agent Residual Rate

From each of fresh and thermostated samples, a nucleating agent was extracted with an organic solvent and determined on the quantity using an HPLC.

Nucleating agent residual rate (%)=[(amount of nucleating agent extracted from the sample aged at 60° C. and 65% for 3 days)/(amount of nucleating agent extracted from the sample immediately after the coating)]×100

(ii) Change in Sensitivity

The above-described fresh and thermostated samples each was developed and determined on the sensitivity and the change in sensitivity ($\Delta S_{1.5}$) was calculated from the values obtained.

(iii) Change in Gradation (G0330)

The fresh and thermostated samples each was developed and examined on the change in gradation.

G0330: the gradation was expressed by the formula:

$$D(3.0-0.3)\div\{\log(D3.0)-\log(D0.3)\}$$

wherein log(D3.0) and log(D0.3) represent exposure amounts necessary for giving a density of 3.0 and a density of 0.3, respectively.

The results obtained are shown in Table 11 below.

TABLE 11

| | Hydrazine | | Compounds of | After Dissolution | Storability | | |
|---|---|---|---|---|---|---|---|
| No. | Nucleating Agent | Nucleation Accelerator | Formulae (SA-1) to (SA-4) | Aging ($\Delta S_{1.5}$) | Residual Rate (%) | $\Delta S_{1.5}$ | G0330 Fresh/Thermostated |
| 1 | A | A-152 | W1-16 | 0.03 | 92 | −0.01 | 7.6/7.3 |
| 2 | B | " | " | 0.03 | 35 | −0.11 | 17.4/9.8 |
| 3 | 3 | " | — | 0.10 | 90 | −0.02 | 18.5/17.6 |
| 4 | " | " | W1-16 | 0.02 | 97 | −0.01 | 19.7/18.9 |
| 5 | " | A-114 | " | 0.02 | 97 | −0.01 | 19.3/18.6 |
| 6 | " | A-211 | " | 0.03 | 95 | −0.02 | 20.3/19.4 |
| 7 | " | A-152 | W1-2 | 0.03 | 95 | −0.02 | 19.6/19.0 |
| 8 | " | " | W1-19 | 0.01 | 96 | 0 | 19.0/18.4 |
| 9 | " | " | W2-13 | 0.02 | 96 | −0.01 | 19.5/18.8 |
| 10 | " | " | W3-3 | 0.02 | 95 | −0.02 | 20.5/19.7 |
| 11 | " | " | PW-5 | 0.03 | 96 | −0.02 | 20.3/19.0 |
| 12 | 4 | " | W1-16 | 0.02 | 95 | −0.03 | 18.7/18.0 |
| 13 | 16 | " | " | 0.03 | 91 | −0.02 | 19.0/18.0 |
| 14 | 19 | " | " | 0.03 | 93 | −0.03 | 19.0/17.4 |

As clearly seen from the results in Table 11, by using the compound represented by formula (SA-1), (SA-2), (SA-3) or (SA-4) in combination, an ultrahigh contrast light-sensitive material could be obtained, which was low in the change in sensitivity due to the dissolution aging of the coating solution of the EM Layer and good in the storage stability.

EXAMPLE 13

Preparation of Emulsion

| | |
|---|---|
| Solution 1: | |
| Water | 750 ml |
| Gelatin | 20 g |
| Sodium chloride | 2 g |
| 1,3-Dimethylimidazolidine-2-thione | 20 mg |
| Sodium thiosulfonate | 10 mg |
| Solution 2: | |
| Water | 300 ml |
| Silver nitrate | 150 g |
| Solution 3: | |
| Water | 300 ml |
| Sodium chloride | 34 g |
| Potassium bromide | 32 g |
| Potassium hexachloroiridate | 0.25 mg |
| Ammonium hexabromorhodate | 0.06 mg |
| Yellow prussiate of potash | 5 mg |

To Solution 1 kept at 38° C. and a pH of 4.5, Solution 2 and Solution 3 each in an amount corresponding to 90% were added simultaneously while stirring over 20 minutes to form core grains having a size of 0.16 μm. Subsequently, Solution 4 and Solution 5 described below were added over 8 minutes and then Solution 2 and Solution 3 each in an amount corresponding to the remaining 10% were added over 2 minutes to grow the grains to a size of 0.18 μm. Further, 0.15 g of potassium iodide was added and the grain formation was completed.

| | |
|---|---|
| Solution 4: | |
| Water | 100 ml |
| Silver nitrate | 50 g |
| Solution 5: | |
| Water | 100 ml |
| Sodium chloride | 14 mg |
| Potassium bromide | 11 mg |
| Potassium ferrocyanide | 5 mg |

Thereafter, the emulsion was washed with water by a flocculation method according to a usual manner and 45 g of gelatin was added thereto. The pH and the pAg were adjusted to 5.6 and 7.5, respectively, and the emulsion was subjected to chemical sensitization by adding 10 mg of sodium thiosulfonate, 3 mg of sodium thiosulfinate, 1 mg of sodium thiosulfate, and 1 mg of Compound (a) and 5 mg of chloroauric acid so as to show optimal sensitivity at 55° C. Then, 200 mg of 1,3,3a,7-tetrazaindene as a stabilizer was added. Finally, a silver iodochlorobromide cubic grain emulsion containing 70 mol % of silver chloride and 0.08 mol % of silver iodide and having an average grain size of 0.18 μm was obtained (coefficient of variation: 9%).

(a)

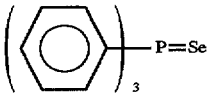

To the thus-obtained emulsion, $5.5\times10^{-4}$ mol/mol-Ag of a sensitizing dye, 5 g/mol-Ag of KBr, 5 g/mol-Ag of KI, 5 g/mol-Ag of hydroquinone as a stabilizer, 0.4 g/mol-Ag of Compound [b] shown below, 0.1 g/mol-Ag of Compound [c] shown below, and 1 g/mol-Ag of Compound [d] shown below were added.

(b)

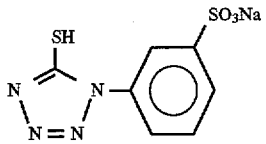

(c)

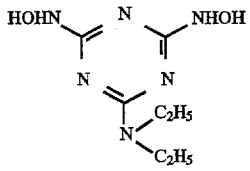

(d)

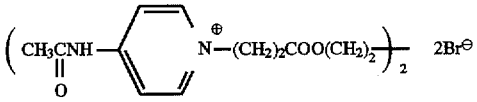

Further, to the emulsion, $1\times10^{-4}$ mol of a nucleating agent and 0.2 g of Compound A-1 shown below as a nucleation accelerator were added. Furthermore, 0.4 g of Compound [d] shown above, 0.4 g of sodium dodecylbenzenesulfonate, polyethyl acrylate latex and colloidal silica having a size of 0.01 μm each in an amount corresponding to 30% in terms of a gelatin binder ratio, and 2-bis(vinylsulfonylacetamido)-ethane as a hardening agent in an amount corresponding to 4% in terms of a gelatin binder ratio were added, and the resulting emulsion was coated on a polyester support undercoated by a moisture-proofing layer containing vinylidene chloride to have a silver coated amount of 3.2 g/m$^2$ and a gelatin coated amount of 1.4 g/m$^2$. By varying the kind of the nucleating agent or the sensitizing dye as shown in Table 14, samples 12-1 to 12-17 were prepared. At this time, a protective upper layer, a protective lower layer and a subbing layer each having the composition shown in Table 12 were coated simultaneously. The support had on the back surface thereof a back layer and a back protective layer each having the composition shown in Table 13.

TABLE 12

| | per m$^2$ |
|---|---|
| Protective lower layer | |
| Gelatin | 0.5 g |
| 1,5-Dihydroxy-2-benzaldoxime | 25 mg |
| α-Lipoic acid | 5 mg |
| Polyethyl acrylate latex | 160 mg |
| Protective upper layer | |
| Gelatin | 0.3 g |
| Silica matting agent having an average particle size of 2.5 μm | 30 mg |
| Silicone oil | 30 mg |
| Colloidal silica having a size of 0.01 μm | 30 mg |
| N-Perfluorooctanesulfonyl-N-propylglycine potassium salt | 10 mg |
| Sodium dodecylbenzenesulfonate | 25 mg |
| Compound [e] shown below | 25 mg |
| Subbing layer | |
| Gelatin | 0.5 g |
| Dye [f] shown below | 20 mg |
| N-Oleyl-N-methyltaurine sodium salt | 10 mg |

(e)

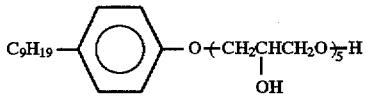

-continued

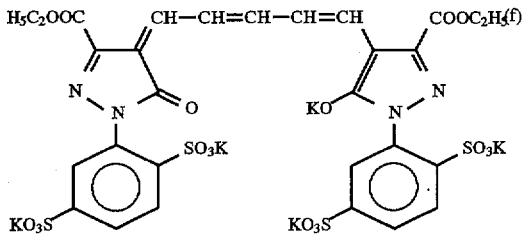

TABLE 13

| | per $m^2$ |
|---|---|
| **Back layer** | |
| Gelatin | 0.25 g |
| Sodium dodecylbenzenesulfonate | 20 mg |
| $SnO_2/SbO_2$ (9/1) having an average particle size of 0.25 μm | 200 mg |
| **Back protective layer** | |
| Gelatin | 3.0 g |
| Polymethyl methacrylate having an average particle size of 6.5 μm (coefficient of variation: 2%) | 50 mg |
| Dye [g] shown below | 35 mg |
| Dye [h] shown below | 35 mg |
| Dye [i] shown below | 120 mg |
| N-Perfluorooctanesulfonyl-N-propylglycine potassium salt | 10 mg |
| Sodium dodecylbenzenesulfonate | 90 mg |
| 2-Bis(vinylsulfonylacetamido)ethane | 160 mg |

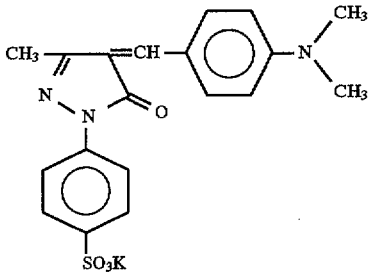

Dye [g]

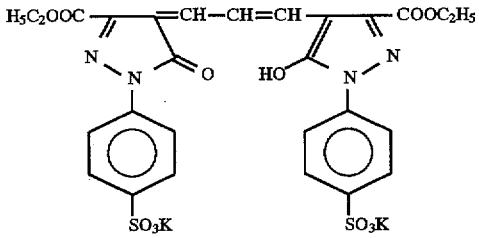

Dye [h]

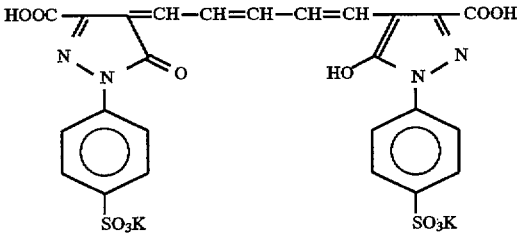

Dye [i]

The comparative dyes and comparative nucleating agents used in this Example are shown below.

A

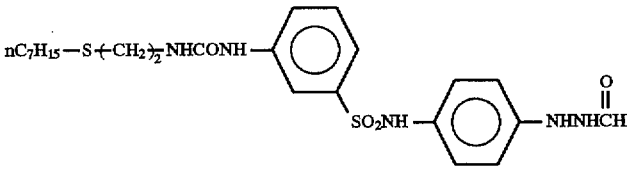

B

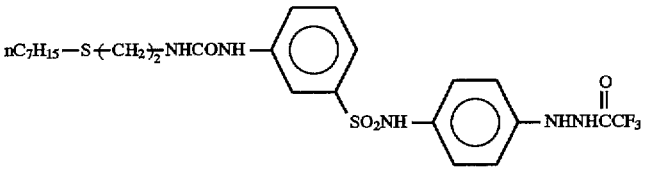

C

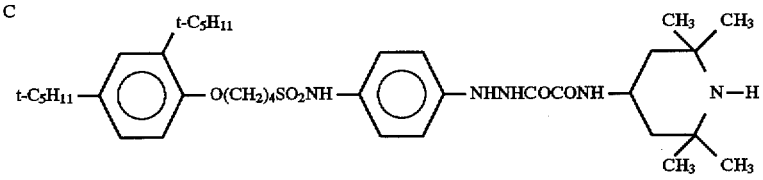

-continued

Sensitizing Dye D

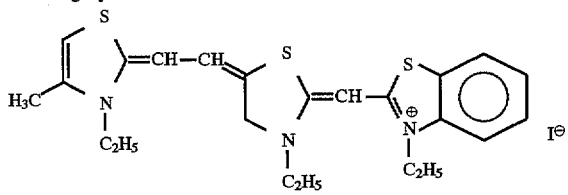

Sensitizing Dye E

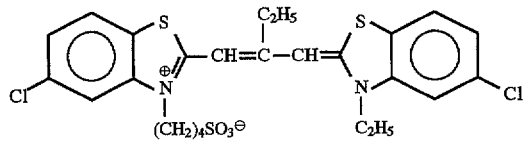

A-1

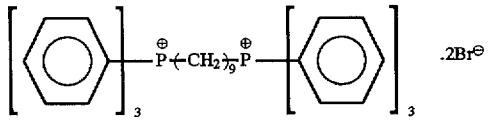

[Preparation of Fatigue Developer]

The developer having the following composition was designated as a fresh developer (Fresh).

| | |
|---|---|
| Potassium hydroxide | 35 g |
| Diethylenetriaminepentaacetic acid | 2 g |
| Potassium carbonate | 12 g |
| Sodium metabisulfite | 40 g |
| Potassium bromide | 3 g |
| Hydroquinone | 25 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Sodium erysorbate | 3 g |
| Water to make | 1 l |
| pH adjusted by adding potassium hydroxide | 10.45 |

Sample 1 in Table 14 was processed at a processing rate of 60 sheets per day over 2 weeks while replenishing the developer in an amount of 50 ml per one full-size sheet (20×24 inch) having a blacking ratio of 60% and the resulting developer was used as a fatigue solution.

The composition of the fixing solution used is shown below.

| | |
|---|---|
| Ammonium thiosulfate | 119.7 g |
| Disodium ethylenediaminetetraacetate dihydrate | 0.03 g |
| Sodium thiosulfate pentahydrate | 10.9 g |
| Sodium sulfite | 25.0 g |
| NaOH (as purity) | 12.4 g |
| Glacial acetic acid | 29.1 g |
| Tartaric acid | 2.92 g |
| Sodium gluconate | 1.74 g |
| Aluminum sulfate | 8.4 g |
| pH (adjusted by sulfuric acid or sodium hydroxide) | 4.8 |
| Water to make | 1 l |

[Test of Storability]

The storage under conditions of 50° C. and 60% RH for two weeks were designated as the enforced storage.

[Evaluation of Photographic Properties]

The thus-prepared samples each was exposed to a xenon flash light through a step wedge and an interference filter having a peak at 633 nm for a luminescence time of $10^{-6}$ sec, developed under conditions of 35° C. and 30 seconds using an automatic processor FG-680AG (manufactured by Fuji Photo Film Co., Ltd.), and then subjected to sensitometry.

The sensitivity was shown by a relative sensitivity to the reciprocal of the exposure amount necessary for giving a density of 1.5 and the gradation was shown by the gradient of a straight line connecting the density of 0.1 and the density of 3.0.

[Evaluation of Residual Color]

The expression area of each processed sample was visually evaluated and rated by 5 ranks. "5" is the best and "1" is the worst. Samples ranked "5" or "4" can be used in practice, samples ranked "3" are poor in quality but tolerable in practical use and samples ranked "2" or "1" cannot be used in practice.

The fixing solution used had the following composition.

The results obtained are shown in Table 14. Samples according to the present invention each provided excellent results with respect to the residual color and underwent no change in sensitivity and gradation even when it was subjected to enforced storage or processed with a fatigue developer. Sample 7 using Nucleating Agent A exhibited excellent storability but when it was processed with a fatigue developer, the sensitivity and the gradation were conspicuously deteriorated, Sample 8 using Nucleating Agent B exhibited excellent aptitude for the fatigue developer, and Sample 17 using Nucleating Agent C was inferior in the storability. Samples using Sensitizing Dye D or E were bad in the residual color but samples using a sensitizing dye represented by formula (OS-V), (OS-VI) or (OS-VII) provided good results with respect to the residual color.

TABLE 14

| | | | Fresh Developer | | | | | | |
|---|---|---|---|---|---|---|---|---|---|
| | Sensitizing | Nucleating | | | Enforced Storage | | Fatigue Developer | | Residual |
| No. | Dye | Agent | Sensitivity | Gradation | Sensitivity | Gradation | Sensitivity | Gradation | Color |
| 1 | OSV-1 | H-3 | 100 | 22 | 99 | 21 | 100 | 20 | 5 |
| 2 | " | H-11 | 98 | 20 | 100 | 19 | 99 | 19 | 5 |
| 3 | " | H-12 | 96 | 19 | 97 | 20 | 98 | 21 | 5 |
| 4 | " | H-14 | 98 | 21 | 102 | 20 | 101 | 20 | 5 |
| 5 | " | H-16 | 95 | 20 | 96 | 19 | 95 | 18 | 5 |
| 6 | " | H-17 | 98 | 21 | 99 | 20 | 99 | 18 | 5 |
| 7 | " | A | 95 | 20 | 95 | 18 | 80 | 12 | 5 |
| 8 | " | B | 100 | 21 | 88 | 14 | 98 | 20 | 5 |
| 9 | OSV-23 | H-3 | 95 | 20 | 93 | 19 | 95 | 18 | 5 |
| 10 | OSV-30 | H-11 | 96 | 21 | 94 | 20 | 95 | 21 | 4 |
| 11 | OSVI-1 | H-3 | 98 | 20 | 98 | 20 | 96 | 18 | 4 |
| 12 | OSVI-5 | H-3 | 95 | 19 | 93 | 19 | 92 | 19 | 4 |
| 13 | OSVII-3 | H-3 | 95 | 20 | 93 | 20 | 91 | 19 | 5 |
| 14 | OSVII-4 | H-3 | 94 | 19 | 93 | 19 | 90 | 18 | 4 |
| 15 | D | H-3 | 90 | 20 | 89 | 20 | 88 | 20 | 1 |
| 16 | E | H-3 | 100 | 21 | 98 | 19 | 99 | 18 | 2 |
| 17 | OSVI-1 | C | 95 | 19 | 94 | 18 | 88 | 15 | 4 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one silver halide emulsion layer, at least one layer of said emulsion layer and other hydrophilic colloid layers containing at least one hydrazine nucleating agent having, in the vicinity of the hydrazine group, an anionic group or a nonionic group which forms an intramolecular hydrogen bond with a hydrogen atom of the hydrazine, and containing a member selected from the group consisting of onium salt compounds represented by formula (a), (b) or (c) and amine compounds represented by formula (d), (e), (f), (g), (h), (i) or (j):

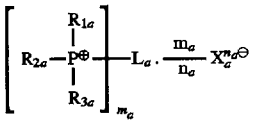

(a)

wherein $R_{1a}$, $R_{2a}$ and $R_{3a}$ each represents an alkyl group, a cycloalkyl group, an aryl group, an alkenyl group, a cycloalkenyl group or a heterocyclic residue, which each may be substituted; $m_a$ represents an integer of from 1 to 4; $L_a$ represents an $m_a$-valent organic group bonded to the P atom through the carbon atom thereof; $n_a$ represents an integer of from 1 to 3; $X_a$ represents an $n_a$-valent anion; and $X_a$ may be linked to $L_a$;

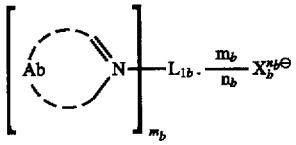

(b)

-continued

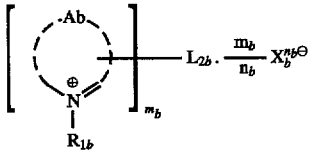

(c)

wherein $A_b$ represents an organic group necessary for completing the heterocyclic ring; $R_{1b}$ represents an alkyl group or an aryl group; $L_{1b}$ and $L_{2b}$ each represents an $m_b$-valent organic group; $X_b$ represents an anion group; $X_b$ may be linked to $R_{1b}$, $L_{1b}$ or $L_{2b}$; $m_b$ represents an integer of from 1 to 6; and $n_b$ represents an integer of from 1 to 3;

$$Y_d—[—(X_d)_{nd}—A_d—B_d]_{md} \quad (d)$$

wherein $Y_d$ represents a group which adsorbs to silver halide; $X_d$ represents a divalent linking group comprising an atom or an atomic group selected from a hydrogen atom, a carbon atom, a nitrogen atom, an oxygen atom and a sulfur atom; $A_d$ represents a divalent linking group; $B_d$ represents an amino group which may be substituted or a nitrogen-containing heterocyclic ring; $m_d$ represents 1, 2 or 3; and $n_d$ represents 0 or 1;

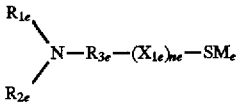

(e)

wherein $R_{1e}$ and $R_{2e}$ each represents a hydrogen atom or an aliphatic residue; $R_{1e}$ and $R_{2e}$ may be combined with each other to form a ring; $R_{e3}$ represents a divalent aliphatic group; $X_{1e}$ represents a divalent heterocyclic ring containing a nitrogen atom, an oxygen atom or a sulfur atom; $n_e$ represents 0 or 1; $M_e$ represents a hydrogen atom, an alkali metal, an alkaline earth metal or an amidino group;

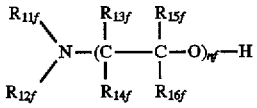

(f)

wherein $R_{11f}$ and $R_{12f}$ each represents a hydrogen atom, an alkyl group having from 1 to 30 carbon atoms, an alkenyl group having from 3 to 30 carbon atoms or an aralkyl group having from 7 to 30 carbon atoms, provided that when $R_{11f}$ and $R_{12f}$ represent an alkyl group at the same time, the total carbon number of $R_{11f}$ and $R_{12f}$ is 10 or more, that $R_{11f}$ and $R_{12f}$ are not a hydrogen atom at the same time and the $R_{11f}$ and $R_{12f}$ may be combined with each other to form a ring; $n_f$ represents an integer of from 2 to 50; and $R_{13f}$, $R_{14f}$, $R_{15f}$ and $R_{16f}$ each represents a hydrogen atom or an alkyl group having from 1 to 4 carbon atoms;

(g)

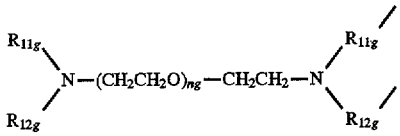

wherein $R_{11g}$ and $R_{11g}'$ each has the same meaning as $R_{11f}$ in formula (f), $R_{12g}$ and $R_{12g}'$ each has the same meaning as $R_{12f}$ in formula (f), and $n_g$ represents an integer of 2 to 50;

$$Y_h—[—(X_h)_{nh}—A_{oh}—B_h]_{mh} \quad (h)$$

wherein $X_h$, $Y_h$ and $B_h$ each has the same meaning as $X_d$, $Y_d$ and $B_d$ in formula (d); $A_{oh}$ represents a divalent linking group having at least two alkylene oxy units; $m_h$ represents 1, 2 or 3; and $n_h$ represents 0 or 1;

(i)

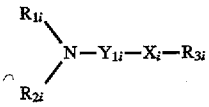

wherein $R_{1i}$ and $R_{2i}$ each represents an alkyl group, an alkenyl group or an alkynyl group and $R_{1i}$ and $R_{2i}$ may form a ring; $R_{3i}$ represents a hydrogen atom, an alkyl group, an alkenyl group, an alkynyl group, an aryl group or a heterocyclic group; $L_{1i}$ represents a divalent linking group; $X_i$ represents an $—[S—L_{2i}—Y_i—(L_{3i})_{ni}]—$ group or an $—[(L_{3i})_{ni}—Y_i—L_{2i}—S]—$ group; $L_{2i}$ represents an alkylene group or an alkenylene group; $Y_i$ represents a carbonyl group, a sulfonyl group, a sulfoxy group or a phosphoryl group; $L_{3i}$ represents —O—,

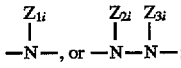

$Z_{1i}$, $Z_{2i}$ and $Z_{3i}$ each represents a hydrogen atom, an alkyl group, an alkenyl group, an alkynyl group, an aryl group or a heterocyclic group; and $n_i$ represents 0 or 1; and (j)

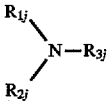

wherein $R_{1j}$, $R_{2j}$ and $R_{3j}$ each represents an alkyl group, an alkenyl group or an alkynyl group, provided that the compound represented by formula (j) has a thioether group and a partial structure of $—(O—Y_j)_{pj}—$; $Y_j$ represents an alkylene group which may be substituted, an alkenylene group which may be substituted or an arylene group which may be substituted; and $p_j$ represents an integer of 2 or greater;

wherein the hydrazine nucleating agent is a member selected from the compounds represented by formula (i), (ii) or (iv):

$$R^1—NHNH—C(=O)—L^1—Y^1 \quad (i)$$

wherein $R^1$ is an alkyl group, an aryl group or a heterocyclic group, $L^1$ is a divalent linking group having an electron withdrawing group, and $Y^1$ is an anionic group or a nonionic group selected from the group consisting of an alkoxyl group, an amino group, an alkylthio group, a carbonyl group, a carbamoyl group, an alkoxycarbonyl group, an urethane group, an ureido group, an acyloxy group, and an acylamino group, the nonionic group having a lone electron pair and at least one of an oxygen atom, a nitrogen atom, a sulfur atom and a phosphorus atom and being capable of forming an intramolecular hydrogen bond between the lone electron pair and the hydrogen atom of the hydrazine bond to form a 5-, 6-, or 7-membered ring, and:

$$R^2—NHNH—C(=O)—C(=O)—L^2—Y^2 \quad (ii)$$

wherein $R^2$ is an alkyl group, an aryl group or a heterocyclic group, $L^2$ is an alkylene group, an arylene group, a —NH-alkylene group, an —O-alkylene group, or a —NH-arylene group, an $Y^2$ is an anionic group or a nonionic group selected from the group consisting of an alkoxyl group, an amino group, an alkylthio group, a carbonyl group, a carbamoyl group, an alkoxycarbonyl group, an urethane group, an ureido group, an acyloxy group, and an acylamino group, the nonionic group having a lone electron pair and at least one of an oxygen atom, a nitrogen atom, a sulfur atom and a phosphorus atom and being capable of forming an intramolecular hydrogen bond between the lone electron pair and the hydrogen atom of the hydrazine bond to form a 5-, 6-, or 7-membered ring; or (vi)

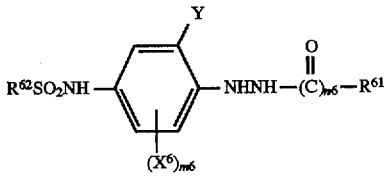

wherein $R^{61}$ and $R^{62}$ each independently represents an alkyl group, an alkenyl group, an alkynyl group, an aryl group, a heterocyclic group, an alkoxy group or an amino group, $X_6$ is a group capable of bonding to the benzene ring, m6 is an integer of 0 to 3, and n6 is an integer of 1 or 2, provided that when n6 is 1, $R^{61}$ is an alkyl group, an alkenyl group, an alkynyl group, an aryl group or a heterocyclic group which each have an electron-withdrawing group, and Y is an anionic group or nonionic group selected from the group consisting of an alkoxyl group, an amino group, an alkylthio group, a carbonyl group, a carbamoyl group, an alkoxycarbonyl group, an urethane group, an ureido group, an acyloxy group, and an acylamino group, the nonionic group having a lone electron pair and at least one of an oxygen atom, a nitrogen atom, a sulfur atom and a phosphorus atom and being capable of forming an intramolecular hydrogen bond between the lone electron pair and the hydrogen atom of the hydrazine bond to form a 5-, 6- or 7-membered ring, and when n6 is 2, $R^{61}$ is an amino group or an alkoxy group and Y is an anionic group.

2. The silver halide photographic material of claim 1, which contains a polymer latex having an active methylene group.

3. A method for processing a silver halide photographic material comprising processing, after exposure, the silver halide photographic material described in claim 1 with a developer containing a reductone developing agent and having a pH of 12 or less.

4. A silver halide photographic material as claimed in claim 1, wherein said member is represented by formula (a).

5. A silver halide photographic material as claimed in claim 1, wherein said member is represented by formula (b).

6. A silver halide photographic material as claimed in claim 1, wherein said member is represented by formula (c).

7. A silver halide photographic material as claimed in claim 1, wherein said member is represented by formula (d).

8. A silver halide photographic material as claimed in claim 1, wherein said member is represented by formula (e).

9. A silver halide photographic material as claimed in claim 1, wherein said member is represented by formula (f).

10. A silver halide photographic material as claimed in claim 1, wherein said member is represented by formula (g).

11. A silver halide photographic material as claimed in claim 1, wherein said member is represented by formula (h).

12. A silver halide photographic material as claimed in claim 1, wherein said member is represented by formula (i).

13. A silver halide photographic material as claimed in claim 1, wherein said member is represented by formula (j).

14. A silver halide photographic material as claimed in claim 1, wherein said hydrazine nucleating agent is represented by formula (i).

15. A silver halide photographic material as claimed in claim 1, wherein said hydrazine nucleating agent is represented by formula (ii).

16. A silver halide photographic material as claimed in claim 1, wherein said hydrazine nucleating agent is represented by formula (vi).

* * * * *